US010443364B2

(12) United States Patent
Parrella et al.

(10) Patent No.: US 10,443,364 B2
(45) Date of Patent: Oct. 15, 2019

(54) COMPREHENSIVE ENHANCED OIL RECOVERY SYSTEM

(71) Applicant: GTherm Energy, Inc., Houston, TX (US)

(72) Inventors: Michael J. Parrella, Katy, TX (US); Martin A. Shimko, Quechee, VT (US)

(73) Assignee: GTHERM ENERGY, INC., Houston, TX (US)

( * ) Notice: Subject to any disclaimer, the term of this patent is extended or adjusted under 35 U.S.C. 154(b) by 97 days.

(21) Appl. No.: 15/517,602

(22) PCT Filed: Oct. 8, 2015

(86) PCT No.: PCT/US2015/054668
§ 371 (c)(1),
(2) Date: Apr. 7, 2017

(87) PCT Pub. No.: WO2016/057780
PCT Pub. Date: Apr. 14, 2016

(65) Prior Publication Data

US 2017/0247992 A1 Aug. 31, 2017

Related U.S. Application Data

(60) Provisional application No. 62/061,462, filed on Oct. 8, 2014, provisional application No. 62/061,448, filed on Oct. 8, 2014.

(30) Foreign Application Priority Data

May 19, 2015 (WO) ..... PCT/US2015/031486

(51) Int. Cl.
*E21B 43/24* (2006.01)
*E21B 36/00* (2006.01)
(Continued)

(52) U.S. Cl.
CPC ..... *E21B 43/24* (2013.01); *E21B 36/005* (2013.01); *E21B 36/04* (2013.01); *E21B 43/003* (2013.01); *E21B 43/164* (2013.01); *E21B 43/305* (2013.01)

(58) Field of Classification Search
CPC ..... E21B 43/24; E21B 43/247; E21B 43/243; E21B 43/2408; E21B 43/168; E21B 43/2406; E21B 43/305; E21B 43/241
See application file for complete search history.

(56) References Cited

U.S. PATENT DOCUMENTS 3,066,733 A 12/1962 Brandon
3,125,072 A 3/1964 Brandt et al.
(Continued)

FOREIGN PATENT DOCUMENTS

WO 2013090901 6/2013

OTHER PUBLICATIONS

E.R. Rangel-German, et al., Abstract of "Electrical-heating-assisted recovery for heavy oil." Journal of Petroleum Science and Engineering, vol. 45, Issues 3-4, Dec. 15, 2004, pp. 213-231, available at www.sciencedirect.com/article/pii/S0920410504000993 (2 pages).
(Continued)

*Primary Examiner* — Zakiya W Bates
(74) *Attorney, Agent, or Firm* — Ware, Fressola, Maguire & Barber LLP

(57) ABSTRACT

A comprehensive enhanced oil recovery system that combines a plurality of different implementations of several enhanced oil recovery methods in an integrated system. The enhanced oil recovery system includes heating an underground reservoir having a heat transfer matrix to increase the temperature of the reservoir around a production well. The heat transfer matrix includes thermal injection wells, production wells and heat delivery wells.

30 Claims, 24 Drawing Sheets

(51) Int. Cl.

| | |
|---|---|
| ***E21B 43/30*** | (2006.01) |
| ***E21B 43/00*** | (2006.01) |
| ***E21B 43/16*** | (2006.01) |
| ***E21B 36/04*** | (2006.01) |

(56) References Cited

U.S. PATENT DOCUMENTS

| | | | | |
|---|---|---|---|---|
| 3,132,692 | A | 5/1964 | Marx et al. | |
| 3,520,362 | A | 7/1970 | Galle | |
| 4,077,220 | A | 3/1978 | Matthews | |
| 4,078,608 | A | 3/1978 | Allen et al. | |
| 4,319,632 | A | 3/1982 | Marr, Jr. | |
| 4,319,635 | A | 3/1982 | Jones | |
| 4,325,432 | A | 4/1982 | Henry | |
| 4,418,752 | A | 12/1983 | Boyer et al. | |
| 4,465,136 | A | 8/1984 | Troutman | |
| 4,824,447 | A | 4/1989 | Goldsberry | |
| 5,695,643 | A | 12/1997 | Brandt et al. | |
| 6,009,940 | A | 1/2000 | Eck et al. | |
| 6,012,521 | A | 1/2000 | Zunkel et al. | |
| 6,467,542 | B1 | 10/2002 | Kostrov et al. | |
| 6,536,523 | B1 | 3/2003 | Kresnyak et al. | |
| 6,585,046 | B2 | 7/2003 | Neuroth et al. | |
| 6,788,619 | B2 | 9/2004 | Calvert | |
| 6,988,549 | B1 | 1/2006 | Babcock | |
| 7,743,826 | B2 | 6/2010 | Harris et al. | |
| 7,814,975 | B2 | 10/2010 | Hagen et al. | |
| 8,851,169 | B2 | 10/2014 | Nikipelo | |
| 2003/0047309 | A1 | 3/2003 | Thomas et al. | |
| 2009/0056944 | A1 | 3/2009 | Nitschke | |
| 2009/0065197 | A1 | 3/2009 | Eslinger | |
| 2009/0090503 | A1 | 4/2009 | Groves | |
| 2009/0120633 | A1 | 5/2009 | Webb et al. | |
| 2010/0126395 | A1 | 5/2010 | Gauthier | |
| 2010/0170453 | A1 | 7/2010 | Betzer-Zilevitch | |
| 2014/0054032 | A1* | 2/2014 | Affholter | E21B 43/24 166/272.6 |
| 2014/0083693 | A1 | 3/2014 | Frank | |
| 2014/0190691 | A1* | 7/2014 | Vinegar | B09C 1/02 166/272.1 |
| 2014/0352947 | A1 | 12/2014 | Hallundbaek | |
| 2015/0117152 | A1 | 4/2015 | Martin et al. | |
| 2015/0138924 | A1 | 5/2015 | Schaefers et al. | |

OTHER PUBLICATIONS

Ahmad H. Haidari, et al., "Electrical Heating Methods for Oil Reservoir Stimulation", Mar. 11, 2013 (4 pages).
"Well Placement", www.niobraranews.net/well-placement, Jul. 2013 (8 pages).
Prats, Michael, Abstract for "Thermal Recovery", www.store.spe.org/Thermal-Recovery-P78.aspx, 1982 (2 pages).
"Porosity and Permeability", www.geomore.com/porosity-and-permeability-2, Feb. 2015 (3 pages).
Zusman, Neil, "Fracking: Gas Drilling and the Marcellus Shale", www.frack.mixplex.com/fracking, Aug. 24, 2010 (5 pages).
Gabe Bass, "Oil and Gas Basics: Drilling and Spacing Units." Bass Law, Jun. 4, 2012, 2 pages.
Albina Mukhametshina, et al., "Electromagnetic Heating of Heavy Oil and Bitumen: A Review of Experimental Studies and Field Applications." Journal of Petroleum Engineering, vol. 2013, Mar. 11, 2013, 7 pages.
"Thermal Recovery Methods for Heavy Oil Fields", www.mobilityoilandgas.com/thermal-recovery-methods-for-heavy-oil-fields, Apr. 2015 (5 pages).
Khalid Rashid Alnoaimi, "Heavy Oil Recovery: Definitions and Means", www.large.stanford.edu/courses/2010/ph240.alnoaimi1, Stanford University, Oct. 23, 2010, 5 pages.
Roger M. Butler, "Thermal Recovery of Oil and Bitumen", Department of Chemical and Petroleum Engineering, University of Calgary, 1991, pp. i-xi, 30-47 and 72-85.
"Steam-assisted gravity drainage", www.wikipedia.org/wiki/Steam-assisted_gravity_drainage, Nov. 2014 (8 pages).
"Pressure gradient", www.wikipedia.org/wiki/Pressure-gradient, Nov. 2014 (2 pages).
"Gradient", www.wikipedia.org/Gradient, Nov. 2014 (8 pages).
"Pressure-gradient force", www.wikipedia.org/Pressure-gradient-force, Nov. 2014 (2 pages).
International Preliminary Report on Patentability, PCT/US15/31486, dated Oct. 14, 2016 (5 pages).
International Search Report and Written Opinion, PCT/US15/31486, dated Mar. 28, 2016 (8 pages).
International Search Report and Written Opinion, PCT/US15/54646, dated Mar. 4, 2016 (13 pages).
International Search Report and Written Opinion, PCT/US15/54650, dated Feb. 25, 2016 (16 pages).
International Preliminary Report on Patentability, PCT/US15/54650, dated Oct. 14, 2016 (4 pages).
USPTO Office Action, U.S. Appl. No. 15/517,586, filed Apr. 5, 2018 (25 pages).
"Oversight Hearing on Spinning Straw Into Black Gold: Enhanced Oil Recovery Using Carbon Dioxide", U.S. House of Representatives Subcommittee on Energy and Mineral Resources Committee on Natural Resources, Jun. 12, 2008 (41 pages).
Laura Romero-Zeron, "Advances in Enhanced Oil Recovery Processes", www.intechopen.com, May 2012 (43 pages).
"The Global Taxonomy Initiative—The Response to a Problem", Secretariat of the Convention on Biological Diversity, Mar. 2015 (2 pages).
"Turbine", www.wikipedia.org/wiki/Turbine, Mar. 2015 (9 pages).
Per Johansson, et al., "Heavy Crude Oil as a Fuel for the SGT-500 Gas Turbine", VIII Forum Turbomaquinas Petrobras, Aug. 2011 (10 pages).
"Boiler (power generation)", www.wikipedia.org/wiki/Boiler_(power_generation), Mar. 2015 (10 pages).
"Boiler", www.wikipedia.org/wiki/Boiler, Mar. 2015 (10 pages).
"Gas flare", www.wikipedia.org/wiki/Gas_flare, Mar. 2015 (3 pages).
"Furnace", www.wikipedia.org/wiki/Furnace, Mar. 2015 (4 pages).
"Volumetric Heat Capacity", www.wikipedia.org/wiki/Volumetric_heat_capacity, Apr. 2015 (4 pages).
USPTO Office Action in U.S. Appl. No. 15/517,572 dated Aug. 2, 2019.

* cited by examiner

PRIOR ART

FIG. 3c
FIG. 3d
Water = 1 CP
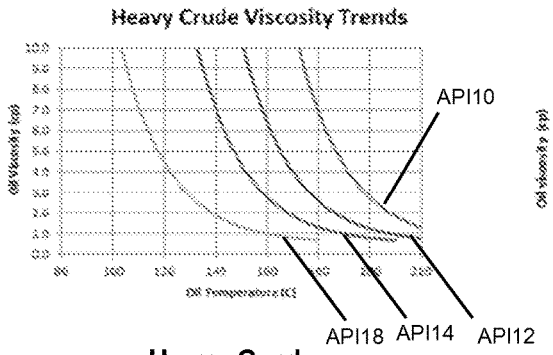
Heavy Crude
API < 22
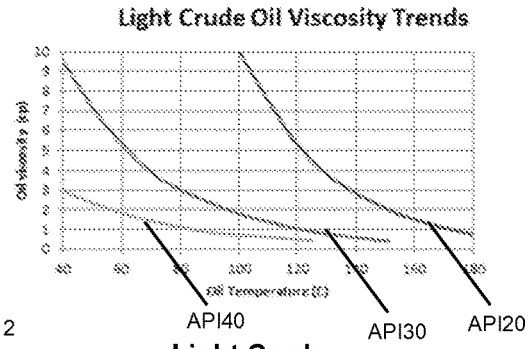
Light Crude
API > 30
FIG. 3e
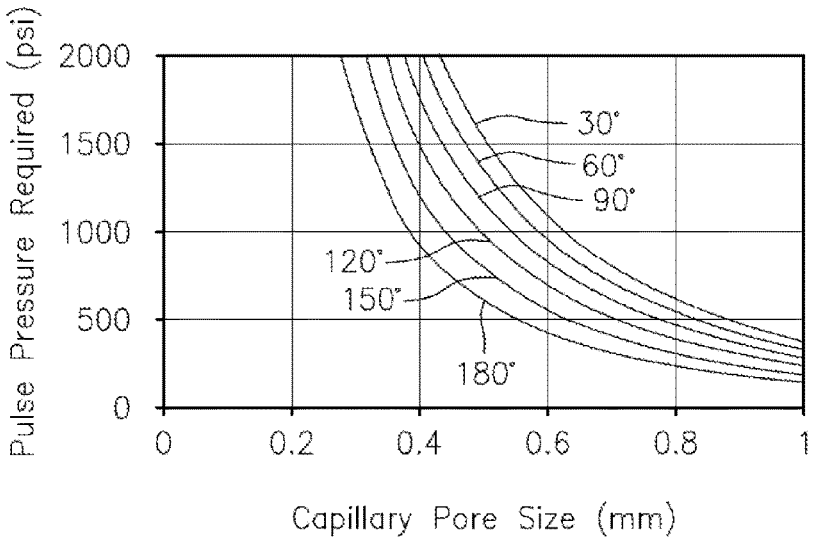

COMPREHENSIVE ENHANCED OIL RECOVERY SYSTEM

CROSS-REFERENCE TO RELATED APPLICATIONS

The present application claims the benefit of U.S. Provisional Patent Application Ser. No. 62/061,462 filed Oct. 8, 2014, U.S. Provisional Patent Application Ser. No. 62/061,448 filed Oct. 8, 2014, and International Patent Application No. PCT/US15/31486, filed May 19, 2015 claiming the benefit of U.S. Provisional Patent Application Ser. No. 62/061,462 filed Oct. 8, 2014, each of which are hereby incorporated by reference in their entirety.

BACKGROUND OF THE INVENTION

There are many techniques currently used for enhanced recovery of oil. Examples of such techniques are listed in the diagram shown in FIG. 1. The techniques include water flooding, $CO_2$ flooding and polymer flooding for light crude oil, and steam flooding and fire flooding for heavy crude oil. The techniques are usually implemented individually and most of the techniques require low viscosity oil. These techniques also have many negative impacts, as they present an adverse environmental impact and high greenhouse gas emission, require high supply and costs for water, gas and chemicals, carry a high fuel cost and also present permitting problems.

The use of horizontal drilling and hydraulic fracturing (also known as fracking) is the predominate technique currently used to improve oil and gas extraction. This method cracks the rock surrounding the production well creating paths for the flow of oil and gas, as shown for example in FIGS. 2*a* and 2*b*. Hydraulic fracturing is a well stimulation process used to maximize the extraction of underground resources, namely oil and gas. The hydraulic fracturing process requires the acquisition of large quantities of source water, construction of a well, stimulation of a well, and disposal of waste. Hydraulic fracturing involves the pressurized injection of fracturing fluids commonly made up of water and chemical additives, into a geologic formation. The pressure exceeds the rock strength and the fluid opens or enlarges fractures in the rock. As the formation is fractured, propping agents, such as sand or ceramic beads, are pumped into the fractures to keep them from closing as the pumping pressure is released. The fracturing fluids are then returned to the surface. Gas and oil will flow from pores and fractures in the rock into the production well for subsequent extraction. Wells used for hydraulic fracturing are drilled vertically and horizontally, or directionally. For example, FIG. 2*a* depicts the process including vertical and horizontal drilling. Wells may extend to depths greater than 10,000 feet or less than 1,000 feet, and horizontal sections of a well may extend many thousands of feet away from the production pad located on the surface. FIG. 2*b* shows, for example, an oil, gas or brine reservoir 51 with production wells 58 feeding into an oil, gas and brine separator 56. The oil 57 that is separated is transported and stored. The hot brine 53 that is separated is sent back into the reservoir for hot brine flooding 57.

Once the oil and gas surrounding these fractured rock paths become depleted, the flow dramatically diminishes. As indicated in FIG. 24, oil or gas production (line 24*a*) significantly falls off within 12 to 18 months. The severity of the depletion curve requires that many wells be drilled and fractured to keep production rates up.

It is an objective of the invention is to accomplish the following with respect to crude oil: rejuvenate depleted wells, improve the extraction rate for green fields, increase the oil reserves, improve the life of the oil fields, eliminate flaring gas, create energy to sustain an oil field without an electric grid or diesel generators, and improve the costs and profitability associated with oil recovery and optionally generate extra electricity to sell to electric users.

SUMMARY OF THE INVENTION

The present invention relates to a comprehensive enhanced oil recovery system that combines a plurality of different implementations of several enhanced oil recovery methods and deploys them in specific geometric arrangements in an integrated system that results in oil extraction rates and total recoverable oil that far exceeds any individually implemented methods. The specific configuration of the injection, production, and thermal input wells is key to successful implementation of these combined technologies.

Though discussed individually below, the comprehensive enhanced oil recovery system combines these aspects into an integrated system. The individual techniques, when combined, create compounded recovery effects. Because of the combination of components and configuration, the comprehensive system of the invention has an effect that is much greater than the sum of each of the individual methods and uses common equipment in its implementation to minimize the up-front equipment cost. There are several options for the specific arrangement of the production, injection, and thermal input wells that will be discussed below and are custom fit to an individual oil field.

The present invention can be implemented with oil fields having high or low viscosity oil and low or high permeability. The types of oil fields that can be used with the comprehensive recovery system of the invention include tar sands, heavy crude oil fields, shale oil fields and depleted oil fields.

Heat is applied to an oil field to lower the viscosity and surface tension in crude oil fields. As the heat applied to the oil raises the temperature of the oil and rock matrix, the viscosity of the oil decreases, and the flow and mobility of the oil increases. This process of heat release into the formation from the oil/heat delivery matrix (implementation design of a combination of heated production wells, heat radiating wells and injection wells with heated brine, gases, $CO_2$, $N_2$, pressure and pulsing waves, which is described further herein) changes the viscosity of the oil or fluids. Heat flow is enhanced as convective flow cells in the formation are created by the temperature difference between the area around a hot horizontal well and the normal formation temperature.

The system design for the delivery of heat is specific to the reservoir characteristics. The comprehensive enhanced oil recovery system is designed to move the volumetric oil and gas in a treated volume of the reservoir to the producer wells. To accomplish this effect, a system is designed to create low viscosity flow paths through which the fluids can be herded to the producer wells.

The techniques that are implemented in the comprehensive oil recovery system according to the invention can include:

Thermal Flooding: Lowering oil viscosity through the conductive and convective introduction of heat from a closed loop inside a horizontal well allows crude oil to flow easier. Geothermal heat and/or a "Green Boiler" (which productively burns normally flared gas) are used to create heat that is introduced into the reservoir via the oil/heat delivery matrix to lower viscosity of the crude oil. This reduction can be by several orders of magnitude in the case of highly viscous, heavy crude oils. This heat creates initial low-viscosity pathways for oil flow to production wells and both water and $CO_2$ flooding from injection wells.

Hot Brine (Water) Flooding: Brine (i.e., water) normally separated from oil during the extraction process is heated and returned to the oil reservoir to introduce additional heat, and provide pressure and pulses to stimulate flow of the crude. This hot water flow carries enormous amounts of heat energy and significantly accelerates the growth of the low viscosity/high flow paths for oil in the reservoir. The hot water vapor in the exhaust of the "Green Boiler" is also injected into the reservoir.

$CO_2$ Flooding: $CO_2$ from the exhaust gas created by burning flare gas and/or crude oil derivatives is injected into the reservoir which results in a variety of positive effects. Because it is compressible, the $CO_2$ injected to displace the harvested oil maintaining the reservoir pressure can be pressurized along with the injected water to create a pressure gradient in the reservoir and thus further enhancing flow of the oil. The $CO_2$ also combines with the oil, additionally lowering the oil viscosity. The $CO_2$ can be injected in a separate injection tube with the well or can be delivered by alternating the gas and brine in the injection process. The $CO_2$ will then mix with the brine in the reservoir. The $CO_2$ thermal energy is combined with the injected water and further enhances and spreads the heat, which further increases the low viscosity/high flow region in the reservoir. In addition, the $CO_2$ component has the lowest viscosity and penetrates the volumetric capillary cracks in the shortest time.

Wave Pulsing: High and low pressure waves are produced by injection and production pumps and transducers that are carefully controlled by an operating system that coordinates the pressures and pulses to establish constructive wave interference. An innovative pulse creation system can be utilized, which triggers intermittent, high rate steam collapse at the injector well exit ports creating extremely high amplitude, steep gradient pressure pulses. The resulting shock-like pulses free tightly held oil from the small capillaries held in the formation by surface tension. The increased oil temperature lowers the pressure gradient required for even the smallest capillary voids. The freed oil is then pushed and pulled along with the water and gas toward the production well. This improves the extraction rate and, more importantly, percentage of oil recoverable from the reservoir. The system is designed to achieve at least two levels of constructive interference maximizing the wave amplitudes in the reservoir. A software based control system, including a non-transitory computer readable medium comprising a memory and a processor, will use feedback from pressure and temperature sensors in the field (near production and injection wells, as well as specific monitoring wells) to "hunt" for the frequency and phasing combination that maximizes oil yield rates. The optimum parameters will constantly be updated as the peak oil flow conditions will change as the reservoir matures.

The present invention incorporates a flow path approach, wherein heat delivery wells create low viscosity flow paths for the oil to flow to the production wells. The flow paths allow the other enhanced oil recovery techniques to operate with maximum efficiency. Heat delivery radiating wells create an oil/heat delivery matrix of low viscosity paths for the flooding (steam, water and $CO_2$), pressure and pulsing to directionally enhance oil flow to the producer wells.

Providing a heat delivery well with a cross-hatched design in accordance with the invention provides further benefits, including lower drilling and installation costs, providing immediate low viscosity flow zones, creating many simultaneous flow paths, beneficial and non-linear heat expansion once flow starts, and a design that over time addresses the entire net-pay zone. In effect the injected fluids progressively scour the oil from the rock matrix at the thermal edge of an expanding heated flow zone.

According to a first aspect of the invention, a method is provided that comprises heating an underground reservoir within at least one volume surrounding at least one production well in the underground reservoir having a plurality of thermal wells arranged to form a heat transfer matrix with the plurality of thermal wells arranged in relation to one another and to the at least one production well so as to transfer heat to increase temperature within the volume at least between the at least one production well and the plurality of thermal wells, and recovering crude oil that flows to the at least one crude oil production well in the underground reservoir heated by the heat transfer matrix.

According to an embodiment of the first aspect of the invention, the method comprises stimulating the underground reservoir within the at least one volume surrounding the production well with synchronized pressure waves provided in the production well and in one or more of the thermal wells.

According to a further embodiment of the first aspect of the invention, the method further comprises burning natural gas or a portion of the crude oil extracted from the underground reservoir, or burning both natural gas and crude oil extracted from the underground reservoir, for providing thermal energy, using recycled $CO_2$ in place of $N_2$ in the inlet flow to burning devices so that the flame temperature of the combustion can be controlled without adding additional volume (generally in the form of $N_2$) to the exhaust stream, transferring the thermal energy to brine separated from the extracted oil, gas, or both, for providing heated brine, or converting the thermal energy to mechanical work, or both transferring the thermal energy to the separated brine and converting the thermal energy to mechanical work, and heating the underground reservoir with the heated brine injected into a thermal well comprising an injection well in the underground reservoir, or heating the underground reservoir with a resistive cable in a thermal well comprising a heat delivery well, the resistive cable energized by electricity generated by converting the mechanical work to electric energy, or heating the underground reservoir with both the heated brine and the energized resistive cable.

According to a further embodiment of the first aspect of the invention, the method comprises burning natural gas recovered with the recovered crude oil or from a portion of the recovered crude oil, or from both the recovered natural gas and a portion of the recovered crude oil to heat circulating water and transfer heat from the heated circulating water to brine extracted from the underground reservoir and returning the heated brine to the underground reservoir via at least one of the thermal wells. This embodiment of the method may further include stimulating the underground reservoir within the at least one volume surrounding the production well with synchronized pressure waves provided in the production well and in one or more of the wells for thermal flooding. The method according to this embodiment may additionally or alternatively include mixing exhaust gas generated from the burning with the brine for thermal flooding, which may include further stimulating the underground reservoir within the at least one volume surrounding the production well with synchronized pressure waves provided in the production well and in one or more of the wells for thermal flooding.

According to a further embodiment of the first aspect of the invention, the transfer of heat gradually spreads within the at least one volume and increases the temperature in the at least one volume until the temperature stabilizes. According to this embodiment, the method may comprise increasing by a selected amount the portion of the recovered crude oil or natural gas recovered with the recovered crude oil, or both, until the temperature stabilizes at a higher temperature level and repeating the increasing by selected amounts until the temperature stops stabilizing at increased temperature levels.

According to a further embodiment of the first aspect of the invention the plurality of thermal wells include both at least one thermal injection well for injecting heated water into the at least one volume surrounding the least one production well and at least one heat delivery well for heating the at least one volume surrounding the least one production well with an electric cable or with heated water circulating within the at least one heat delivery well, the at least one volume having the at least one thermal injection well and the at least one heat delivery well arranged in relation to one another and to the at least one production well so as to increase temperature within the at least one volume between the at least one production well and the at least one heat delivery well, and between the at least one production well and the at least one thermal injection well.

According further to an embodiment of the first aspect of the invention, the thermal wells are arranged in relation to one another and to the at least one production well so as to define a volumetric shape for the at least one volume surrounding the at least one production well. The volumetric shape can be a tubular shaped volume extending into the underground reservoir having the at least one production well as a central axis of the tubular shaped volume surrounded by the plurality of thermal wells arranged at points around the central axis and extending into the underground reservoir parallel to the at least one production well. The tubular volumetric shape can be cylindrical. In another embodiment, the volumetric shape has a polygonal cross section extending into the underground reservoir having the at least one production well as a central axis of the at least one volume surrounded by the plurality of thermal wells arranged at points around the central axis and extending into the underground reservoir parallel to the at least one production well. The at least one production well may comprise a plurality of production wells radiating into the reservoir from an oil well pad having a central axis perpendicular to a surface of the earth with each at least one production well situated in a well set of a corresponding plurality of well sets that each include a thermal injection well and a heat delivery well, the corresponding plurality of well sets arranged as sectors that form a circle around the oil well pad. The volumetric shape may have a circular cross section extending into the underground reservoir having the at least one production well as a central axis of the at least one volume surrounded by the plurality of thermal injection wells arranged at points around the central axis and extending into the underground reservoir parallel to the at least one production well. The volumetric shape can be a parallelepiped, such as a rectangular parallelepiped shape. The volumetric shape may also be a polyhedron shape. The plurality of thermal wells may comprise at least two thermal injection wells arranged in parallel to the at least one production well and situated on opposite sides of the at least one production well. The plurality of thermal wells can comprise at least two heat delivery wells arranged perpendicular to the at least one production well and the at least two thermal injection wells. The plurality of thermal wells can also comprise at least one heat delivery well arranged in parallel to the at least one production well and situated between the at least one production well and at least one of the at least two thermal injection wells. In an embodiment, at least one of the at least two thermal injection wells is equipped with an injection well pressure wave generator and the method further comprises stimulating the underground reservoir within the at least one volume surrounding the production well with pressure waves. The at least one production well can be equipped with a production well pressure wave generator and the method further comprises stimulating the underground reservoir within the at least one volume surrounding the production well with pressure waves synchronized with the pressure waves provided in the at least one injection well.

According further to an embodiment of the first aspect of the invention, the thermal wells are arranged in relation to one another and the at least one production well to form a circle around the at least one production well.

According to a second aspect of the present invention, an apparatus is provided. The apparatus comprises a heat transfer matrix including a plurality of thermal injection wells arranged in relation to one another and to at least one production well for transferring heat to an underground reservoir at least within at least one volume surrounding the at least one production well so as to increase temperature within the at least one volume and at least one production pump for recovering crude oil that flows to the at least one crude oil production well in the underground reservoir heated by the heat transfer matrix.

The apparatus according to the second aspect of the invention may further comprise pressure wave stimulators for stimulating the underground reservoir within the at least one volume surrounding the production well with synchronized pressure waves provided in the production well and in one or more of the plurality of thermal injection wells.

In one embodiment of the apparatus according to the second aspect of the invention, the apparatus comprises a boiler for burning natural gas or a portion of the crude oil recovered from the underground reservoir, or for burning both natural gas and a portion of the crude oil recovered from the underground reservoir, for transferring thermal energy to a circulating fluid, a heat exchanger for receiving both brine separated from the recovered oil and natural gas and the circulating fluid from the boiler for transferring the thermal energy from the circulating fluid to the brine separated from the extracted oil and natural gas, for providing heated brine, and at least one injection pump for injecting the heated brine into at least one thermal injection well of the plurality of thermal injection wells in the underground reservoir for transferring heat to the underground reservoir with the heated brine. This embodiment of the apparatus may further comprise a mixer responsive to exhaust from the boiler for mixing the exhaust with the brine.

According further to an embodiment of the apparatus of the second aspect of the invention, a plurality of thermal injection wells are arranged in relation to one another and to the at least one production well so as to define a volumetric shape for the at least one volume surrounding the at least one production well. The volumetric shape can be tubular extending into the underground reservoir having the at least one production well as an axis of the tubular shaped at least one volume surrounded by the plurality of thermal injection wells arranged at points around the axis and extending into the underground reservoir parallel to the at least one production well. The tubular volumetric shape can be cylindrical and the axis is a central axis perpendicular to a surface of the earth penetrated by the production well.

According further to the second aspect of the invention, the volumetric shape may have a polygonal cross section extending into the underground reservoir having the at least one production well as an axis of the at least one volume surrounded by the plurality of thermal injection wells arranged at points around the axis and extending into the underground reservoir parallel to the at least one production well.

According further to the second aspect of the invention the volumetric shape may have a circular cross section extending into the underground reservoir having the at least one production well as a central axis of the at least one volume surrounded by the plurality of thermal injection wells arranged at points around the central axis and extending into the underground reservoir parallel to the at least one production well and the central axis is perpendicular to a surface of the earth penetrated by the production well. The volumetric shape can be a parallelepiped. The parallelepiped shape is a rectangular parallelepiped shape. The volumetric shape can also be a polyhedron shape. According to an embodiment of the apparatus, at least two thermal injection wells of the plurality of thermal injection wells are parallel to the at least one production well and are situated on opposite sides of the at least one production well. A part of the production well that is parallel to the at least two thermal injection wells extends at an angle from a perpendicular to a surface of the earth.

According to a further embodiment of the apparatus according to the second aspect of the invention, thermal injection wells are arranged in relation to one another and the at least one production well to form a circle around the at least one production well and the axis is a central axis perpendicular to a surface of the earth penetrated by the production well.

According further to the apparatus of the second aspect of the invention, the transfer of heat from the heat transfer matrix gradually spreads within the at least one volume and increases the temperature in the at least one volume until the temperature stabilizes.

According to a further embodiment of the apparatus of the second aspect of the invention, the plurality of thermal wells can include both at least one thermal injection well for injecting heated water into the at least one volume surrounding the least one production well and at least one heat delivery well for heating the at least one volume surrounding the least one production well with an electric cable or with heated water circulating within the at least one heat delivery well, the at least one volume having the at least one thermal injection well and the at least one heat delivery well arranged in relation to one another and to the at least one production well so as to increase temperature within the volume between the at least one production well and the at least one heat delivery well, and between the at least one production well and the at least one thermal injection well.

According to a further embodiment of the apparatus of the second aspect of the invention, the at least one production well comprises a plurality of production wells radiating into the reservoir from an oil well pad having an axis perpendicular to a surface of the earth with each at least one production well situated in a well set of a corresponding plurality of well sets that each include a thermal injection well and a heat delivery well, the corresponding plurality of well sets arranged as sectors that form a circle around the oil well pad in a center of the circle.

BRIEF DESCRIPTION OF THE FIGURES

FIGS. 3*c* and 3*d* show the changes in viscosity versus temperature for various levels of API.

FIG. 3*e* shows the pulse pressure required to move oil from different size pores with a pressure wave at a given frequency and propagation speed in a tight reservoir at various temperatures.

DETAILED DESCRIPTION OF THE FIGURES

Figure 1:
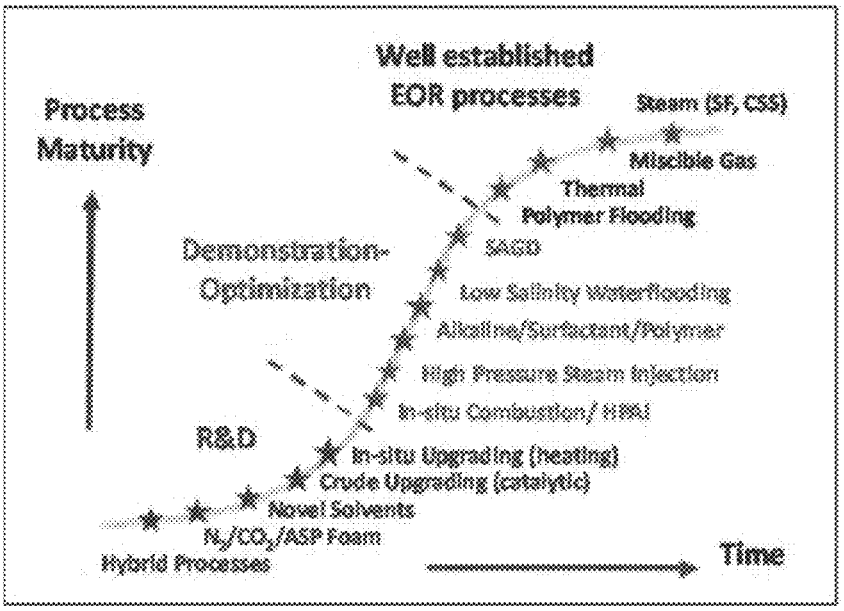
FIG. 1 shows the oil recovery techniques according to the prior art, and their process maturity relative to time.
Figure 2A:
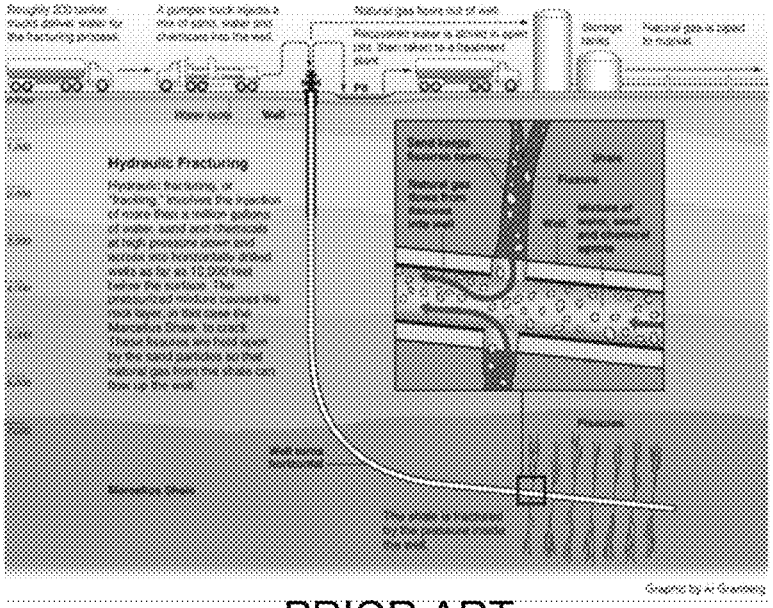
PRIOR ART FIG. 2a
FIG. 2*a* shows the industry standard horizontal drilling and fracturing approach to extract oil according to the prior art.
Figure 2B:
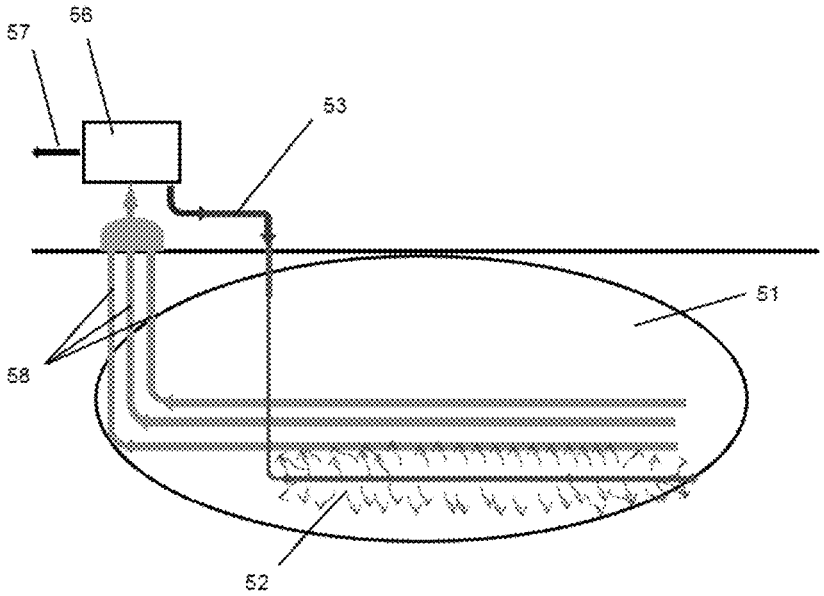
FIG. 2*b* shows a standard extraction well with flaring gas.

The comprehensive enhanced oil recovery system according to the invention can integrate one or more of the following features:

1. A boiler system that provides power and resources in a closed loop. (See, e.g., FIGS. 4-8)
2. Thermal input into a field from a closed-loop fluid flow or radiating resistant electric cable in horizontal wells implemented in circular formations (See, e.g., FIG. 31), lateral formations (See, e.g., FIGS. 20*a*-20*c*, 21*a*-21*c*, 22*a*-22*c*, 25*a*-25*b*, 26, 27*a*-27*c*, 28, 29, 30*a*-30*c*), or angular formations (FIG. 23).
3. Gradient pressurized hot fluid injection from a perforated vertical or horizontal well (See, e.g., FIGS. 21*a*-21*c*, 23*a*-22*c* and 23) (either brine or $CO_2$, or both brine and $CO_2$, additives may be optionally used).
4. Gradient pressurized hot oil, gas and brine (with optional additives) fluid extraction from a perforated vertical or horizontal producer well (See, e.g., FIGS. 21*a*-21*c*, 22*a*-22*c* and 23).
5. Imposing pressure pulse excitation to the injection and producer formations using the "Green Boiler" system with pulsing devices. The injection and production pulsing ports are placed one wavelength apart of the frequency of the standing wave (pressure wave or pulse) in order to create constructive interference of the waves emitted from the injection wells and the producer wells individually thereby doubling the amplitude of the pulses of each of the wells (See, e.g., FIGS. 10*a*-10*d* and 15).
6. Creating additional levels of constructive interference when the injection pulses from the injection wells meet the extraction pulses from the producing wells. This is accomplished by timing the pulses from each of the wells so that the waves constructively meet. The pulses are calculated, controlled and adjusted so that the waves constructively meet (See, e.g., FIGS. 15, 21*a*-21*c*, 22*a*-22*c* and 23).
7. Specific placement of production, injection, and thermal input wells (heat delivery wells) creating the optimum configuration (oil/heat delivery matrix) for maximizing the oil and gas extraction rate and total amount of oil and gas that is extractable. The design is determined by the modeling based on the reservoirs 3-D seismic surveys or other pertinent data available. A control system adjusts the pressure gradients and the pulsing dynamics of both the injection wells and the producer wells to maximize the flows for the low viscosity paths. The heat delivered by the heat delivery wells into the reservoir creates the low viscosity paths for the treated portion of a reservoir.
8. As the system matures and the reservoir dynamics change, the control system adjusting the pressure gradients, the frequency and timing of the pulses, the heat and the pumping rates in order to continue to maximize the oil extraction rates. The particular features of the invention will be discussed in further detail below.

Green Boiler System (FIGS. 4-9)

In petroleum geology, a reservoir is a porous and permeable lithological unit or set of units in a formation that hold hydrocarbon reserves such as crude oil and natural gas. The flow rate (Q) of the hydrocarbon reserves through such a formation may be determined according to Darcy's Law:

$$Q = \frac{\kappa A}{\mu} \cdot \frac{\partial p}{\partial x}$$

where Q is the flowrate (in units of volume per unit time), κ is the relative permeability of the formation (typically in millidarcies), A is the cross-sectional area of the formation, μ is the viscosity of the fluid (typically in units of centipoise), and ∂p/∂x represents the pressure change per unit length of the formation that the fluid will flow through.

Figure 3A:
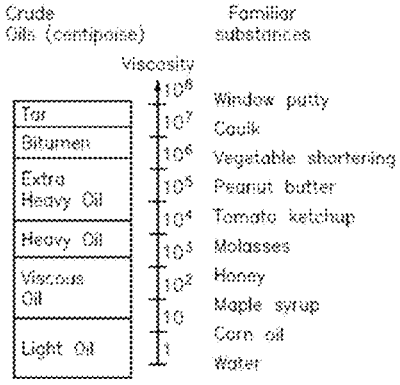
PRIOR ART FIG. 3a
FIG. 3*a* shows viscosities of various types of crude oil as compared to familiar substances.

Crude oil viscosity (κ) is its resistance to flow. It may be viewed as a measure of its internal friction such that a force is needed to cause one layer to slide past another. Newton's law of viscosity states that the shear stress between adjacent fluid layers is proportional to the negative value of the velocity gradient between the two layers. Alternatively, the law may be interpreted as stating that the rate of momentum transfer per unit area, between two adjacent layers of fluid, is proportional to the negative value of the velocity gradient between them. The unit of viscosity in cgs units is dyne·sec/$cm^2$ (1 dyne-sec/$cm^2$ is called a poise (P)). From the units, it will be evident that viscosity has dimensions of momentum per unit area. One Poise (P) in mks units is 0.1 $kg \cdot m^{-1} \cdot s^{-1}$. The SI unit for viscosity is the pascal·second (Pa·s) which equals 10P. A centipoise is one-hundredth of a poise and one millipascal·second (mPa·s). FIG. 3*a* shows (on the left hand side) various types of crude oil with viscosities indicated on a vertical logarithmic scale in centipoise as compared to familiar substances on the right hand side aligned along the same scale.

Figure 3B:
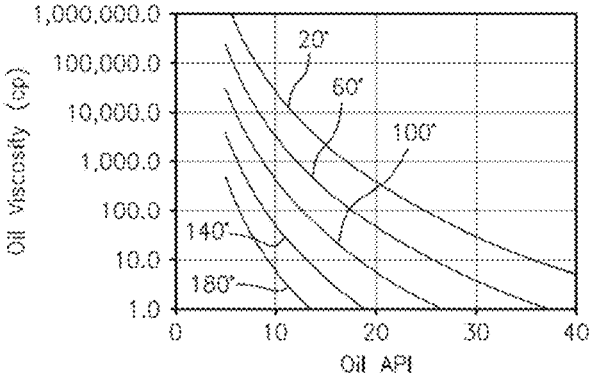
FIG. 3*b* shows crude oil viscosity vs. API (American Petroleum Institute) gravity curves for five temperatures.

API (American Petroleum Institute) gravity is an inverse measure of the relative density, as compared to water, of crude oil. It is measured in units called API degrees (API). The lower the number of API degrees, the higher the specific gravity of the oil. If greater than 10, the oil floats. If less than 10, it sinks. FIG. 3*b* shows a rough correlation between crude oil viscosity (cp) versus API gravity for five different temperatures (five curves, from left to right, at 180 C, 140 C, 100 C, 60 C, and 20 C). For a given temperature curve, e.g., the top curve at 20 C, it is clear that a light crude with API>30 will have a viscosity much lower than a heavy crude with API<22. The ratio of fluid viscosity to density is called kinematic viscosity and is indicative of the ability of the fluid to transport momentum. It has dimensions of $L^2t^{-1}$. It is also referred to as the momentum diffusivity of the fluid.

The permeability to flow through a rock for the case where a single fluid is present is different when other fluids are present in the reservoir. Saturation, the proportion of oil, gas, water and other fluids in a rock is a crucial factor in a pre-development evaluation of the reservoir. The relative saturations of the fluids as well as the nature of the reservoir affect the permeability. Crude oil mobility ($\lambda_0$) is the ratio of the effective permeability ($\kappa_0$) to the oil flow to its viscosity ($\mu_0$):

$$\lambda_2 = \kappa_0/\mu_0$$

The effective permeability characterizes the ability of the crude oil to flow through the rock material of the reservoir. As will be evident from the above-mentioned Darcy's Law, permeability should be affected by pressure in the rock material. The millidarcy unit mentioned above in connection with the typical unit used for permeability (K) is related to the basic unit of permeability measure, $m^2$ in the mks system. The darcy is referenced to a mixture of unit systems. A medium with a permeability of 1 darcy permits a flow of 1 $cm^3$/s of a fluid with viscosity 1 cP (1 mPa·s) under a pressure gradient of 1 atm/cm acting across an area of 1 $cm^2$. A millidarcy (md) is equal to 0.001 darcy. Rock permeability is usually expressed in millidarcys (md) because rocks hosting hydrocarbon or water accumulations typically exhibit permeability ranging from 5 to 2000 md.

Thus, the principle used herein is that heat applied to a reservoir increases its permeability and reduces the viscosity of the crude oil to increase the oil mobility. In other words, lowering oil viscosity with heat increases the flow rate of the oil. Conventional heating methods include cyclic steam injection, steam flooding and fire flooding. For cyclic steam injection, steam may first be injected into a well for a few days or weeks. Then the heat is allowed to dissipate into the reservoir for a few days to reduce oil viscosity. Finally, the production begins with improved flow rate. The three step process is then repeated e.g. after the flow rate diminishes. In steam flooding some wells are used for injecting steam and others for oil production. The steam flood acts to both heat the reservoir and push the oil by displacement toward the production wells. In many cases gravity is also used to move the oil toward the production well. Fire flooding is where combustion generates heat within the reservoir itself.

TABLE 1

| Composition by Weight | | | |
|---|---|---|---|
| Hydrocarbon | Average | Range | Melting or Liquification Point |
| Paraffins | 30% | 15 to 60% | 115° F. to 155° F. (46° C. to 68° C.) |
| Naphthenes | 49% | 30 to 60% | |
| Aromatics | 15% | 3 to 30% | |
| Asphaltenes | 6% | Remainder | 180° F. (82° C.) |
| Karogen | | | 842° F. to 932° F. (450° C. to 500° C.) |

It should be realized that the viscosity is affected by temperature, pressure, and by composition. Among others, the following conditions impact oil flow rate:

1) Crude oils contain substantial proportions of saturated and aromatic hydrocarbons with relatively small percentages of resins and asphaltenes and other substances as listed in Table 1. More degraded crude oils contain substantially larger proportions of resins and asphaltenes. Heavy crude oil (API<22) occurs when the oil contains paraffin and/or asphaltenes and the temperature of the oil reservoir is too low. See Table 1 above for melting or liquification points and see also FIG. 3*b*. As oil is heated the viscosity lowers and the efficiencies of flow increase.

2) Crude oil (including light crude oil API>30) viscosity increases as it cools due to one or more of the following conditions:

a) the oil reservoir is shallow and the temperature of the reservoir is low;
b) it is heavy crude oil (API<22);
c) the oil reservoir is deep and the oil cools as it is pumped out of the well;
d) the ambient temperature is extremely cold and the oil cools quickly as it is exposed to the cold near or at the surface; and
e) any set of conditions where the oil cools and the viscosity increases and this adversely effects the efficiency of the oil flow in a production well.

As will be appreciated from the foregoing, heating the reservoir to remove barriers to the flow of fluids into a well will tend to lower the viscosity of the fluids so that the existing permeability will allow the oil to flow with an increased rate and hence increased volume to the production wells. An important teaching hereof is to burn crude oil or natural gas extracted from an underground reservoir (or burn both crude oil and natural gas extracted from the underground reservoir), in order to provide thermal energy. In other words, the teaching is to supply the necessary power and materials from the reservoir itself to mobilize the oil and move it to the production wells. A heat source fed by fuel produced from the reservoir accomplishes the production of heat. It does so in such a way, as shown below, as to allow enhanced oil recovery that is environmentally benign.

Thus a method is disclosed herein, in that a portion of the crude oil or natural gas extracted from an underground reservoir is burned for providing thermal energy. Or, both crude oil and natural gas extracted from an underground reservoir is burned, for providing thermal energy. The thermal energy is transferred to brine separated from the extracted oil, gas, or both, for providing heated brine. Or, the thermal energy is converted to mechanical work. Or, the thermal energy is both transferred to the separated brine and converted to mechanical work. The underground reservoir is heated with the heated brine by injection into the underground reservoir. Or the underground reservoir is heated with a resistive cable energized by electricity generated by converting the mechanical work to electric energy. Or, the underground reservoir is heated with both heated brine and heat from an energized resistive cable.

For instance, a "Green Boiler" may be provided to burn natural gas, crude oil, or both, produced from a reservoir. The boiler may be used to heat a flow of water that circulates in a closed loop out of a heat exchanger in a cooled condition and return a flow of heated water into the heat exchanger in order to transfer heat from the heated water to the brine pumped from a production well and injected back into the reservoir after gaining heat and flowing out of the heat exchanger. As such, the "Green Boiler" is a closed loop system that uses the resources of an oil and gas reservoir to enhance the extraction of oil and gas. The system eliminates any flaring gas and eliminates any negative emissions of any pollutants into the atmosphere. The byproducts may thus be used in the enhancement process. The heat exchanger may be any type that will transfer heat efficiently from the heated water to the brine such as a counter-flow heat exchanger where the fluids enter the exchanger from opposite ends.

Figure 4:
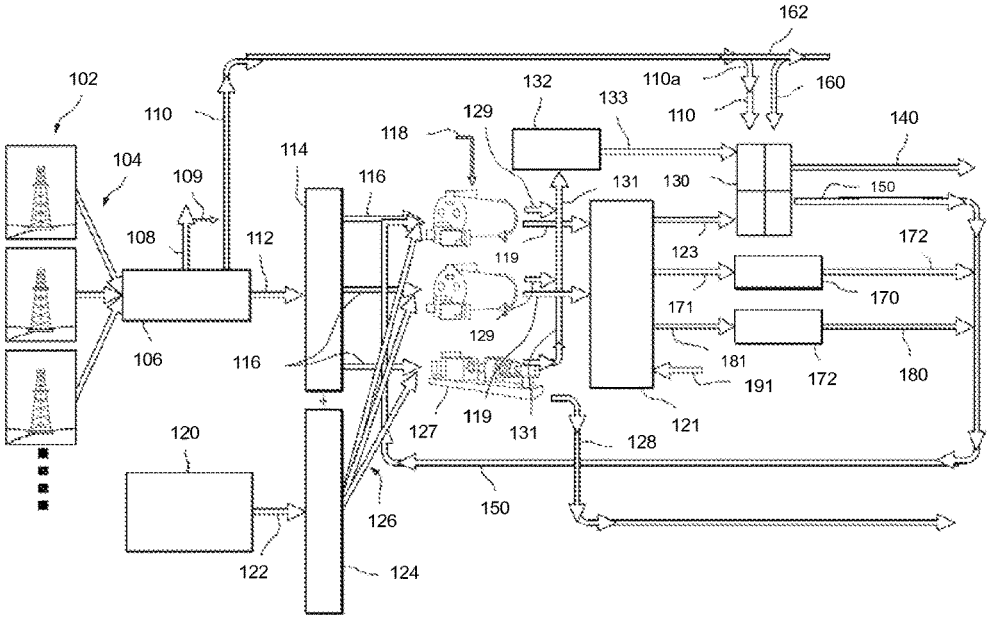
FIG. 4 shows an embodiment of a "Green Boiler" system according to the invention.

FIG. 4 shows a system and method according to the teachings hereof. One or more oil wells 102 are pumped to produce a fluid mixture 104 that may include crude oil, natural gas, and brine. The pumped fluid is provided to a separator 106 that represents a pressure vessel that separates the different well fluids into their constituent components of oil, gas and water/brine and that provides separate flows of crude oil 108, brine 110, and natural gas 112. Separators work on the principle that the three components have different densities, which allows them to stratify when moving slowly with gas on top, water on the bottom and oil in the middle. Solids settle in the bottom of the separator. If there are more than one well used and the volume of recovered hydrocarbons is large, a plurality of heat sources may be employed in the system, as in FIG. 4. In such a case, the natural gas may be provided from an outlet of the separator to an inlet of a manifold 114 and split by the manifold into a plurality of natural gas stream outlets provided in piping connected to the plurality of heat sources, in this case, one or more "green boilers" 118. Other types of heat sources such as furnaces may be used as well. It should be realized that some 109 of the crude oil 108 separated by the separator 106 may be used to fuel the heat source either alone or in combination with natural gas. There are boilers that can burn both types of fuel. If in some cases the hydrocarbon recovery volume is low and additional fuel is needed, e.g., crude oil and/or diesel 120, it may be supplied 122 via another manifold 124 to the plurality of heat sources via separate fuel feed pipe lines 126. In any event, according to the teachings hereof, the system of FIG. 4 is able to carry out a method of burning crude oil or natural gas extracted from an underground reservoir, or burning both crude oil and natural gas extracted from an underground reservoir, for providing thermal energy.

The natural gas 116 supplied by the manifold 114 may also be supplied to one or more gas, crude oil, or diesel fueled heat engines such as a gas turbine generator 127 that provides electricity 128. The electricity output from the generator may be connected to an electric resistant cable that is used to produce heat for heating a thermally assisted oil well. The electricity may be used for other purposes as well.

The separated brine 110 from the separator 106 may be provided to a heat exchanger/mixer 130 to be heated. Although shown as a combined heat exchanger/mixer 130, it should be realized the heat exchanger and mixer could be separate. The thermal energy provided by the boilers 118 may be transferred to a fluid such as water circulating in a closed loop through the boilers and the heat exchanger. Heated water is shown being provided on one or more pipe lines 119 from outlets of the boilers 118 to at least one inlet of a hot water manifold 121. An outlet of the hot water manifold provides hot water on a line 123 to an inlet of a heat exchanger part of the heat exchanger/mixer 130 or to a separate heat exchanger.

Hot exhaust gases from the one or more heat engines such as exhaust 129 from the plurality of gas boilers 118 and/or exhaust gases 131 from a gas turbine of the turbine generator 127 are provided to an exhaust scrubber 132. Scrubbed exhaust gases, containing $CO_2$ and $N_2$ for example, are then provided on a line 133 to the mixer part of the heat exchanger/mixer 130 or to a separate mixer. The mixer performs a mixing of the scrubber exhaust gas 133 from the scrubber 132 (fed by at least one of a heating vessel, e.g., boiler(s) 118 and a heat engine e.g. a turbine of turbine generator 127) with the separated brine at least before, during, or after the transfer of thermal energy to the separated brine, wherein hot brine on the line 140 mixed with the exhaust gas 133 is injected into the underground reservoir via one or more injection wells. A mixer may have a series of fixed, geometric elements enclosed within a housing. The fluids to be mixed are fed at one end and the internal elements impart flow division to promote radial mixing while flowing toward the other end. Simultaneous heating can be done if the mixer is inside the heat exchanger.

The heat exchanger is thus for transferring the thermal energy produced in the boilers 118 to the separated brine 110, for providing heated brine on the line 140, or for converting the thermal energy to mechanical work for instance by a turbine part of the turbine generator 127, or (as in FIG. 4) for both transferring the thermal energy to the separated brine as shown in the heat exchanger 130 and converting the thermal energy to mechanical work as shown in the turbine part of the turbine generator 127.

The system of FIG. 4 then continues the process by heating the underground reservoir with the heated brine on the line 140 by injecting it into the underground reservoir. Or the system continues the process by heating the underground reservoir with a resistive cable energized by electricity 128 generated by converting mechanical work to electric energy. Or the system continues the process by heating the underground reservoir with both the heated brine and the energized resistive cable.

Cooled circulating water on a line 150 that is shown circulating out of an outlet of the heat exchanger/mixer 130 is returned to the boilers 118 for re-heating and for again being fed into the hot water manifold 121 on lines 119 for heating more brine produced on an on-going basis by the wells 102. Geothermal heat 191 may be supplied to the hot water manifold 121. It is noted that hot water from the hot water manifold 121 may be further provided on a line 171 to provide heat for a thermally assisted oil well 170, or on a line 181 to other applications 180 requiring heat. The cooled water from these applications can be fed into the cooled circulating water on a line 150 by way of separate lines 172 or 182. It should be mentioned that if viscosity reducing additives are used for instance as shown on a line 160 for mixture in a mixer (not shown) with the extracted brine 110, there will need to be an additive separator (also not shown) as signified by the brine being sent on a line 162 to such an additive separator before it is returned on a line 110*a* to the heat exchanger/mixer 130.

Figure 5:
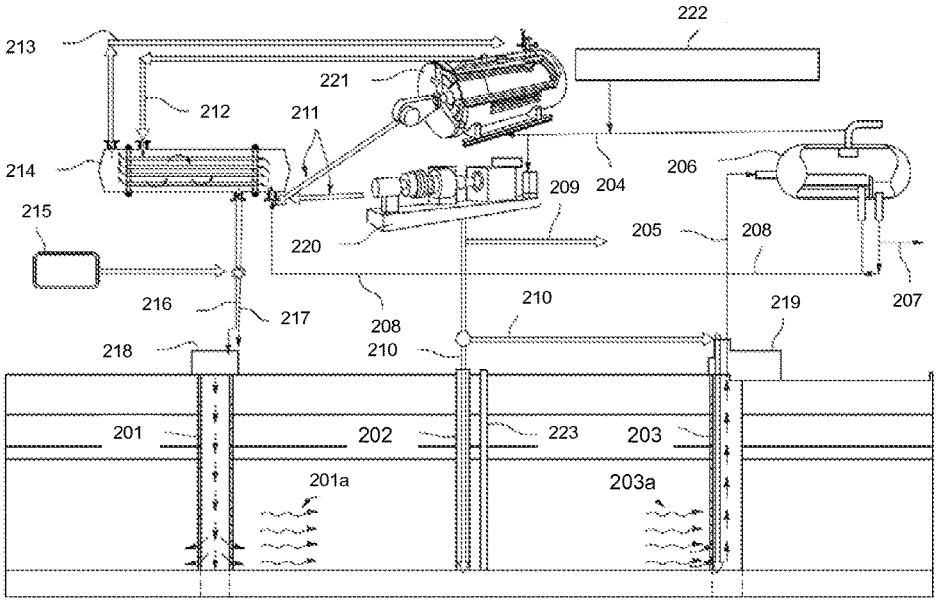
FIG. 5 shows another embodiment of "Green Boiler" system and how it interfaces and supports a comprehensive enhanced oil recovery system according to the invention.

Another exemplary "Green Boiler" System is shown in detail in FIG. 5. Though shown vertically, all wells depicted are horizontal. It should be realized that the wells do not need to be horizontal. For the case where horizontal wells are used, the heat delivery wells may be at right angles relative to the injector and the producer wells or may be implemented in a parallel or angular formation. The system works as follows:

One or more producer wells 203 deliver oil, gases and brine (water) on a line 205 (which may contain other elements) to at least one separator 206. The at least one separator 206 separates the oil and provides separated oil on a line 207, provides separated gas on a gas line 204, and provides separated brine on a brine line 208. The separated brine may include optional additives and/or optional oil. The separated brine with or without the optional additives and/or crude oil is sent on the line 208 to an inlet of at least one heat exchanger/mixer 214. If additives have been used, they are separated from the brine. The oil 207 (less any oil used for fluid injection 208 and any oil that may be used for thermal generation 204) is sent on the line 207 to a pipeline or a storage tank as recovered crude oil. The gas 204 and/or any oil used for thermal generation is sent on the line 204 to one or more boilers 221 for generation of thermal energy and may also be sent on the line 204 to one or more heat engines connected to an electric generator, such as one or more turbine generators 220 for generation of electricity on a line 209. A further gas or crude oil source 222 may provide gas and/or crude oil into the line 204. The turbines of the one or more turbine generators 220 may be gas turbines. A gas turbine derives its power from burning fuel such as the gas or crude oil on the line 204 in a combustion chamber and using the fast flowing combustion gases to drive a turbine in a manner similar to the way high pressure steam drives a steam turbine. The difference is that the gas turbine has a second turbine acting as an air compressor mounted on the same shaft. The air turbine (compressor) draws in air, compresses it and feeds it at high pressure into the combustion chamber to increase the intensity of the burning flame. The pressure ratio between the air inlet and the exhaust outlet is maximized to maximize air flow through the turbine. High pressure hot gases are sent into the gas turbine to spin the turbine shaft at a high speed connected via a reduction gear to the generator shaft. In the alternative, the one or more turbine generators 220 may include one or more steam turbines. In that case, the one or more boilers 221 may include one or more steam boilers. Or, exhaust gases from a gas turbine may be supplied to a heat exchanger that produces steam fed to a steam turbine connected to another electric generator (electricity co-generation).

Exhaust 211 from the boiler(s) 221 and turbine(s) of the turbine generator 220 (or other heat engine) is also sent on a line 211 e.g., to an inlet of the heat exchanger/mixer 214, which may be the same inlet as used by the separated brine on the line 208.

The hot water on the line 212 from the closed loop boiler 221 and the cooled water on the line 213 from the heat exchanger/mixer 214 are cycled. The hot water on the line 212 from the boiler 221 is provided to another inlet of the heat exchanger/mixer 214. The heat exchanger/mixer 214 uses the heat from the hot water 212 to heat the brine or brine/oil mixture on the line 208 before, during, or after mixing the brine or brine-oil mixture with the exhaust 211. Thus, the mixer 214 may mix the exhaust into the brine or brine-oil mixture before, during, or after the heat transfer. Once the heat exchange has occurred the cooled water on the line 213 is sent back from the heat exchanger 214 to the boiler 221 for re-heating.

The heated brine/oil mixture 217 may be mixed with the heated exhaust 216 and then optionally mixed with additional additives 215 and sent to one or more injection pumps 218.

The injection pumps 218 inject the combined mixture into one or more injection wells 201, and may include one or more oscillating devices that create pressure waves for the enhanced oil extraction system. In other words, any of the methods shown herein may include stimulating the underground reservoir with pressure waves propagated into the underground reservoir by stimulating the heated brine during injection in an injection well 201.

The one or more injection wells 201 inject heated brine and/or oil, hot exhaust gases such as $CO_2$, $N_2$ and other gases, and optionally additives into the oil and gas reservoir. Electricity 209 for the injection pump or pumps may be provided by the electric generator of the turbine generator 220.

Figure 6:
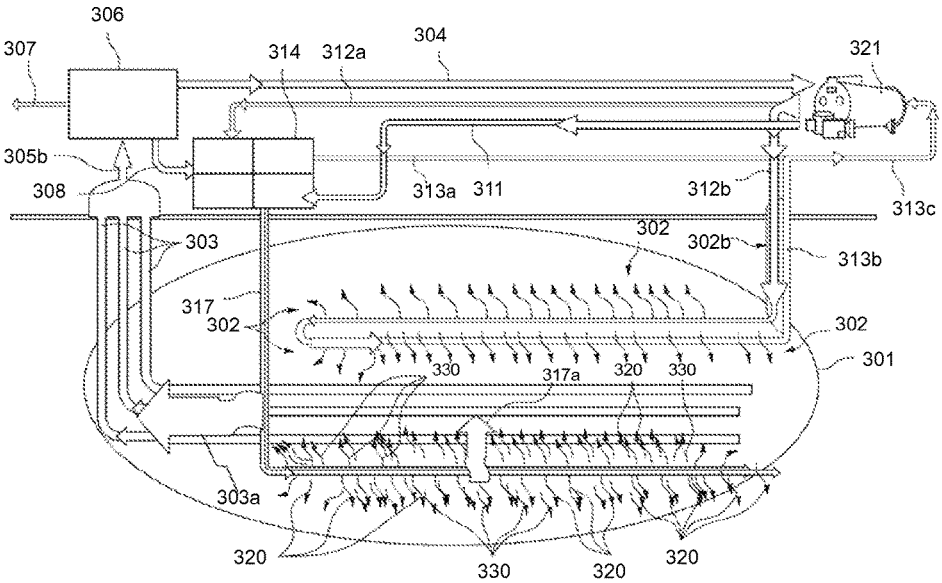
FIG. 6 shows yet another embodiment of a "Green Boiler" system using liquid to heat the heat delivery wells instead of using an electrical resistant heater.

The heat delivery well 202 radiates heat into the reservoir using either electricity generated from the generator of the turbine generator 220 (as shown) and/or water heated by the boiler 221 and circulated in a closed loop (see, e.g., FIG. 6 into and out of a heat delivery well 302*b*).

One or more producer well pumps pulsing oscillators 219, and electric heating cables 210 may be powered by the generator of the turbine generator 220. The one or more pulsing oscillators 219 are used to stimulate the underground reservoir with additional pressure waves 203*a* that are propagated into the underground reservoir. The oil, gas, and brine mixture in a given production well 203 is stimulated during extraction from underground. The additional pressure waves 203*a* are controlled such that the additional pressure waves 203*a* are at the same frequency and are synchronized to propagate "in phase" with the pressure waves 201*a* that are separately propagated into the underground reservoir by stimulation of the heated brine during injection into the well 201. When the "in phase" pressure waves 203*a* meet the pressure waves 201*a* in the reservoir between the two wells, they interfere constructively as shown in FIG. 10*d*. The amplitude of vibratory stimulation of the reservoir by pressure waves is thus increased in order to increase vibration in the pores of the reservoir, increase mobility of the crude oil, and enhance flow rate.

One or more monitor wells 223 may be employed to provide control information to a control system that controls the operations of the system.

FIG. 6 shows another embodiment where the fluid heated in a boiler 321 is circulated in a closed loop above ground to and from a heat exchanger/mixer 314, and also below ground in a heat delivery well 302*b* in an underground oil/gas/brine reservoir 301. It should be realized that the heat delivery well 302*b* may be fed circulating hot fluid 312*b* by the boiler 321, by a separate boiler, or by another type of heat source. Wavy arrows 302 are shown emanating from the heat delivery well 302*b* in the reservoir 301 to signify the transfer of heat to the oil/gas/brine reservoir 301. Oil, gas, and brine produced from one or more production wells 303 is provided on a line 305*b* to at least 306 that provides separated gas on a line 304 to the boiler 321, separated oil on a line 307 for storage, and separated brine on a line 308 to the heat exchanger/mixer 314. As in the case for FIGS. 4-5 as well, the separated gas is not flared, but rather, is put to good use to increase hydrocarbon recovery flow rate. Hot exhaust 311 from the boiler 321 is provided to a mixer part of the heat exchanger/mixer 314 for mixing with the separated brine 308. The hot brine/exhaust mixture is injected into an injection well 317, where hot brine flooding takes place to heat the reservoir, displace the trapped hydrocarbons, and push or move the hydrocarbons toward the one or more production wells 303. Wavy arrows 320, 330 are shown emanating from the hot brine flooding well 317 into the reservoir 301 to signify the delivery of hot brine/$CO_2$ to heat the oil/gas/brine reservoir 301 and to push and displace gas and oil toward the one or more production wells 303. Hot water from the boiler 321 is provided on a line 312*a* to the heat exchanger 314 where it transfers heat to the separated brine 308. The cooled fluid emerging from the heat exchanger on a line 313*a* may be joined with cooled fluid 313*b* emerging from the heat delivery well 302*b* before the joined fluids 313*c* are together returned to the boiler 321 for re-heating. The re-heated fluid emerges from the boiler 321 on line 312*a* for connection to the heat exchanger 314 and on line 312*b* for connection to the heat delivery well 302*b* in a repeating cycle of heating, cooling, and re-heating.

Also shown in FIG. 6, pressure waves 303*a* may be generated in both the one or more production wells 303 and additional pressure waves 317*a* in the at least one injection well 317. The underground placement of the production and injection wells with respect to each other may be advantageously set up such that constructive interference is facilitated and controlled with the production and injection waves controlled so as to be stimulating the reservoir simultaneously, continuously and synchronized in phase so as to meet in the reservoir and add constructively, thereby increasing the amplitude of the stimulating force imparted to the reservoir. The spatial relationship should be such that at least part of the production wave 303*a* is propagated in a direction toward the injection well 317 and the injection wave 317*a* is propagated in the opposite direction toward the production well 303 so that the waves meet in a space in between the wells and interfere constructively as shown in FIG. 10*d*.

Figure 7:
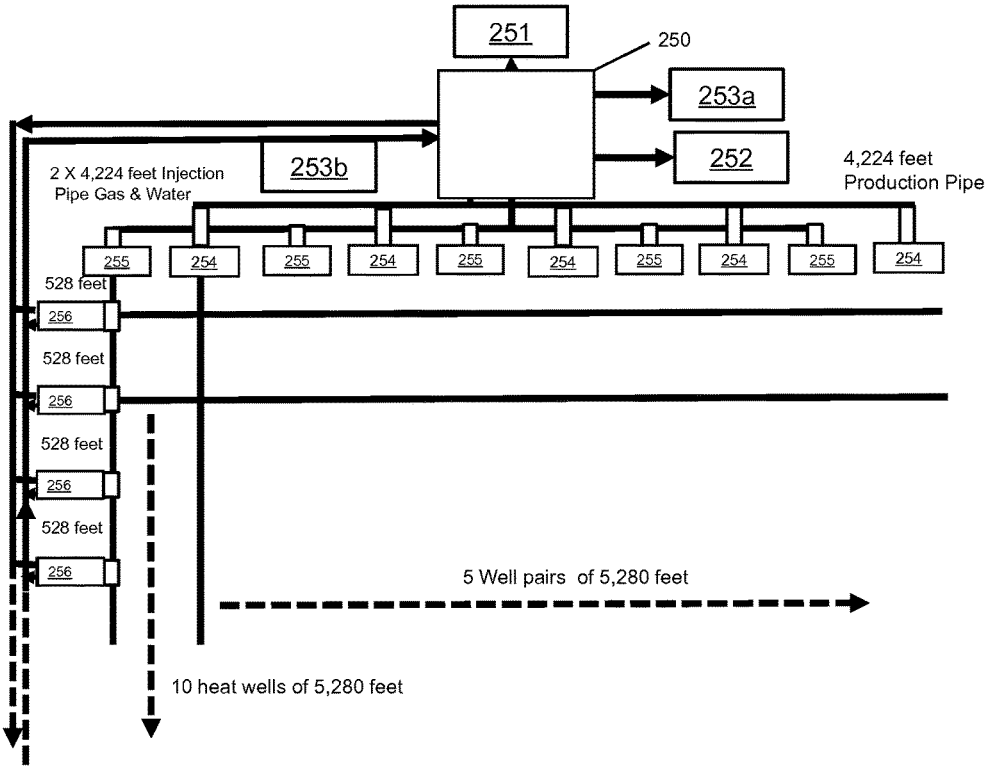
FIG. 7 shows a further embodiment of a "Green Boiler" system according to the invention.

A further embodiment for circulating fluid in a reservoir is shown in FIG. 7. In the embodiment shown in FIG. 7, five pairs of injection wells 254 and production wells 255 are provided, and ten heating wells 256 are provided. Each of the production wells 255 and heating wells 256 can be supplied with a pump, and each of the injection wells 254 can be supplied with a pump and an oscillator. The injection wells 254 and production wells 255 are arranged as vertical wells in the embodiment shown in FIG. 7, and the heating wells are 256 are shown as horizontal wells. The array of heating wells 256 spans a distance of 5,280 feet, with 528 feet in between each well 256 (and 264 feet on each end). The array of injection wells 254 and production wells 255 also spans a distance of 5,280 feet, with 528 feet in between each well 254, 255 (and 264 feet on each end). The production wells 255 can have a length of 4,224 feet. The injection wells 254 may comprise two separate pipes, one for gas and one for water, each having a length of 4,224 feet.

The system shown in FIG. 7 further includes a "Green Boiler" system 250, similar to those described previously, which is connected to the injection wells 254, production wells 255 and heating wells 256. The boiler system 250 can supply heated water and gas to the injection wells 254 and heating wells 256. The boiler system 250 can also supply pumped and separated oil, gas and water to an oil tank 251, a gas tank 252 and a water tank 253*a*. A second water tank 253*b* can also be provided to store cooled water pumped out of the heating wells 256 and to supply water for heating by the boiler system 250.

Figure 8:
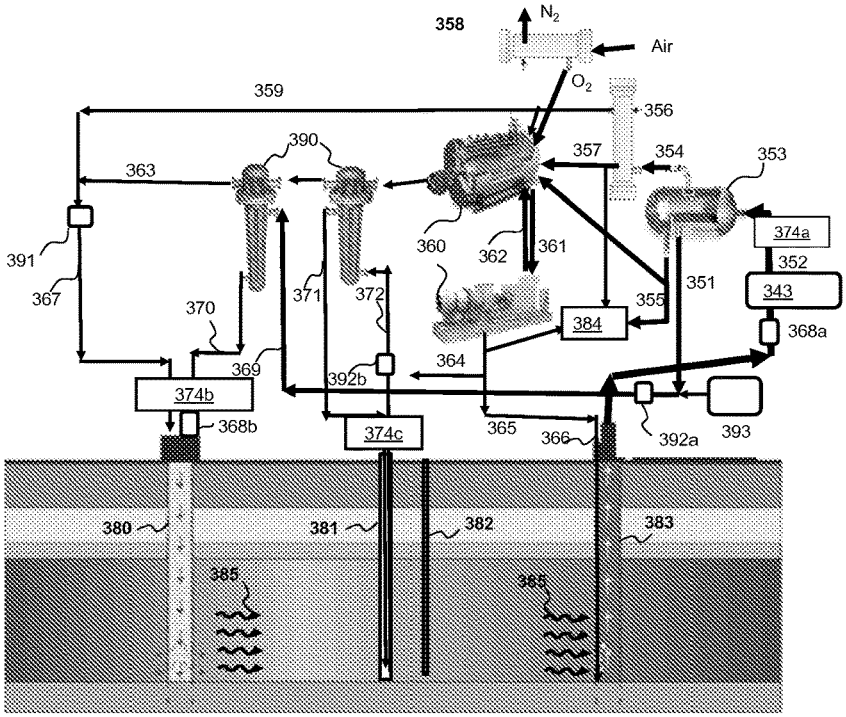
FIG. 8 shows a further embodiment of a "Green Boiler" system according to the invention.

FIG. 8 shows a further embodiment of a "Green Boiler" system according to the invention. The system comprises injection wells 380, heat delivery wells 381, monitor wells 382 and producer wells 383. Although only one of each well is shown in FIG. 8, in a preferred embodiment, five injection wells 380, ten heat delivery wells 381 and five production wells 383 are provided, the same number as in the embodiment of FIG. 7.

The production well 383 pumps oil, gas, brine and/or water 352. The production well 383 is equipped with an oscillator 368*a* and a jet pump 373, which aid in generating the pressure waves 385 that are used to increase oil recovery in the reservoir. A manifold 374*a* is also provided between the production well and a separator 353. The separator 353 separates the brine 351, gas 354 and the oil 355.

A boiler and steam turbine or generator 360 is provided with oxygen from an oxygen/nitrogen separator 358, and is provided with the separated oil 354 and with methane/Carbon Dioxide ($CH_4$/$CO_2$) 357 from a carbon dioxide/methane separator 356, receiving the separated gas 354. Using these components, the boiler 360 convert water from the steam turbine 362 into steam 361 and generates electricity for operations 364, electricity for sale on the energy market 384, and supplies electricity 365 to an electric heating cable 366 in the production well 383. $CO_2$ 359 from the oxygen/nitrogen separator 358 can also be added to the inlet flow to the boiler 360 as needed to control flame temperature without adding unwanted $N_2$ to the exhaust stream.

The exhaust of the boiler and steam turbine or generator 360 is provided to one or more heat exchangers 390 configured to heat water and/or brine. Separated brine 351 is mixed with water and additives 393 and pumped by a pump 392*a* to a heat exchanger 390, which heats the brine and outputs heated brine 370 to the injection well 380. Carbon dioxide 359, separated by the separator 356, is mixed with hot exhaust 363 from the heat exchanger 390, and compressed by a compressor 391. The compressed and heated $CO_2$ and exhaust gases 367 are supplied to a manifold 374*b*, and pumped into the injection well 380, which also incorporates an oscillator 368*b* to aid in creating pulsing pressure waves 385.

The heat delivery well 381 is provided with a manifold 374*c*. The heat delivery well 381 pumps via a pump 392*b* cooled water 372 to a heat exchanger 390, which outputs heated water 371. The heated water 371 is provided to the heat delivery well 381 to transfer heat into the well. As the heated water 371 transfers heat to the well, the water cools and the cooled water 372 is provided back to the heat exchanger 390 in a cyclical manner.

Figure 9A:
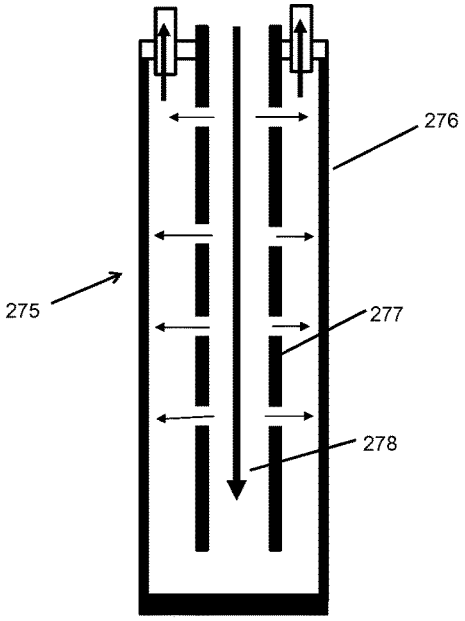
FIG. 9*a* shows a heat well according to an embodiment of the invention.

An example of a heat delivery well 275, as discussed above in reference to earlier Figures, is shown in FIG. 9*a*. The heat delivery well 275 shown in FIG. 9*a* can be used as the heat delivery well 381 of FIG. 8, for example. The heat delivery well 275 includes a highly heat conductive casing 276. Hot water 278 is pumped through a highly non-heat conductive ported pipe 277. As the hot water 278 transfers heat to the reservoir, the water cools and is pumped back up to the surface, where it can be reheated and resupplied to the heat delivery well 275.

Figure 9B:
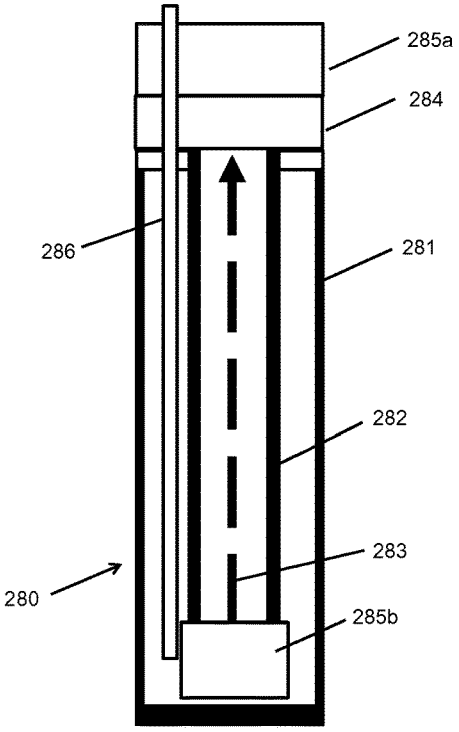
FIG. 9*b* shows a production well according to an embodiment of the invention.

An example of a production well 280, as discussed above in reference to earlier Figures, is shown in FIG. 9*b*. The production well 280 shown in FIG. 9*b* can be used as the heat delivery well 383 of FIG. 8, for example. The production well 280 comprises a porous pipe 281 surrounding an oil pipe 282. Oil, gas and water 283 are pumped to the surface by one or more jet pumps 285*a*, 285*b*. An oscillator 284 is also provided, which pulses the pumping up of the oil, gas and water to create pressure waves. An electrical cable 286 can also be provided, which supplies heat to the production well and decreases the viscosity of the pumped substances 283.

It should be realized that systems such as shown in FIGS. 4-9*b* are merely examples of systems assembled according to the teachings hereof. Various elements may be added to or subtracted from the illustrated systems. Likewise, various elements may be modified.

Enhanced Oil Recovery Pulsing (FIGS. 10*a*-10*d* and 12-13)

Figure 10A:
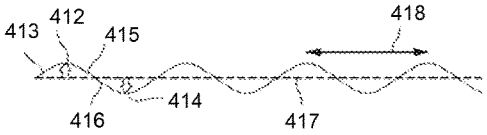
FIG. 10*a* shows a longitudinal sound wave propagating in air and having a sinusoidal form with pressure peaks and troughs shown in relation to atmospheric pressure.
Figure 10C:
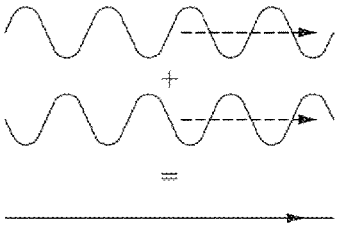
FIG. 10*c* shows destructive interference caused when waves meet out-of-phase.
Figure 10B:
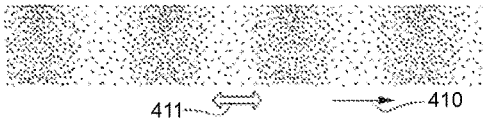
FIG. 10*b* is in alignment with FIG. 10*a* to show the wave of FIG. 10*a* causing air particle displacement parallel to the direction of propagation, left to right in the Figure, with rarefactions and compressions of air molecules corresponding to the decreased pressure and increased pressure, respectively, as compared to atmospheric pressure in FIG. 10*a*.
Figure 10D:
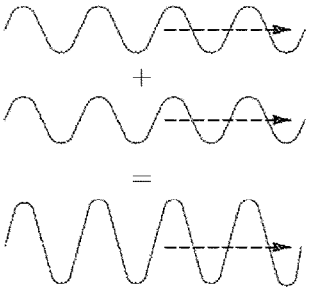
FIG. 10*d* shows constructive interference caused when waves meet in-phase.

FIGS. 10*a* and 10*b* show an example of a longitudinal sound wave produced in air, for example, by a vibrating tuning fork. A wave is a disturbance or variation that travels through a medium. The medium in the example of FIGS. 10*a* and 10*b* is air through which the disturbance or sound or pressure wave travels. The pressure of a sinusoidal pressure wave is shown plotted versus time in FIG. 10*a* propagating 410 from left to right. If FIGS. 10*a* and 10*b* were animated, the impression would be that the regions of compression travel from left to right. In reality, although the air molecules experience some local oscillations as the pressure wave passes, the molecules do not travel with the wave. As the tines of the fork vibrate back and forth, they push on neighboring air molecules. The forward motion of a tine pushes air molecules horizontally to the right to create a high-pressure area and the backward retraction of the tine to the left creates a low-pressure area allowing the air molecules to move back to the left. As shown in the plot of displacement in the bottom half in FIG. 10*b*, because of the longitudinal motion 411 of the air molecules, there are regions where the air molecules are compressed together and other regions where the air molecules are spread apart. These regions are known as compressions and rarefactions, respectively. The compressions are regions of high air pressure and the rarefactions are regions of low air pressure. At the far left of FIG. 10*b*, an increased pressure compression is depicted corresponding to a peak 412 in FIG. 10*a*, following an up amplitude 413. A decreased pressure rarefaction corresponding to a trough 414 then follows down amplitudes 415 and 416. The maximum distance (the crest or trough) that a molecule of the air moves away from its rest position, indicated by horizontal line 417 in FIG. 10*a*, is the amplitude. As such, this may be understood as the amplitude of the movement of an air molecule caused by the pressure wave as it propagates through the air. The sinusoid in FIG. 10*a* represents the extremes of the horizontal molecule displacement amplitude of the air molecules as the pressure wave moves. It may also be seen as representative of the pressure amplitude of the wave as it propagates through the air. The wavelength 418 of such a wave is the distance that the wave travels in the air in one complete wave cycle. The wavelength is commonly measured as the distance from one compression to the next adjacent compression or the distance from one rarefaction to the next adjacent rarefaction.

Figure 13A:
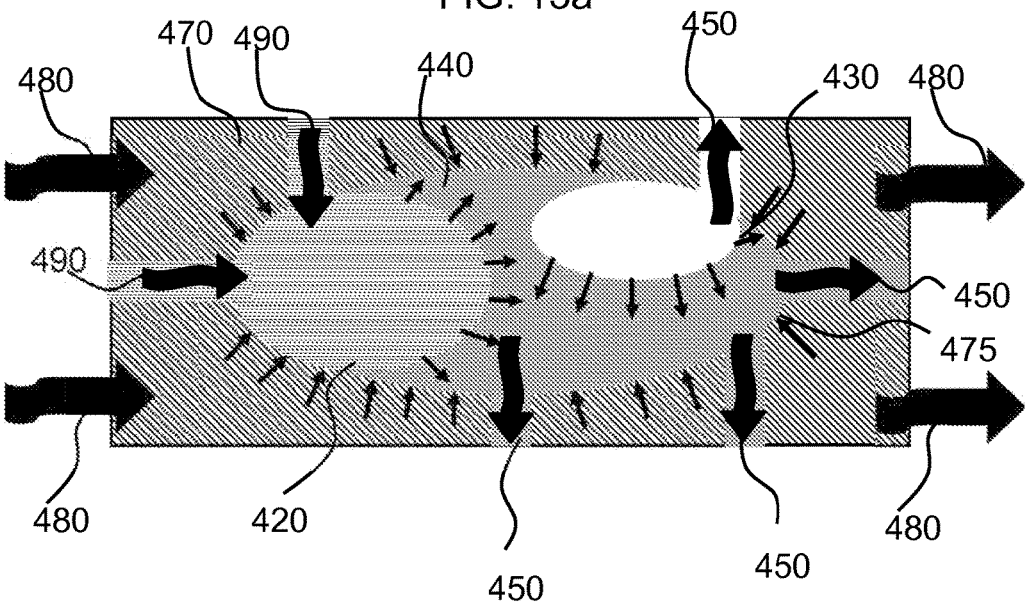
FIG. 13*a* shows the impact of pulsing from the injection wells and production wells on the oil and gas mobility according to an embodiment of the invention.
Figure 13B:
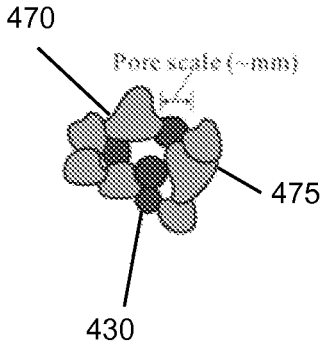
FIG. 13*b* shows oil droplets captured in a pore space before a wave based enhanced oil recovery technique is applied.
Figure 13C:
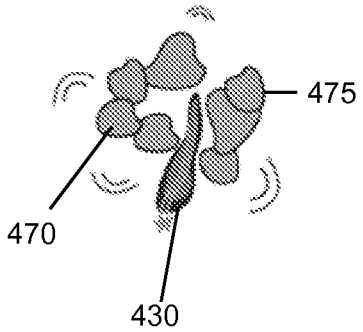
FIG. 13*c* shows reservoir shaking mobilizing an oil droplet.

In accordance with the present invention, excitation of an oil reservoir with a pressure wave results in a repeating pattern of high-pressure and low-pressure regions moving through the oil reservoir, which enhances oil recovery by causing movement in the walls of a pore 475 of a particle of rock 470, so as to induce movement and flow of capillaries 450 out of the pore 475, as shown in FIGS. 13*a*-13*c*. It also breaks the surface tension 460 of the oil 430 and water 420 in the rock pore 475. To cause pressure waves characterized by cycles of low and high pressure, pumps or other forms of transducers may be used, as will be described further herein. The length of one cycle (i.e., the wavelength) and the number of times the cycle repeats itself per unit time defines the frequency of the pressure wave. The velocity of the wave depends on the medium but is defined as the frequency times the wavelength.

Wave interference is the phenomenon that occurs when two waves meet while traveling along the same medium. The interference of waves causes the medium to take on a shape that results from the net effect of the two individual waves upon the particles of the medium. Consider two pulses of the same amplitude traveling in different directions along the same medium. Each pulse is displaced upward one unit at its crest and has the shape of a sine wave. As the sine waves move towards each other, there will eventually be a moment in time when the waves completely overlap. At that moment, the resulting shape of the medium would be an upward displaced sine pulse with amplitude of two units. This is constructive interference as shown in FIG. 10*d*. On the other hand, FIG. 10*c* depicts the results when two equal waves meet that are 180° out of phase. When the two out of phase waves meet, the compression and rarefactions overlay and the resultant wave has zero compression and rarefaction, as the waves cancel each other with destructive interference. If two waves meet in-phase, the compression is additive and the rarefaction is additive, as in FIG. 10*d*.

According to the teachings of the present invention, constructive wave interference, such as shown in FIG. 10*d*, can be used to enhance oil and gas recovery by increasing the flow of oil and gas in a reservoir. Such may be done with conditioning of the reservoir before or at the same time as the wave pulsing to further enhance oil and gas recovery, or it may be done without conditioning of the reservoir. Such techniques include for example, the thermal flooding shown in FIGS. 16 and 17. In other words, although examples described or shown below may show constructive wave interference used in conjunction with conditioning to enhance flow, it should be understood that constructive wave interference may be used as a standalone technique, by itself, for the same purpose. The constructive interference may be of modulated pressure waves that modulate at a lower frequency than an underlying pressure wave at a higher frequency.

Figure 11:
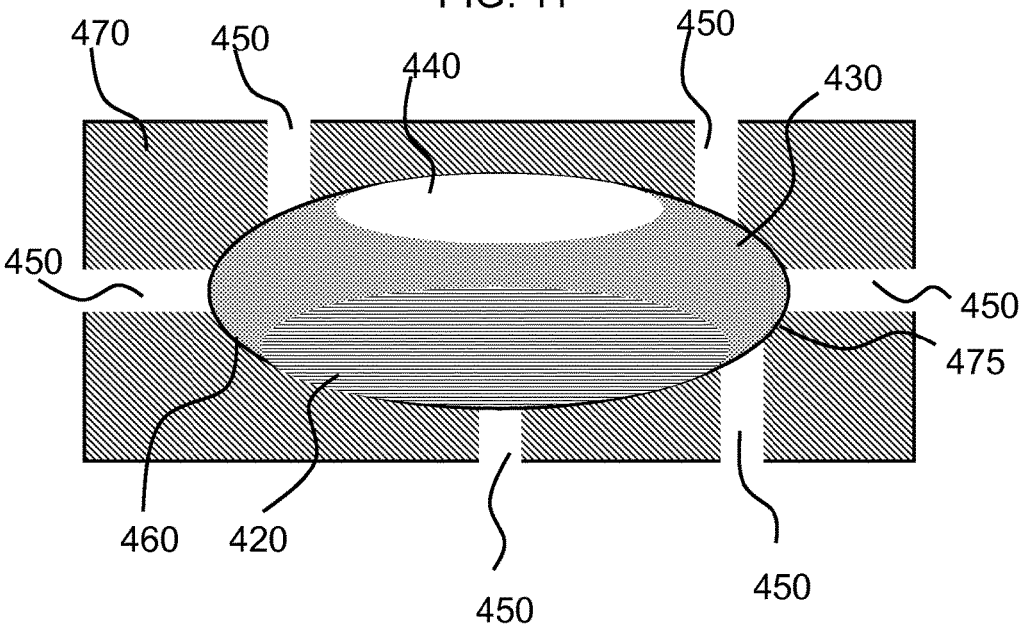
FIG. 11 shows a rock pore that is filled with gas, oil and water.

At a microscopic level a reservoir may contain hydrocarbon reserves as shown in FIG. 11. Water 420, oil 430, and gas 440 are contained in rock pores 475 in a particle of rock 470. The proportion of each fluid is determined by the characteristics of the reservoir. Surface tension 460 constrains the fluids from flowing through capillaries 450 in the particle of rock 470. At a macroscopic level, the reservoir may comprise an assemblage of a large number of such rock particles 470 containing water 420, oil 430 and/or gas 440.

When the reservoir is disturbed or displaced by imparting energy by way of stimulation, for instance by wave excitation, the displacement will give rise to an elastic force in the material adjacent to it, then the next particle of water 420, oil 430, or gas 440 will be displaced, and then the next, and so on. The displacement will be propagated with a speed dependent on the physical properties of the reservoir. If the excitation is oscillatory, an oscillatory pressure wave is the result, i.e., a wave that results from the back and forth vibration of particles of the medium through which the wave is moving. If a wave is moving from left to right through a medium, then particles of the medium will be displaced both rightward and leftward as the energy of the wave passes through it. The motion of the particles is parallel to the direction of the energy transport. This is what characterizes waves as longitudinal waves.

Figure 12:
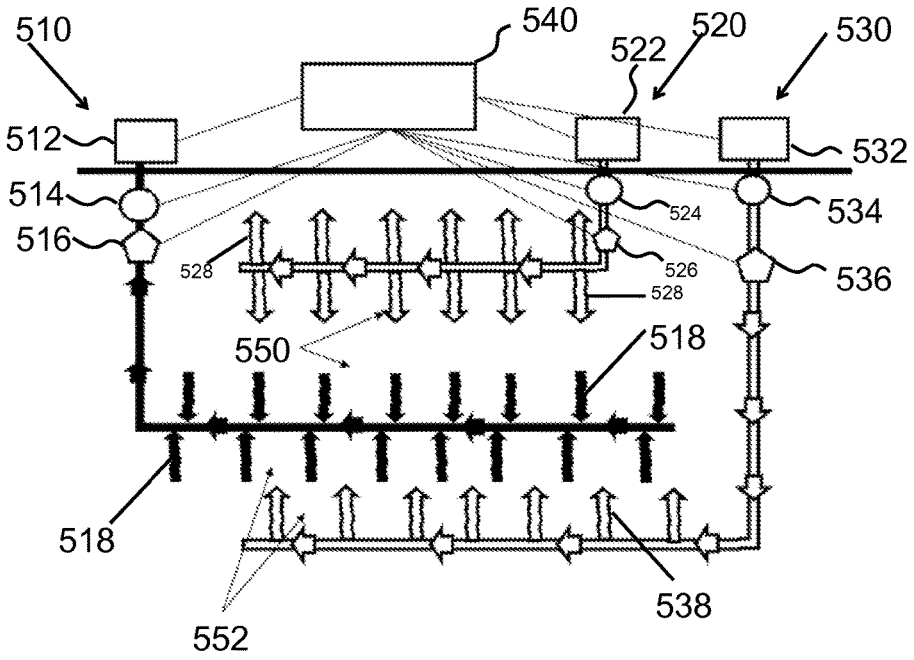
FIG. 12 shows the interface between the control system and various components of the comprehensive enhanced oil recovery system according to an embodiment of the invention

A system and methodology for stimulating a reservoir with pressure waves is shown in FIGS. 12 and 13*a*. Such may for example be done by pulsing an underground reservoir with pressure waves to further increase flow and thereby enable the recovery of even more oil and gas. For instance, acoustic waves may be longitudinal waves that propagate by means of adiabatic compression and decompression in the reservoir. As described above, longitudinal waves have the same direction of vibration as their direction of propagation. Acoustic waves propagate with the speed of sound which depends on the medium. Acoustic waves are characterized by sound pressure, particle velocity, particle displacement, and sound intensity. Prior to or in combination with generating pulsing pressure waves, the reservoir may be further conditioned using other techniques to multiply the oil recovery benefits of using the pressure waves as described herein. For example, in the embodiment shown in FIG. 13*a*, the reservoir is further conditioned using a thermal flooding technique shown in FIG. 17, and described in reference thereto. The flooding with $CO_2$, heat, hot water and/or wave pulsing can be simultaneous, continuous and synchronized in the systems shown in FIGS. 13*a*, 16 and 17.

FIG. 12 shows a pressure wave system according to an embodiment of the invention that includes pressure wave valves/transducers 514, 524, 534, applied to hot brine and $CO_2$ injection wells 520, 530 and oil production wells 510. A pressure wave control system 540 senses a parameter such as pressure (e.g. sound pressure) by means of pressure sensors 516, 526, 536 and controls the pumps 512, 522, 532 and the valves 514, 524, 534 and transducers associated with the oil production well 510 and the injection wells 520, 530. The pressure waves 518 through brine/oil/gas in the production well 510 are controlled by the control system 540 to add constructively 550, 552 with the pressure waves 528, 538 through brine/$CO_2$ in the injection wells 520, 530. This in-phase synchronization of the pulsing pressure waves 518, 528, 538 applied to the two different types of fluid mixtures results in resonant pulsing waves, such as waves 303*a* such as shown in FIG. 6. The synchronized pulsing pressure waves 303*a* act even more effectively on a reservoir 301 conditioned in the manner shown and described below in connection with FIGS. 6 and 16-17 to further reduce surface tension, reduce capillary resistance, and move pore walls to thereby induce oil trapped in pores 470 to become untrapped and combine with other untrapped oil so as to increase the oil flow volume. This is illustrated in FIG. 13*a* which shows pulsing waves 480 coaxing oil 430 from low permeable to high permeable areas by breaking the surface tension 460 and enhancing flow through capillaries 450.

The control system 540 of FIG. 12 controls the frequency and amplitude of pressure waves 518, 528, 538 injected into the reservoir by the oil production well 510 and the injection wells 520, 530. The control system 540 measures the resultant pressure waves 518, 528, 538 with the pressure sensors 516, 526, 536. By managing the pressure waves 518, 528, 538, the control system 540 can create constructive reenforcement 550, 552 of the pressure waves 518, 528, 538 in the reservoir to maximize their effectiveness in enhancing oil and gas flow and recovery.

In an exemplary operation of the present invention, the oil production well 510 is pulsed, creating the first pressure wave 518 in the reservoir. The pressure wave 518 generated by the production well 510 has the effect of pulling oil, gas and/or brine towards the oil production well 510 through ports in the production well 510, where the oil is then pumped to the surface. The pressure pulse 518 can be generated by pulsing the pump 512 or by opening and restricting the flow through the valve 514 to the production well 510 using a valve 514. The amplitude of the pressure wave 518 is determined by the amount the pump 512 power is varied or the amount the flow is restricted through the valve 514 by partially closing the valve 514. The frequency of the pressure wave 518 is controlled by timing the pulsing of the pump 512 or the timing of opening and partially closing the valve 514. Another way of generating the pressure wave 518 is by adding a transducer that will provide additional timed pressure pulses to the flow. A starting low frequency for the generated pressure wave 518 is determined by the make-up of the geology of the reservoir. Once a starting frequency is selected, the frequency can be increased and/or decreased by the control system 540 until the maximum oil and gas flow is achieved. More than one frequency can be used over the course of generating the pressure waves 518.

Further, one or more injection wells 520, 530 are pulsed creating pressure waves 528, 538 in the reservoir. The pressure waves 528, 538 generated by the injection wells 520, 530 from brine and $CO_2$ passing through ports in the injection wells 520, 530 have the effect of pushing oil towards the oil production well 510, where the oil is then pumped to the surface. The pressure waves 528, 538 can be generated by pulsing the pump 522, 532, or by opening and restricting the flow through the valves 524, 534 through the injection wells 520, 530 using the valve 524, 534. The amplitude of the pressure waves 528, 538 is determined by the amount the pump 522, 532 power is varied or the amount the flow is restricted through the valves 524, 534 by repeatedly partially closing and opening the valves 524, 534. The frequency of the pressure waves 528, 538 is controlled by timing the pulsing of the pump 522, 532 or the timing of opening and partially closing the valves 524, 534. Another manner of generating the pressure waves 528, 538 is by adding a transducer that will add additional timed pressure pulses to the flow. The frequency (or frequencies if more than one frequency is used) of the waves 528, 538 should match the frequency of the pulsing waves 518 of the oil and gas production well 510. The timing of the creation of the pressure wave 128, 138 is timed by the control system 540 so that constructive wave interference 550, 552 is achieved to create a heightened pressure wave 480. The constructive wave interference 550, 552 increases the amplitude and distance the pressure wave 480 may penetrate and influence flow in the reservoir, which increases the pushing and pulling effects of the waves.

The control system 540 constantly monitors the pressure wave system and adjusts the frequencies and amplitudes of the pressure waves 518, 528, 538 in order to maximize oil 430 and gas 440 flow out of the rock pores 470, and hence maximize the volume of oil 430 and gas 440 extracted per unit time. Because the pressure waves 518, 528, 538 will travel through different media of the reservoir at different speeds, the control system 140 is configured to adjust the timing of the pressure waves to ensure the maximum effect on the oil and gas extraction. The speeds of pulsing waves through various media are indicated below in Tables 2, 3 and 4.

TABLE 2

(Solids)

| Substance | Density ($g/cm^3$) | Vl (m/s) | Vs (m/s) | Vext (m/s) |
|---|---|---|---|---|
| Metals | | | | |
| Aluminum, rolled | 2.7 | 6420 | 3040 | 5000 |
| Beryllium | 1.87 | 12890 | 8880 | 12870 |
| Brass (70 Cu, 30 Zn) | 8.6 | 4700 | 2110 | 3480 |
| Copper, annealed | 8.93 | 4760 | 2325 | 3810 |
| Copper, rolled | 8.93 | 5010 | 2270 | 3750 |
| Gold, hard-drawn | 19.7 | 3240 | 1200 | 2030 |
| Iron, Armco | 7.85 | 5960 | 3240 | 5200 |
| Lead, annealed | 11.4 | 2160 | 700 | 1190 |
| Lead, rolled | 11.4 | 1960 | 690 | 1210 |
| Molybdenum | 10.1 | 6250 | 3350 | 5400 |
| Monel metal | 8.9 | 5350 | 2720 | 4400 |
| Nickel (unmagnetized) | 8.85 | 5480 | 2990 | 4800 |
| Nickel | 8.9 | 6040 | 3000 | 4900 |
| Platinum | 21.4 | 3260 | 1730 | 2800 |
| Silver | 10.4 | 3650 | 1610 | 2680 |
| Steel, mild | 7.85 | 5960 | 3235 | 5200 |
| Steel, 347 Stainless | 7.9 | 5790 | 3100 | 5000 |
| Tin, rolled | 7.3 | 3320 | 1670 | 2730 |
| Titanium | 4.5 | 6070 | 3125 | 5080 |
| Tungsten, annealed | 19.3 | 5220 | 2890 | 4620 |
| Tungsten Carbide | 13.8 | 6655 | 3980 | 6220 |
| Zinc, rolled | 7.1 | 4210 | 2440 | 3850 |
| Various | | | | |
| Fused silica | 2.2 | 5968 | 3764 | 5760 |
| Glass, Pyrex | 2.32 | 5640 | 3280 | 5170 |
| Glass, heavy silicate flint | 3.88 | 3980 | 2380 | 3720 |
| Lucite | 1.18 | 2680 | 1100 | 1840 |
| Nylon 6-6 | 1.11 | 2620 | 1070 | 1800 |
| Polyethylene | 0.9 | 1950 | 540 | 920 |
| Polystyrene | 1.06 | 2350 | 1120 | 2240 |
| Rubber, butyl | 1.07 | 1830 | | |
| Rubber, gum | 0.95 | 1550 | | |
| Rubber neoprene | 1.33 | 1600 | | |
| Brick | 1.8 | | | 3650 |
| Clay rock | 2.2 | | | 3480 |
| Cork | 0.25 | | | 500 |
| Marble | 2.6 | | | 3810 |
| Paraffin | 0.9 | | | 1300 |
| Tallow | | | | 390 |
| Ash, along the fiber | | | | 4670 |
| Beech, along the fiber | | | | 3340 |
| Elm, along the fiber | | | | 4120 |
| Maple, along the fiber | | | | 4110 |

TABLE 3

(Liquids)

| Substance | Formula | Density ($g/cm^3$) | Velocity at 25° C. (m/s) | $-\delta v/\delta t$ (m/sec ° C.) |
|---|---|---|---|---|
| Acetone | $C_3H_6O$ | 0.79 | 1174 | 4.5 |
| Benzene | $C_6H_6$ | 0.87 | 1295 | 4.65 |
| Carbon tetrachloride | $CCl_4$ | 1.595 | 926 | 2.7 |
| Castor oil | $CH_{11}H_{10}O_{10}$ | 0.969 | 1477 | 3.6 |
| Chloroform | $CHCl_3$ | 1.49 | 987 | 3.4 |
| Ethanol amide | $C_2H_7NO$ | 1.018 | 1724 | 3.4 |
| Ethyl ether | $C_4H_{10}O$ | 0.713 | 985 | 4.87 |
| Ethylene glycol | $C_2H_6O_2$ | 1.113 | 1658 | 2.1 |

TABLE 3-continued (Liquids)

| Substance | Formula | Density ($g/cm^3$) | Velocity at 25° C. (m/s) | $-\delta v/\delta t$ (m/sec ° C.) |
|---|---|---|---|---|
| Glycerol | $C_3H_8O_3$ | 1.26 | 1904 | 2.2 |
| Kerosene | | 0.81 | 1324 | 3.6 |
| Mercury | Hg | 13.5 | 1450 | |
| Methanol | $CH_4O$ | 0.791 | 1103 | 3.2 |
| Turpentine | | 0.88 | 1255 | |
| Water (distilled) | $H_2O$ | 0.998 | 1496.7 | −2.4 |

TABLE 4

(Gases)

| Substance | Formula | Density (g/L) | Velocity (m/s) | $\delta v/\delta t$ (m/sec ° C.) |
|---|---|---|---|---|
| Air, dry | | 1.293 | 331.45 | 0.59 |
| Ammonia | $NH_3$ | 0.771 | 415 | |
| Argon | Ar | 1.783 | 319 (at 20° C.) | 0.56 |
| Carbon monoxide | CO | 1.25 | 338 | 0.6 |
| Carbon dioxide | $CO_2$ | 1.977 | 259 | 0.4 |
| Chlorine | $Cl_2$ | 3.214 | 206 | |
| Deuterium | $D_2$ | | 890 | 1.6 |
| Ethane (10° C.) | $C_2H_6$ | 1.356 | 308 | |
| Ethylene | $C_2H_4$ | 1.26 | 317 | |
| Helium | He | 0.178 | 965 | 0.8 |
| Hydrogen | $H_2$ | 0.0899 | 1284 | 2.2 |
| Hydrogen chloride | HCl | 1.639 | 296 | |
| Methane | $CH_4$ | 0.7168 | 430 | |
| Neon | Ne | 0.9 | 435 | 0.8 |
| Nitric oxide (10° C.) | NO | 1.34 | 324 | |
| Nitrogen | $N_2$ | 1.251 | 334 | 0.6 |
| Nitrous oxide | $N_2O$ | 1.977 | 263 | 0.5 |
| Oxygen | $O_2$ | 1.429 | 316 | 0.56 |
| Sulfur dioxide | $SO_2$ | 2.927 | 213 | 0.47 |
| Vapors | | | | |
| Acetone | $C_3H_6O$ | | 239 | 0.32 |
| Benzene | $C_6H_6$ | | 202 | 0.3 |
| Carbon tetrachloride | $CCl_4$ | | 145 | |
| Chloroform | $CHCl_3$ | | 171 | 0.24 |
| Ethanol | $C_2H_6O$ | | 269 | 0.4 |
| Ethyl ether | $C_4H_{10}O$ | | 206 | 0.3 |
| Methanol | $CH_4O$ | | 335 | 0.46 |
| Water vapor (134° C.) | $H_2O$ | | 494 | 0.46 |

Figure 14A:
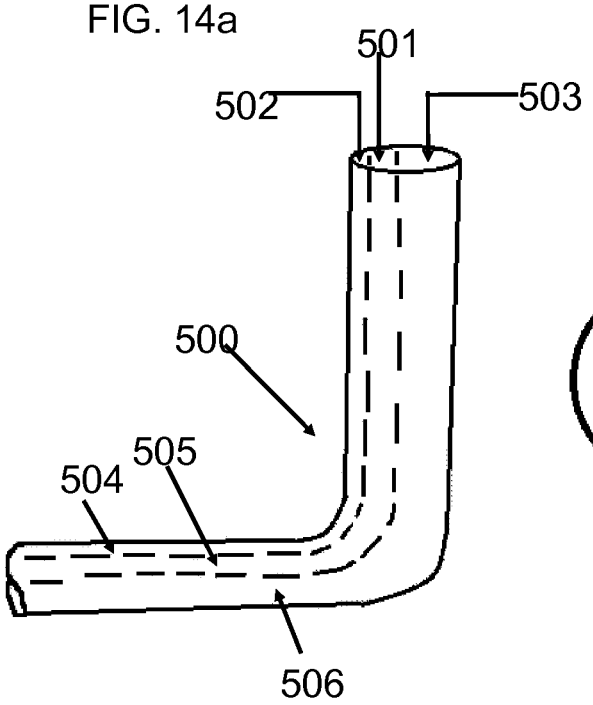
FIGS. 14*a* and 14*b* shows a system design for thermally-induced, steam-collapse, shock pulse generation, according to an embodiment of the invention.
Figure 14B:
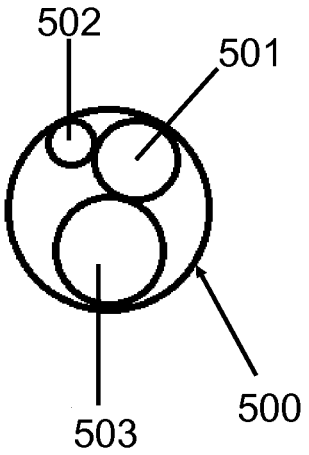

A further method for generating pressure pulses in accordance with the invention is shown in FIGS. 14*a* and 14*b*. Within a porous pipe 500, a plurality of tubes or pipes 501, 502, 503, each having ports, are provided. A water tube 501 is provided with a pulsed supply of heated liquid water that flows through the tube 501. The heated liquid water is pressurized so that the water can maintain its liquid form at a high temperature while travelling through the tube 501. As the liquid water exits the tube through an outlet 504 in the reservoir, which has a lower pressure, and the water experiences a decrease in pressure, which causes the water to vaporize.

A second, insulated water tube 502 is provided with a supply of cooler water that flows through the tube 502. The water supplied through the tube 502 is supplied in a timed, pulsed manner. As a result, water escapes through the perforations of the tube outlet 505 and mixes with the previously described vaporized water created from the drop in pressure of the water from tube 501 in spurts. The temperature of the resulting combined flow is lower and the causes the vaporized water to reliquify and with a significant pressure decrease.

The rapid change of the water from a liquid form to a vapor form and back to a liquid form causes large pressure jumps and rapid depressurization. This creates a substantial pressure pulsing wave for pushing oil and gas in a reservoir to an oil production well.

The pipe 500 of FIGS. 14*a* and 14*b* can be used as an injection well 520, 530, for example. This method can be also used in conjunction with the pulsing methods described previously to increase the amplitude of the pulses in the primary water tube 401.

The techniques for generating pressure pulsing waves in an oil or gas reservoir are not limited to those techniques previously described, but other techniques can be used without departing from the spirit of the invention.

Wave models will determine the optimum frequency, placement, and timing or phasing of pressure oscillations to maximize amplitude of the pressure waves at the target locations in the field. As shown in FIG. 6, the pressure waves can be produced by the pumping equipment and/or oscillating equipment attached to the pumps used for both injection and production. Additionally or alternatively, pressure waves can be produced by a thermal injection based process that creates significant shock wave-like pressure pulses. The output of pressure wave amplitude for a given frequency and optimum phasing for the pumping components will be optimized for maximum yield versus the pumping energy cost for a specific formation.

Figure 15:
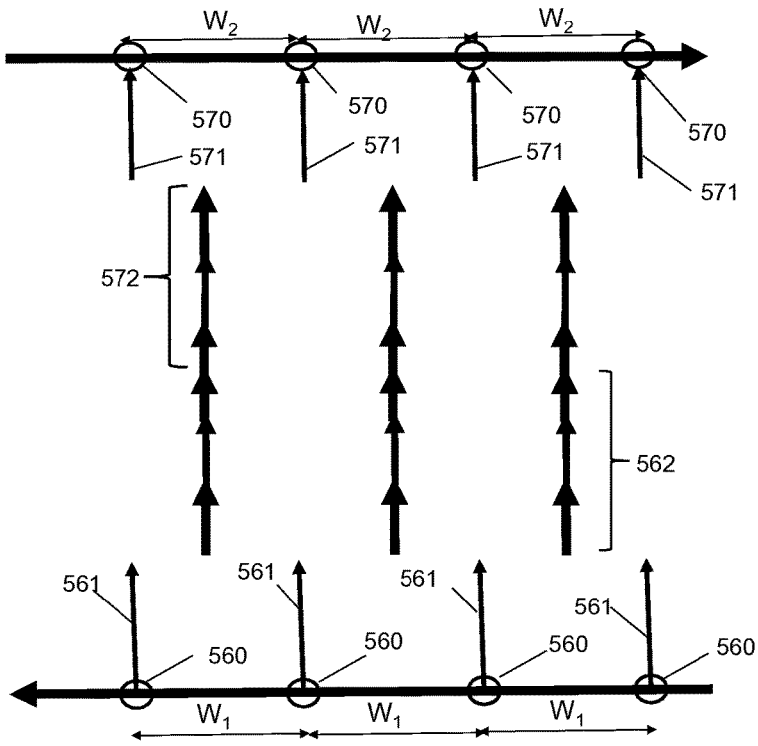
FIG. 15 shows two levels of constructive interference, the first level occurring one wavelength from the injection ports and the extraction ports and the second level occurring within the reservoir at a distance that depends on the phase timing control of the injection and extraction waves.

An example of a formation according to an embodiment of the invention is shown in FIG. 15. The formation includes multiple injection ports 560 and extraction ports 570. The extraction ports 570 can be production wells such as production well 510 shown and described in FIG. 12, and the injection ports 560 can be injection wells such as injection wells 520 and 530, also shown and described in FIG. 12.

The injection ports 560 are each separated by a distance $W_1$. As an example, when the ports are separated by a distance of forty-two feet, waves having a frequency of twenty-seven hertz can be created. Pressure waves 561 are generated at the injection ports 560, each also having a wavelength that is the same distance $W_1$ as the distance $W_1$ between injection ports 560. By generating waves 561 with wavelengths $W_1$ corresponding to the distance $W_1$ between injection ports 560, the waves 561 constructively interfere and double in amplitude. In FIG. 15, four injection ports 560 are shown, but the number of injection ports 560 is not limited to four.

The extraction ports 570 are each separated by a distance $W_2$. Pressure waves 571 are generated at the extraction ports 570, each also having a wavelength that is the same distance $W_2$ as the distance $W_2$ between extraction ports 570. By generating waves 571 with wavelengths $W_2$ corresponding to the distance $W_2$ between extraction ports 570, the waves 571 constructively interfere and double in amplitude. The distance $W_1$ between injection ports 560 and the distance $W_2$ between extraction ports 570 can be the same distance, and correspondingly the pressure waves 561 and 571 can have the same wavelength. In FIG. 15, four extraction ports 570 are shown, but the number of extraction ports 570 is not limited to four.

A second level of constructive interference occurs when the waves 561 from the injection wells 561 meet the waves 571 of the extraction wells 570. This further constructive interference results in waves 562 and 572 that are further increased in amplitude. If the wavelengths $W_1$ and $W_2$ of the waves 561 and 571 are the same, the amplitudes will double.

A control system 540, as shown and described in FIG. 12, is configured to manage the timing of the pulsing so that the waves 561 and 571 constructively meet. The control system 540 continuously takes measurements and adjusts to maximize the wave forces operating in the reservoir, as previously described. Maximizing the wave forces and the amplitudes of the waves maximizes the directional flow of the oil, gases and water in the reservoir from the injection well to the producer well.

Pulsed pressure waves are used to move oil that is "locked" into formations by being trapped by surface tension in the small capillary sized openings in the formation rock. The steep localized pressure gradient in a pressure pulse can move the oil "droplets" through the capillaries until they encounter larger passageways. The oil can then flow via the overall pressure gradient in the formation created by either natural pressure gradients or those induced by pumps for the production and injection wells. This increases oil recovery rates and overall yields in lower permeability formations. The portion of the tightly held oil that can be moved by a given pressure wave generator is dependent on the distribution of oil and gas in the formation, the pore size, the surface tension of the oil, the water and free gas content co-located in the formation and the number and size of the capillaries. By further heating the oil in the formation using techniques described below, the surface tension of the oil can be significantly reduced, i.e., by 50% or more, resulting in a significant increase in the amount of the formation oil that can be freed by this technique.

Figure 16:
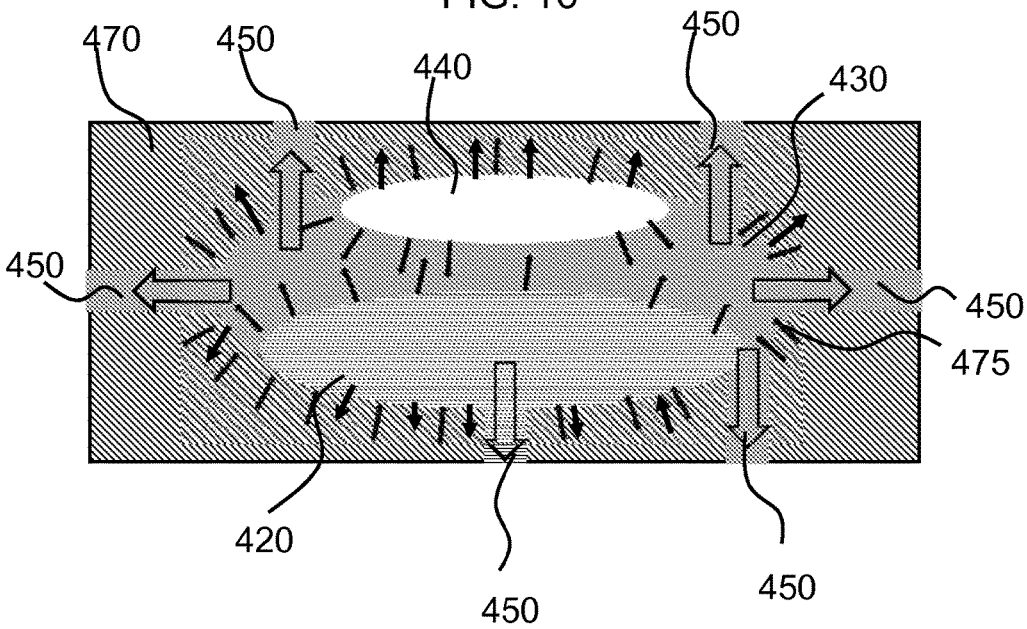
FIG. 16 shows the impact of applying the thermal heating of the rock pore according to an embodiment of the invention.
Figure 17:
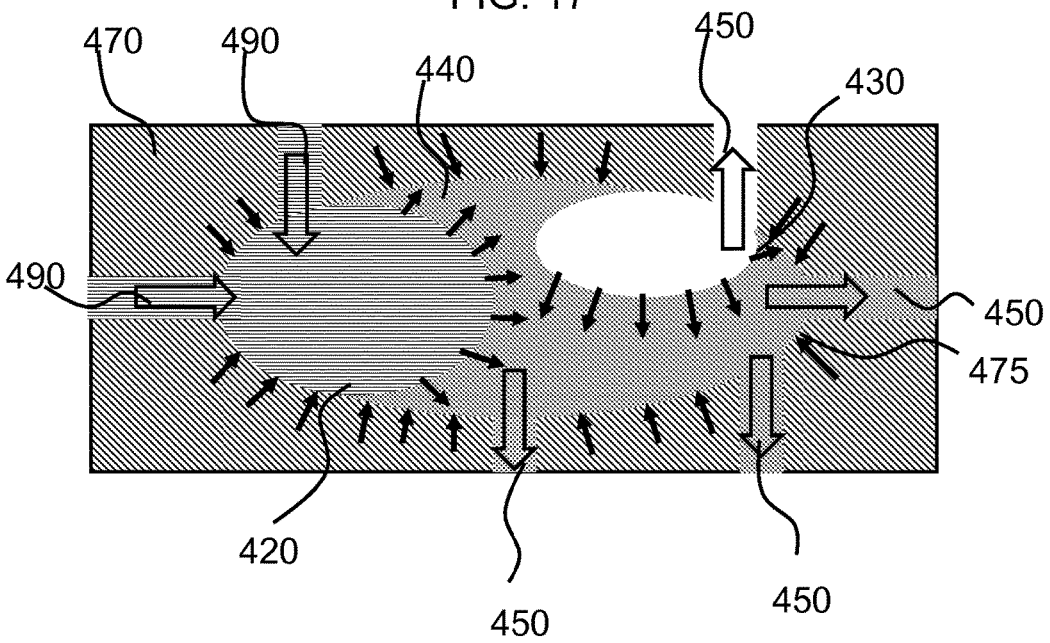
FIG. 17 shows the impact of the hot brine and $CO_2$ and $N_2$ flooding from an injection well creating oil movement to producer wells according to an embodiment of the invention.

Thermal and Brine $CO_2$ Flooding (FIGS. 16 and 17)

A further technique that can be integrated into the comprehensive system according to the invention is thermal flooding of an oil and gas reservoir to maximize extraction rates and total yield from an oil and gas reservoir. Using an oil/heat delivery matrix, the rock or sand pores containing the oil, gas and water/brine, as shown in FIG. 11, are heated. Thermal energy is combined with other advanced processes to deliver constant and sustainable heat and pressure into an oil reservoir.

Heat is applied to an oil or gas field to lower the viscosity and surface tension in crude oil field rock pore 475 capillary cracks 450, as shown in FIG. 16. This process of radiating heat release into the formation is accomplished using a closed loop liquid heating system and/or an electrical radiating system, such as those systems shown in FIGS. 5 and 6.

As the heat is applied, the rock 470 expands, which shrinks the rock pore 475. The water 420, oil 430 and gas 440 all also expand. Each of these expansions creates pressure. The oil 430 emits gas, further creating pressure. The viscosities of the oil 430, gas 440 and water 420 lower and the interfacial tension or surface tension 460 of the capillary restrictors 450 is broken and the fluids 420, 430, 440 start to flow.

Changing the rock pore 475 viscosity and breaking the surface tension 460 create flow paths for the oil 430 and gas 440 through the oil/heat delivery matrix.

Hot fluid injection 490, including both brine and $CO_2$ and preferably from a perforated horizontal pipe, can further provided, as shown in FIG. 17. It is critical to accurately combine the mass and thermal effects from hot brine and $CO_2$ injection 490 with the thermal flooding previously discussed and shown in FIG. 16. The combined results of these techniques can be used to specify the placement of the production tubing to maximize yield rates from the oil/heat delivery matrix. The brine and $CO_2$ 490 are combined and delivered under pressure as shown in FIG. 17.

The injected $CO_2$ (and in some instances $N_2$) pushes the fluids (water 420, oil 430 and gas 440) in the rock pore 475 having a very low viscosity towards the producer well. The $CO_2$ mixes with the oil 430, which lowers the viscosity of the oil 430. The hot $CO_2$ and brine 490 heat the water 420, oil 430 and gas 440. As the viscosity of the fluids is lowered, the brine and $CO_2$ continues to push the fluids toward the producer well. Additionally, the increase in pressure that is created enhances the breaking of the interfacial tension 460 of capillary restrictors 450. The directional pressure further creates oil and gas mobility.

Figure 18:
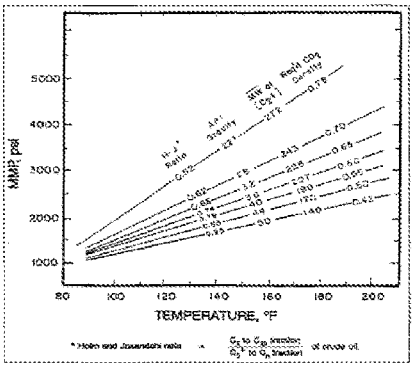
FIG. 18 shows a graph of pressure versus $CO_2$ miscibility.

The parameters that determine the effectiveness of the $CO_2$ injection are further relevant to the miscibility of $CO_2$ and $N_2$ and crude oil. Miscibility refers to the ability of two substances to be mixed. The oil 430 and gas 440 are miscible and mix well, unlike oil 430 and water 420, which are immiscible. Whether $CO_2$ is miscible in specific oil in a reservoir depends on both the pressure and temperature in the reservoir. The lower the oil API (i.e., the heavier the crude), the higher the required minimum miscible pressure (MMP) will be. This relationship is shown in FIG. 18. A higher reservoir temperature will require a higher MMP. Miscibility is important for at least two reasons. First, miscibility enables a high level of surface interaction that controls the rate at which the $CO_2$ can be absorbed into the oil. Second, co-flowing miscible fluids of $CO_2$ and oil will result in an increase of the combined fluid mobility regardless of how much of the $CO_2$ has been absorbed into the oil. The mobile $CO_2$ drags the oil along. Therefore, miscibility is not necessary but is highly beneficial to enhanced oil recovery processes using $CO_2$.

$CO_2$ and $N_2$ flooding of oil reservoirs is used to increase the mobility of the oil and to increase both the rate and the percentage of oil recovered from the reservoir. $CO_2$ is soluble in oil, with the amount of $CO_2$ that can be absorbed depending on oil composition and temperature, as discussed above. All crude oil weights can "absorb" significant amounts of $CO_2$. When $CO_2$ is absorbed into the oil, it decreases the viscosity of the oil and the interfacial tension between the oil and the rock, both of which increase the oil's mobility. Oil highly saturated with $CO_2$ (and $N_2$) can have viscosity reduced by one to two orders of magnitude. This absorption also causes the oil to "swell" which helps force the oil out of voids where it can be trapped. $CO_2$ and $N_2$ are generated by burning crude oil or gas that was normally flared, in a boiler, scrubbing the exhaust and re-injecting the $CO_2$ and $N_2$ and other gases into the reservoir, as described and shown in FIGS. 5-6 for example.

Heavy crudes and $CO_2$ miscibility are generally found at less deep locations than light crude. This means that reservoir pressures are frequently below the MMP for heavy crudes. A reservoir will usually have about 1 psi (pound per square inch) of pressure for every 2¼ feet of depth. As seen in FIG. 18, pressures exceeding 2,000 or 3,000 psi are frequently needed to achieve miscibility at common heavy crude reservoir compositions and temperatures. This correlates to well depths of 4,500 to 7,000 feet. The pressure of shallower reservoirs can be increased by pumping water and $CO_2$ and $N_2$ into the reservoir, under pressure. These are both physical characteristics—how well can the pumping fluids push the oil to the producing well based on geology, and economics. The $CO_2$ and $N_2$ are yielded from combusting co-produced natural gas that would otherwise be flared and/or retrieved crude oil, the economics can be quite attractive for increasing reservoir pressure via $CO_2$ and $N_2$ injection.

One technique that is commonly used in enhanced oil recovery processes using $CO_2$ and $N_2$ is to alternate brine (water) and $CO_2$ and $N_2$ injection. This tends to create water fronts that push the oil toward the production well that has been mobilized by the previous $CO_2$ and $N_2$ injection cycle. This water and gas alternating process ("water after gas" or "WAG") has proven highly successful.

Thermal enhanced oil recovery processes can be combined with $CO_2$ and $N_2$ processes to yield excellent results. The majority of the benefit of $CO_2$ and $N_2$ absorption to oil mobility occurs early in the approach to saturated levels of $CO_2$ and $N_2$ in the oil, so that much of the reduced viscosity benefit is obtained at low saturation levels. The combination of increased temperature and $CO_2$ and $N_2$ absorption both increase mobility. This is especially convenient if the $CO_2$ and $N_2$ can be obtained from burning natural gas (and/or crude oil) that is frequently contained in the harvested oil. The combustion of this gas yields $CO_2$ and the thermal energy that can be added to the water (or brine) that is injected into the reservoir when applying enhanced oil recovery processes described in accordance with the present invention.

Though varying significantly based on crude oil composition, surface tension (δ) values at 100° F. (32° C.) range from 20 to 40 dynes/cm for oil, gas, rock interfaces. Values are roughly half that value for oil, water, rock interfaces. What is fairly consistent is the change in surface tension with temperature, generally running in the −0.10 to −0.18 dynes/cmK range.

For example, by heating the formation oil from a typical temperature of 40° C. to 140° C., the surface tension would drop from 30 dynes/cm to 15 dynes/cm. As a quantitative example, for a pore size (d) of 1 mm (0.1 cm), the force required to break surface tension is estimated as follows:

$$F=\pi\cdot\delta d\cdot\cos(\theta)=6.6 \text{ dynes}$$

When it is assumed there is a 45 degree contact angle for θ

If it is assumed a single bubble in a gas filled pore has a pressure gradient of $$dp/dx=F\cdot(4/\pi/d^3)=8400 \text{ dynes/cm}^3=0.31 \text{ psi/in}$$

The issue then becomes what pressure pulse will create that pressure gradient in the pore. The peak gradient in a sine wave is calculated by the following:

$$dp/dt=\pi\cdot A\cdot f$$

where f is the pulse frequency and A is the pulse pressure amplitude

If divided by the wave speed (v) which is dx/dt, it provides the peak physical gradient.

$$dp/dx=\pi\cdot A\cdot(f/v)$$

The frequency f in Hz is typically approximately 20 Hz to minimize attenuation while traveling through the formation A reasonable pressure wave velocity in a formation (gas/oil/water mixture) is 2000 m/s (78000 in/s)

Equating the two equations allows solving for the required pressure pulse amplitude to dislodge the oil droplet.

$$A=0.31\cdot(v/\pi/f)=0.31\cdot(78000/\pi/20)=385 \text{ psi}$$

If the surface tension is halved then the pressure amplitude required is halved. FIGS. **3*c*-3*e*** are graphs showing the increase in pore size addressability for a given pressure pulse as surface tension is reduced by heating the oil. For a typical oil being stimulated by a 2000 psi, 20 Hz pulse generator, the addressable capillary size drops to below ¼ mm if the oil is heated to 180° F. This is a critical range to address in many tightly held formations.

The Oil/Heat Delivery Matrix (FIGS. 20*a*-33)

Figure 31:
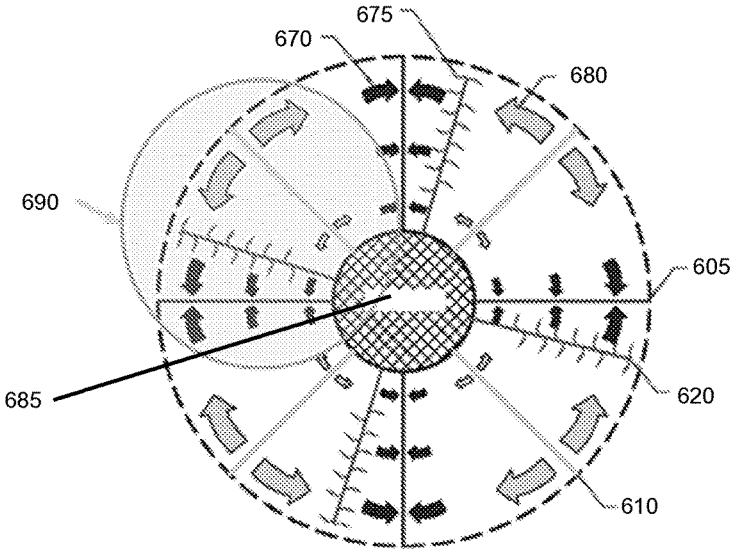
FIG. 31 shows a circular implementation of the comprehensive enhanced oil recovery system according to an embodiment of the invention.
Figure 32:
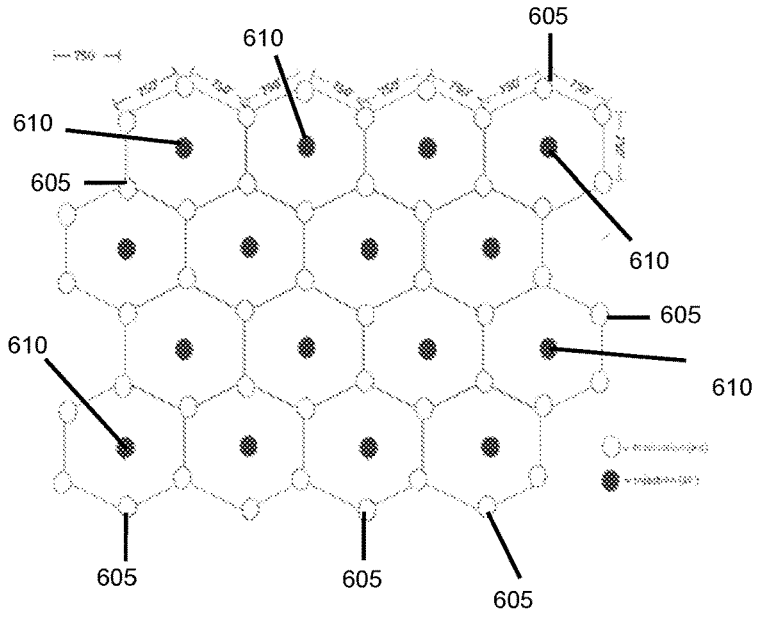
FIGS. 32-33 show flow matrix implantation where the injection wells and production wells are vertical wells.
Figure 33:
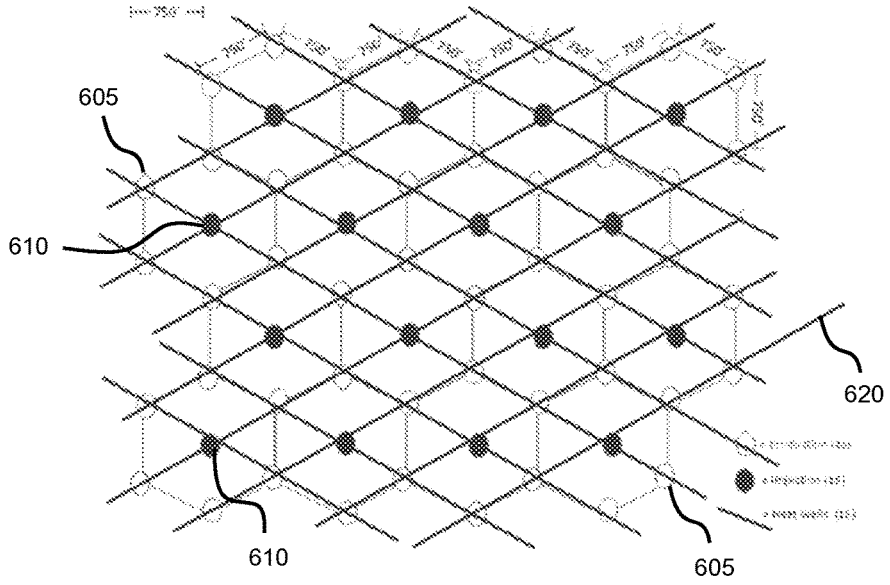

The position of the production, injection, and heat delivery wells is critical to maximizing the flow enhancement from the thermal and injection processes described above. There are a number of arrangements that can be used. The preferred arrangement for a particular reservoir can be selected based on the characteristics of the specific reservoir and the results of the performance models. The following sections will describe several of these arrangements, but are not intended to be an exhaustive listing of all of the possible permutations. These arrangements include: (1) a perpendicular layout having heat delivery wells running perpendicular to the production and injection wells, or lateral formations (FIGS. 20*a*-23); (2) a parallel layout of one or more heat delivery wells running parallel to the production and injection wells (FIGS. 25*a*-30*c*); (3) a circular layout of heat delivery wells running parallel to the production and injection wells, in a pattern radiating out from a central hub (FIG. 31); and (4) using vertical wells to replace the horizontal production and injection wells (FIGS. 32 and 33).

In each of these arrangements, a key for long term success and maximizing the extracted amount of the closely held oil is to adjust the injection and extraction points to bias the oil, water, and gas flows induced by the injection well and production well pulsed pumping to move through areas of newly heated resource as the thermal soaking profile of the resources evolves over time. The adjustment of the fluid injection and extraction points along the length of these wells can be implemented using a number of mechanical means. These methods can involve the use of slotted liners and packers with variable positioning mechanisms, the use of controllable valves or other methods.

The spacing of the injection ports and the extraction ports are critical to achieve the first level of constructive interference. The ports are preferably approximately one wave length of the pulsing frequency apart in order to have a first level of constructive interference, as shown in FIG. 15. A second level of constructive interference occurs when the extraction waves meet the injection waves. This is achieved by controlling the timing of the pulses, the wavelength of the pulsing frequency and the distance between the injection wells and the production wells. A control system manages the pressure gradients, the pulsing frequencies, the ports, the temperatures and the timing in order to converge on the maximum flow rates.

Figure 19:
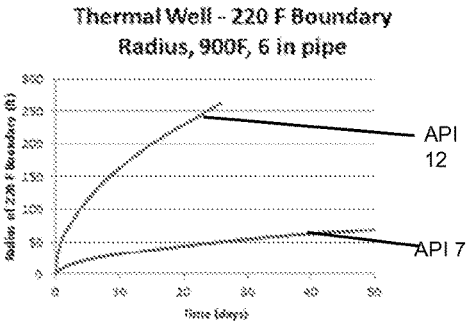
FIG. 19 shows the rate of heat spreading from a heat delivery well.

A region heated to a given temperature around the heat delivery wells expands over time as the heat soaks into the resource. The rate of heat absorption by the resource is controlled by the both conduction characteristic through the fluid and rock, and by the convective flow cells created in the fluid by the differential temperature between the heat delivery well and the formation. A heat transfer model is used to predict the increasing diameter of this heat soak over time. The viscosity of the oil is a critical value in determining the convective effect on the thermal soak rate. A typical result is shown in FIG. 19.

As mentioned above, the flow pattern from the injection well to the production well must be biased to direct flow through newly heated regions in the formation. Regions that are initially heated by the heat delivery wells (at closer radii from the pipe) will be swept by the pulsing injection flow and the oil extracted. As new, oil rich regions are heated (enabling pulse driven flow) the injected flow locations and the entry points to the production well must be adjusted to direct the flow through these newly heated regions. As these inlet and outlet flow locations are moved further from the heat delivery well location as the regions are heated, new oil rich regions will be swept with the injection fluids. Over time, the entire resource can be addressed.

Option 1—Perpendicular Layout

According to a first embodiment shown in FIGS. 20*a*-23, an arrangement in a reservoir is provided with the production wells 605, injection wells 610, a monitoring well 615 and heat delivery wells 620, which are oriented perpendicularly to the production wells 605, injection wells 610, and monitoring well 615. The wells 605, 610, 615, 620 are oriented in between a seal 601 and trap 602 in the reservoir. In the arrangement shown in the Figures, the distance between the seal 601 and trap 602 is approximately 480 feet, and the production wells 605, injection wells 610, a monitoring well 615 and heat delivery wells 620 are located approximately in the middle of this distance, 240 feet from the seal 601 and trap 602. Each of the production wells 605, injection wells 610, and heat delivery wells 620 can have a length of 6,000 feet. The distance between the parallel production wells 605 and injection wells 610 can be approximately 750 feet and the distance between the parallel heat delivery wells 620 can also be approximately 750 feet. The injection wells 610 and production well 605 can incorporate high powered pumps that can be configured for created pressure wave pulses. The monitoring well 615 senses characteristics of the well such as pressure, heat and flow, and is in communication with a control system to adjust the well dynamics to achieve an idealized system.

Figure 20A:
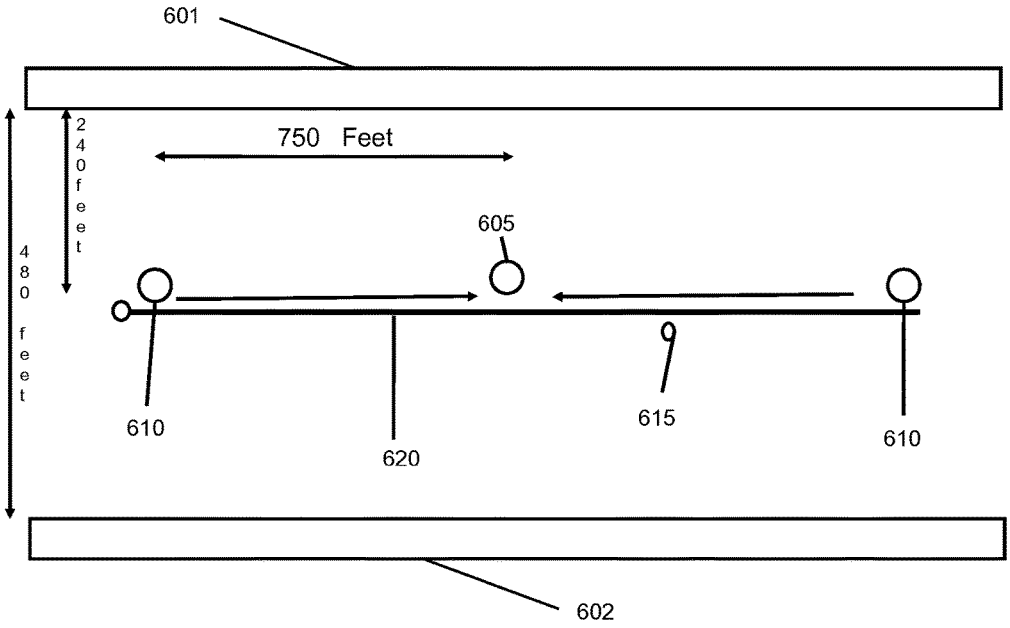
FIGS. 20*a*-20*c* show a cross hatched implantation of the oil/heat delivery matrix.
Figure 20B:
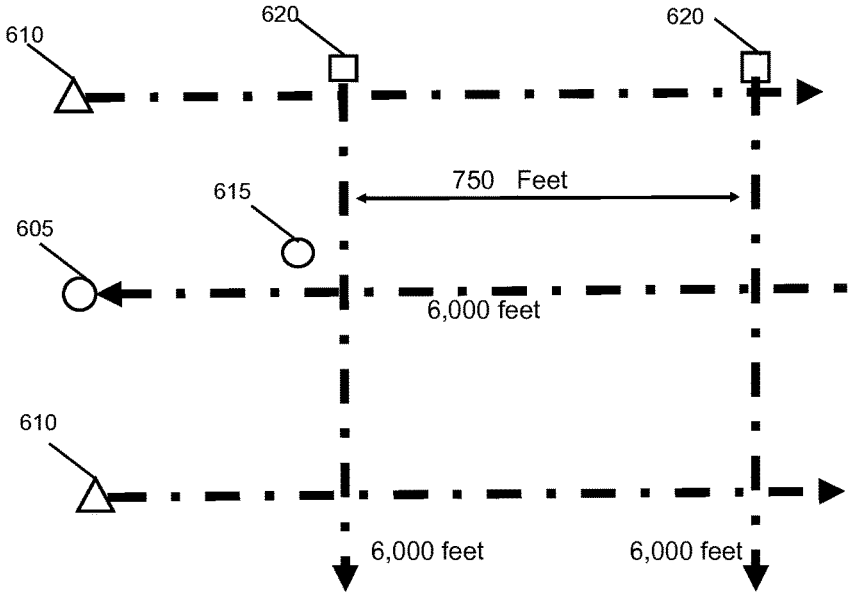
Figure 20C:
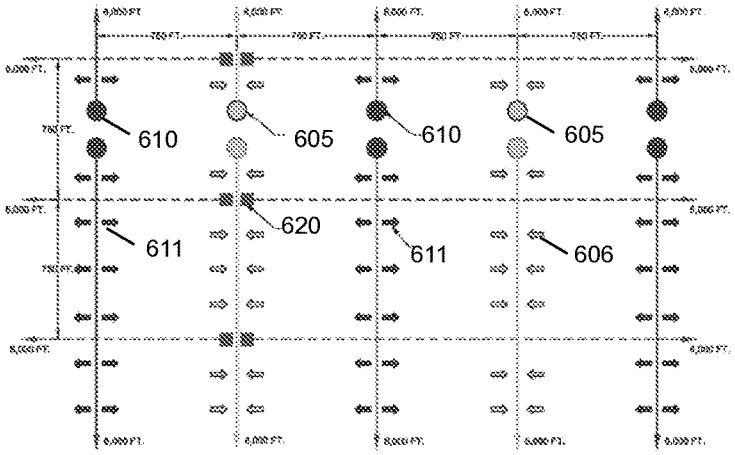

This cross hatched pattern of heat delivery wells create low viscosity paths for the flooding (steam, water and $CO_2$). In this arrangement the heat does not need to expand radially from the source to achieve this as low viscosity paths 630 are immediately created. As the heat does expand radially from the heat delivery well over time, the entire net pay zone is addressed. FIGS. 20*a*-20*c* depict this arrangement.

In the matrix arrangement shown in FIGS. 20*a*-23, technically controlled pressure gradients for the injection wells 610 and the production wells 605 avoid creating disruptive channeling paths. The further the oil is away from the flow paths the higher the pressure gradient will be. This herds the oil directionally to the flow paths. Pressure oscillation creates standing waves in the reservoir that constructively add to increase the amplitude and oil mobility. Directional standing waves break the interfacial tension of the capillaries eliminating flow restrictions and moving the fluids to the producer wells 605. Pressure gradients create imbalances in the reservoir pressures and allows for a large sweep area. Because the heating wells 620 produce a viscosity pattern that can be accurately modeled, specific designs can be implemented to quantitatively set the pressure gradient fields to best match the viscosity patterns.

Figure 20D:
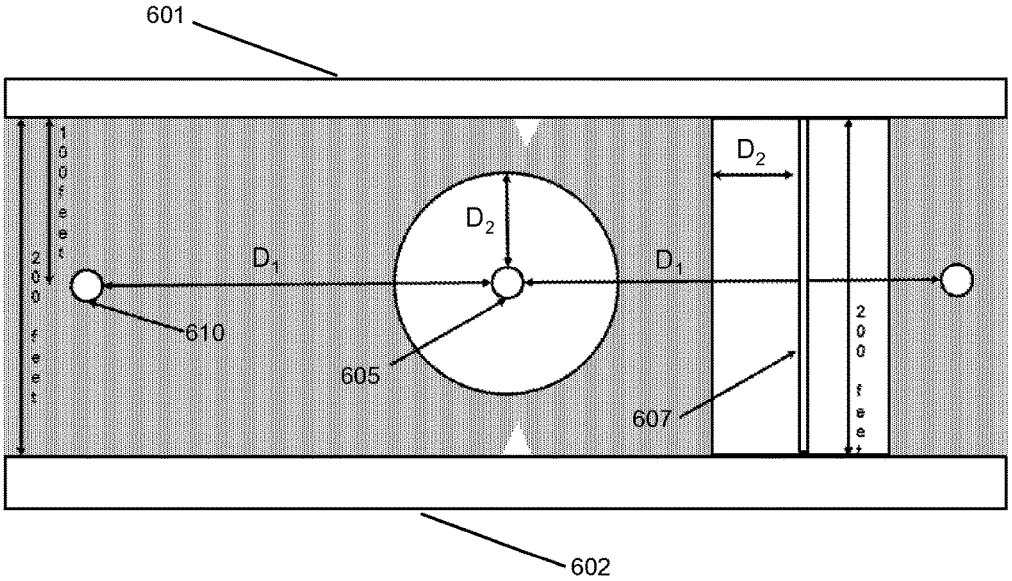
FIG. 20*d* shows a comparison of the comprehensive enhanced oil recovery system to conventional enhanced oil recovery systems.

FIG. 20*d* shows a comparison of the effectiveness of the current system at its maximum recovery stage relative to the maximum recovery stage using hydraulic fracturing. According to the present invention, using the techniques described herein, with a horizontal well 605 is provided a distance $D_1$ from parallel injection wells 620 of 750 feet, the system of the present invention is able to recover up to 1.6 billion cubic feet of oil or gas, and if the distance $D_1$ between the production well 605 and injection well 610 is changed to 375 feet, the system of the present invention is able to recover up to 792 million cubic feet of oil or gas. In contrast, when hydraulic fracturing is used, it is only able to recover oil or gas within a distance $D_2$ from the horizontal production well 605 or vertical production well 607. When a horizontal production well 605 is used, the recovery is up to 95.3 million cubic feet and when a vertical production well 607 is used, the recovery is up to 3.53 million cubic feet.

Figure 21A:
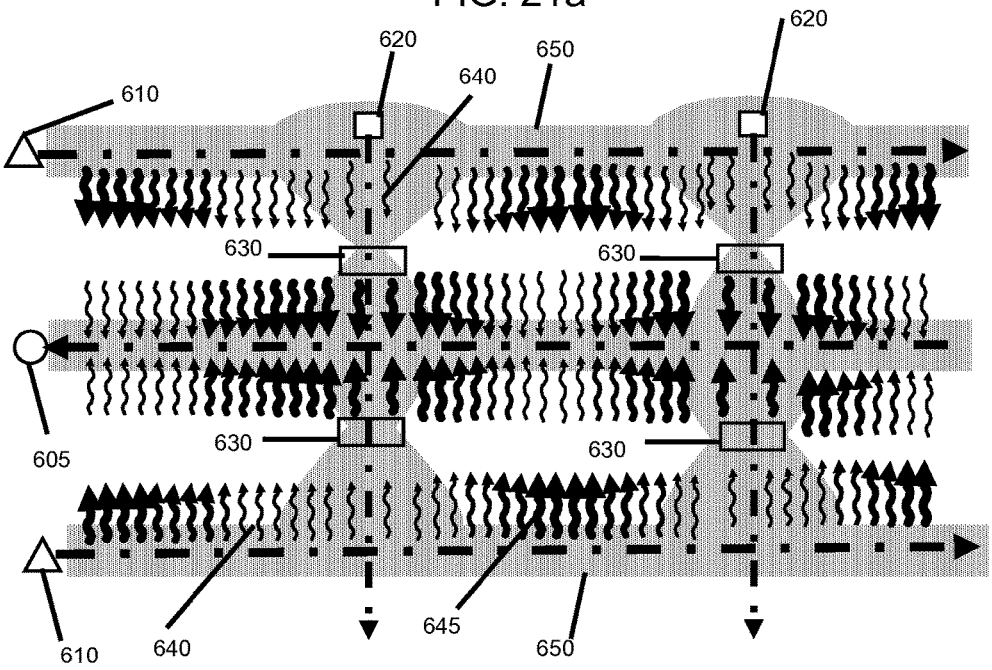
FIGS. 21*a*-21*c* show the volumetric sweep over time of the treated volumetric reservoir using cross hatched heat delivery wells.
Figure 21B:
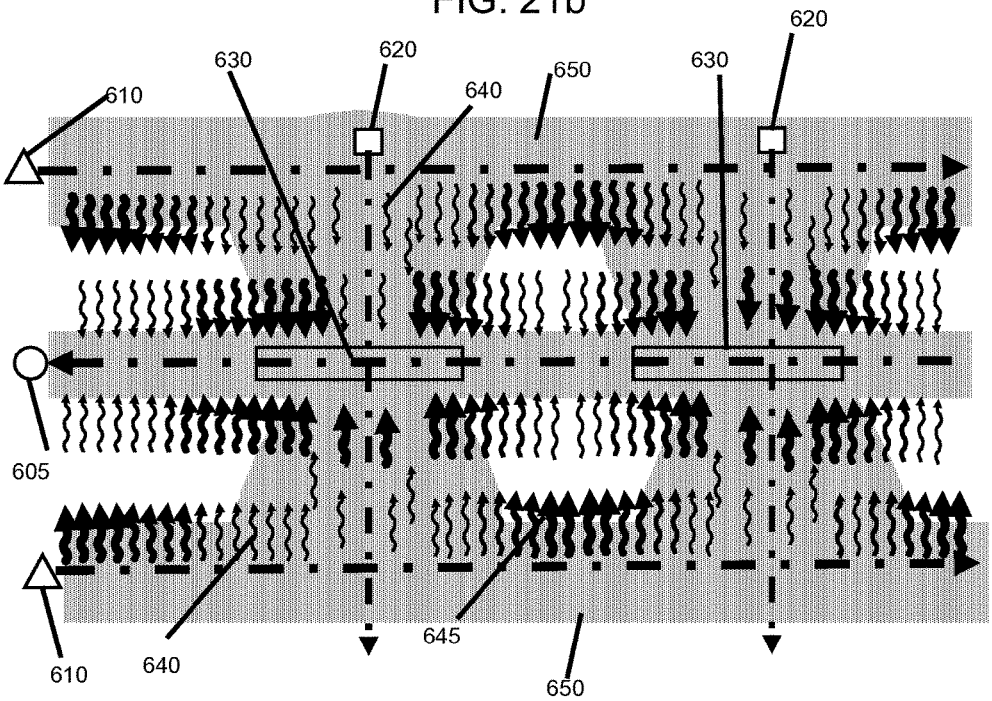
Figure 21C:
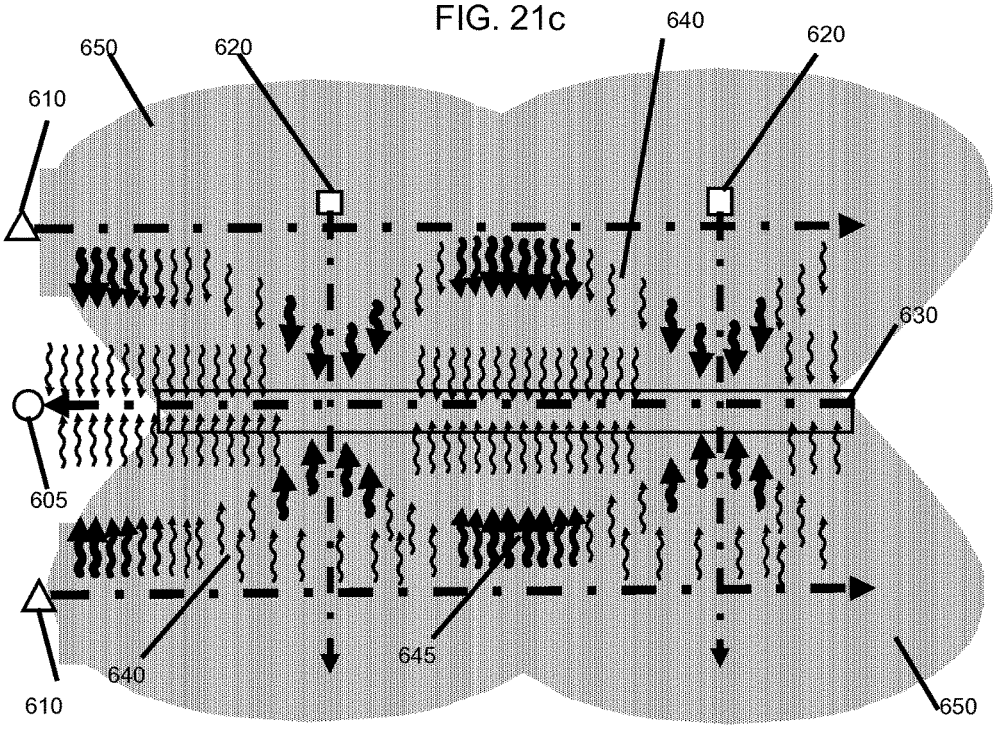

FIGS. 21*a*-21*c* show the growth of the heated region 650 over time (on one plane) and how the flow pattern is manipulated by having pressure gradients along the injection and production wells. In the arrangement shown in FIGS. 21*a*-21*c*, the horizontal heat pulsing waves 640 and 645 will travel in many directions and bounce off of the seal 601, the trap 602 and the higher viscosity oil, but will always travel in the direction of the production well 605. FIG. 21*a* shows the matrix arrangement after 10 days of implementation. FIG. 21*b* shows the matrix arrangement after 50 days of implementation. FIG. 21*c* shows the matrix arrangement once the oil flow has been maximized.

The system shown in FIGS. 21*a*-21*c* includes injector wells 610, heat delivery wells 620 and a producer well 605. The injector wells 610 and heat delivery well 605 are preferably ported, meaning that the pipes of the wells have ports spaced apart along the length of the pipe. For example, the ports can be separated by forty-two feet on each pipe. The size of the ports along the length of the pipes may vary in order to adjust the pressure of the waves created by the fluid exiting or entering the port, depending on whether the ports are in the injector well 610 or producer well 605. Ports having a smaller size or diameter create lower pressure waves 640, while ports having a larger size or diameter create higher pressure waves 645, as the amount of fluid that can exit the port of injector well 610 or enter the producer well 605 increases. As used in the Figures, a thinner wavy arrow 640 corresponds to a low pressure wave and lower corresponding flow rate, and a thicker wavy arrow 645 corresponds to a higher pressure wave and higher corresponding flow rate.

The combination of the injector wells 610, heat delivery wells 620 and producer well 605 as shown in the FIGS. 21*a*-21*c* reduces the viscosity of the oil or gas in the reservoir, creating low viscosity areas 650 and low viscosity flow paths 630. The low viscosity flow paths 630 push and pull oil and gas towards the producer well 605 with greater efficiency. Over time, the size of the low viscosity areas 650 and low viscosity flow paths 630 increases.

Figure 22A:
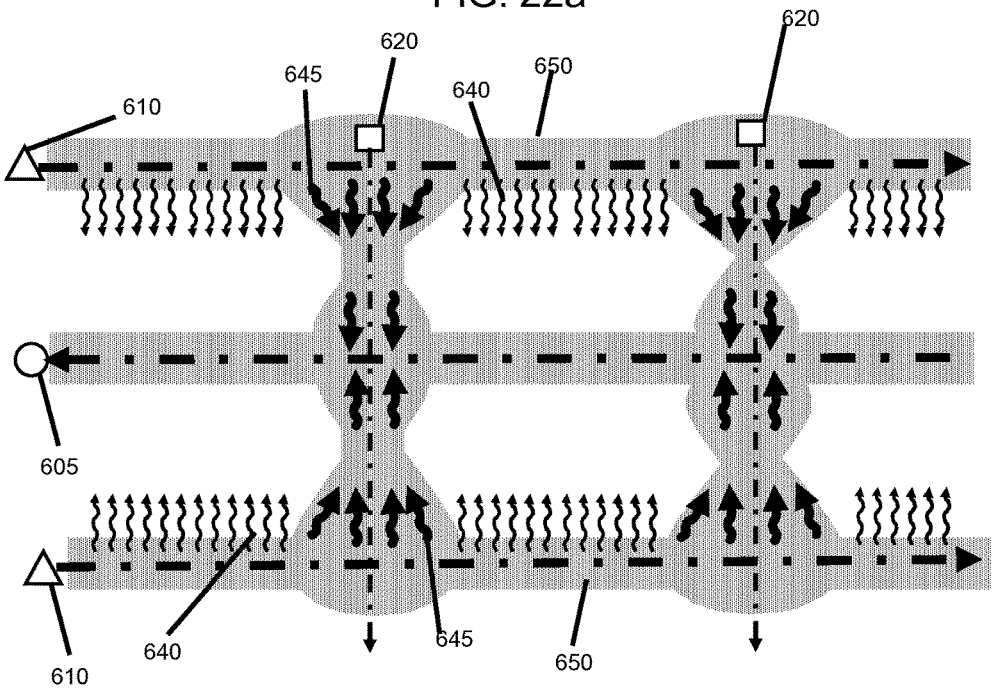
FIGS. 22*a*-22*c* show the volumetric sweep over time varying the pressure gradients to increase the extraction rates of the treated volumetric reservoir.
Figure 22B:
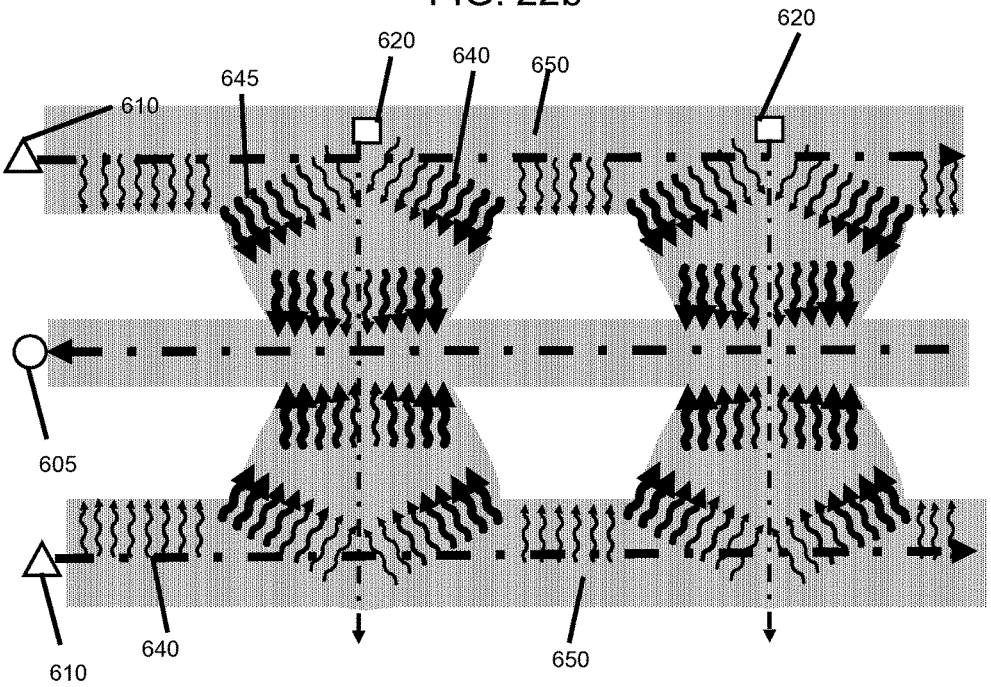
Figure 22C:
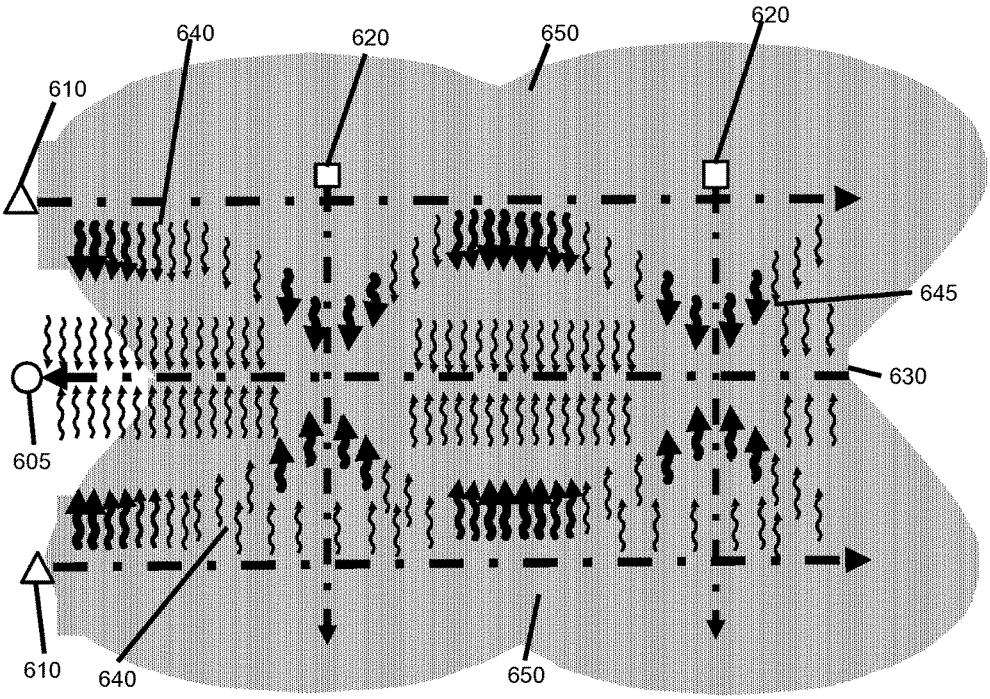

FIGS. 22*a*-22*c* change the pressure gradients blocking the radial flow ingress and egress on the production and injection wells in specific locations over time. FIG. 22*a* shows the matrix arrangement after 10 days of implementation. FIG. 22*b* shows the matrix arrangement after 50 days of implementation. FIG. 22*c* shows the matrix arrangement once the oil flow has been maximized control over the pressure gradients and oscillations (pulses) over time allow the comprehensive enhanced oil recovery system to mobilize and "herd" the oil to the producer wells accomplishing a full sweep of the treated pay zone. The strength of the pressure waves in these embodiments can be adjusted by adjusting the size of the ports in the injector wells 610 and producer well 605, described previously above. An example of this would be the addition of a solid liner over portions of the slotted liner in these wells.

Figure 23:
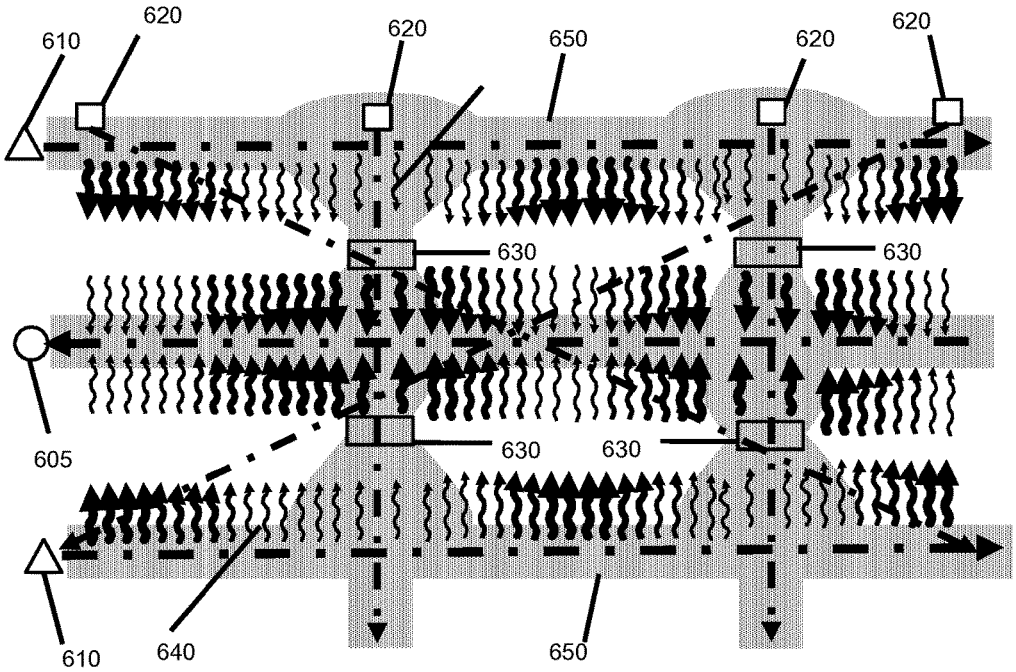
FIG. 23 shows an oil/heat delivery matrix with angular heat delivery wells.
Figure 24:
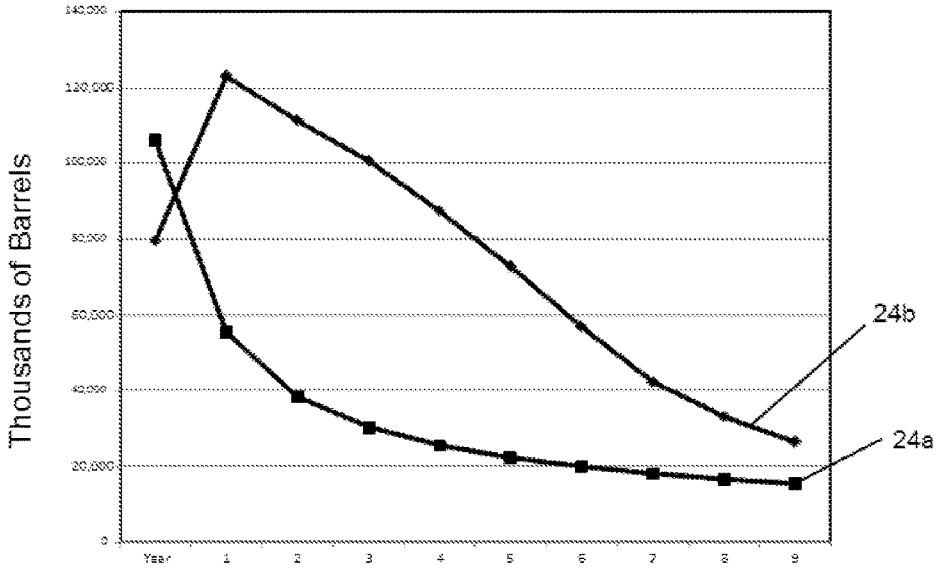
FIG. 24 compares the extraction rates of a standard horizontal fractured well (line 24*a*) against a comprehensive enhanced oil recovery system according to an embodiment of the invention (line 24*b*).

The oil/heat delivery matrix can be established with perpendicular heat delivery wells or with any combination of perpendicular wells and angled wells, as shown in FIG. 23. FIG. 23 shows a well comprising diagonally oriented heat delivery wells 620. Modeling with respect to a particular reservoir can help determine the optimum design of the oil/heat delivery matrix.

Using the flow path approach of the perpendicular matrix arrangement, heat delivery wells 620 create low viscosity areas 650 and low viscosity flow paths 630 for the oil to flow to the production well 605. The flow paths 630 also allow the other enhanced oil recovery techniques to operate with maximum efficiency. Heat delivery wells 620 also create a delivery matrix of low viscosity paths 630 for the flooding techniques (using steam, water and $CO_2$ as described previously), pressure and pulsing to directionally enhance oil flow to the producer. The cross-hatched design of production wells 605, injection wells 610, and heat delivery wells 620 lowers drilling and installation cost, provides immediate low viscosity flow zones, creates many simultaneous flow paths, provides heat expansion in a non-linear fashion once flow starts, and over time, the design addresses the entire net-pay zone.

Option 2—Parallel Layout

According to a second embodiment shown in FIGS. 25*a*-30*c*, an arrangement in a reservoir is provided with production wells 605, injection wells 610, a monitoring well 615 and heat delivery wells 620, which are oriented in parallel to the production wells 605, injection wells 610, and monitoring well 615. The wells 605, 610, 615, 620 are oriented in between a seal 601 and trap 602 in the reservoir. In the arrangement shown in the Figures, the distance between the seal 601 and trap 602 is approximately 480 feet, and the production wells 605, injection wells 610, a monitoring well 615 and heat delivery wells 620 are located approximately in the middle of this distance, 240 feet from the seal 601 and trap 602. Each of the production wells 605, injection wells 610, and heat delivery wells 620 can have a length of 6,000 feet. The injection wells 610 and production well 605 can incorporate high powered pumps that can be configured for created pressure wave pulses.

This arrangement can be implemented with ether one or more heat delivery wells 620 being provided in the space between injection wells 610 and production wells 605. FIGS. 25*a*-27*c* show an example of an embodiment including a single heat delivery well 620 positioned between the injection wells 610 and production well 605. Because two injection wells 610 are shown in FIGS. 25*a*-27*c*, there are two heat delivery wells 620 in total shown. The distance between the parallel production wells 605 and injection wells 610 can be approximately 600 to 750 feet, and the heat delivery wells 620 can be positioned to be approximately halfway between the production well 605 and injection well 610, approximately 300 to 325 or 375 feet from each of the production well 605 and injection well 610, for example.

Figure 25A:
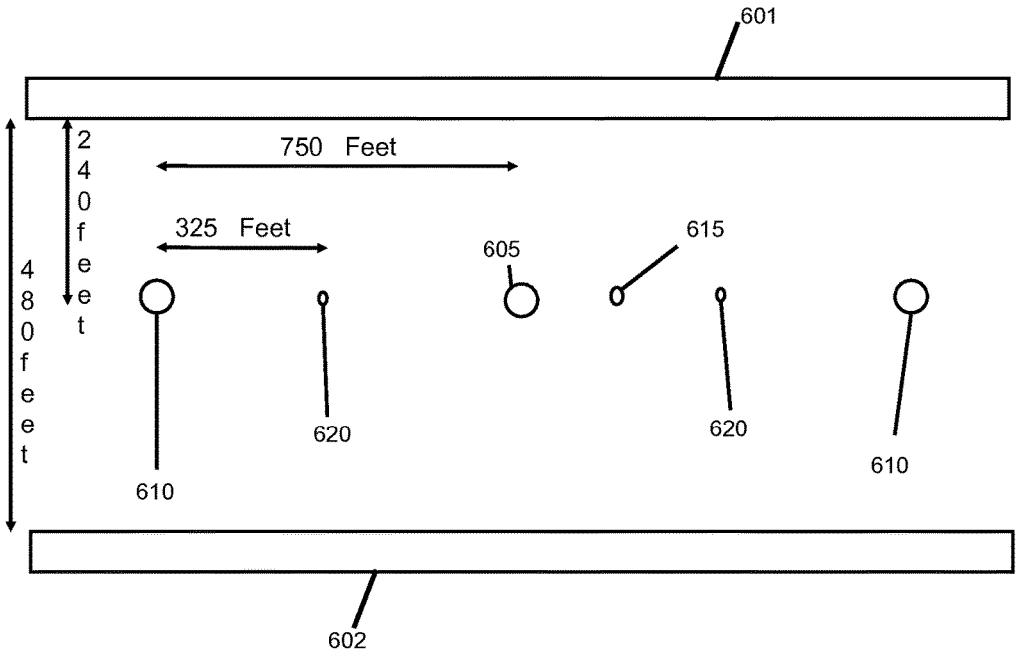
FIGS. 25*a*-25*b* show parallel heat delivery well implementations of the oil/heat delivery matrix with a single heat delivery well between the injection well and the production well.
Figure 25B:
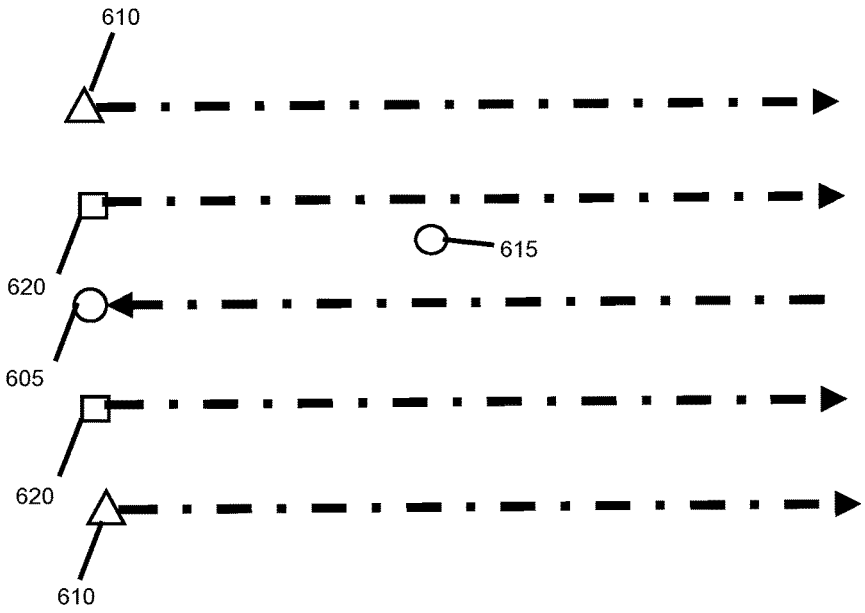
Figure 26:
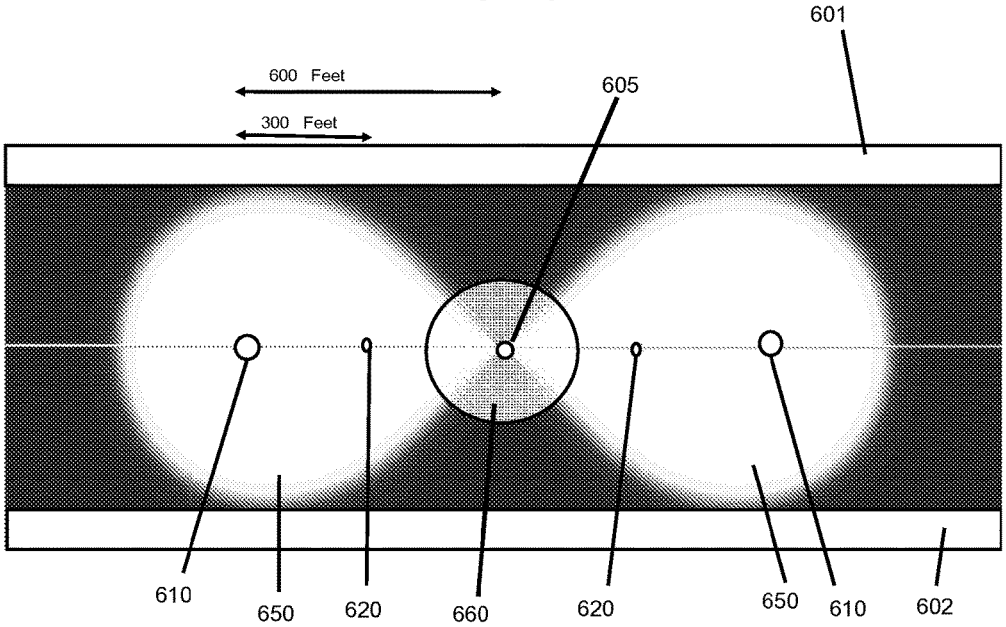
FIG. 26 shows model results of the configuration depicted in FIGS. 25*a* and 25*b*.

FIG. 25*a* shows a horizontal view of the matrix comprising parallel wells and FIG. 25*b* shows an overhead view of the matrix comprising parallel wells. FIG. 26 shows a modeled representation of this formation. As the formation is expanded into full production, the tear shaped low viscosity area 650 will be on both sides of the injection wells 610. The production well 605 and injection wells 610 are provided with high power pulsing pumps. A pull pressure area 660 forms around the production well 605, pulling fluid into the production well 605.

Figure 27A:
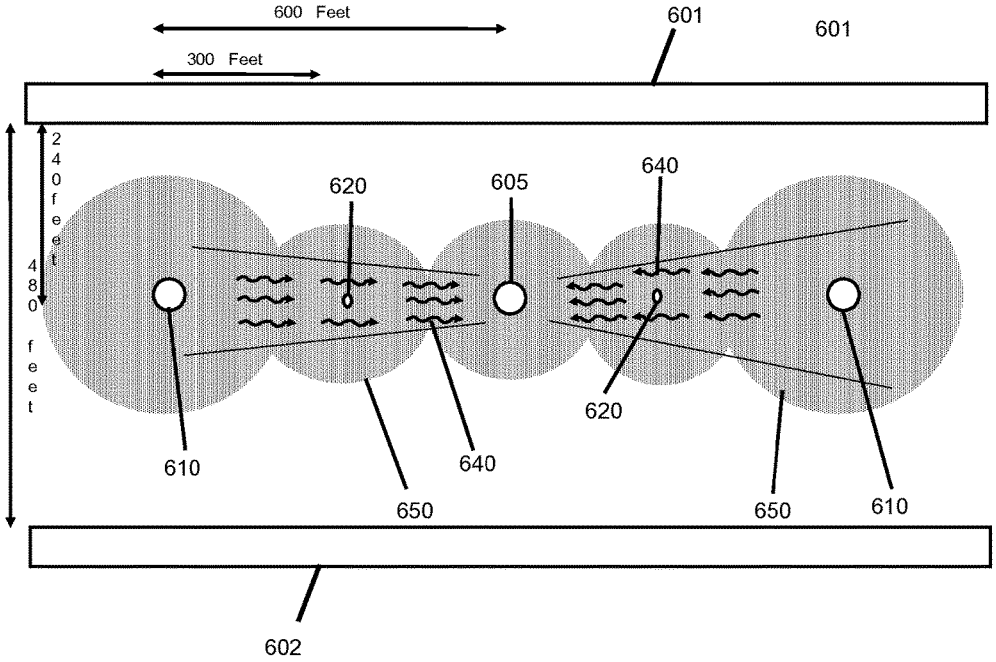
FIGS. 27*a*-27*c* show the evolution of the flow paths for the configuration depicted in FIGS. 25*a* and 25*b*.
Figure 27B:
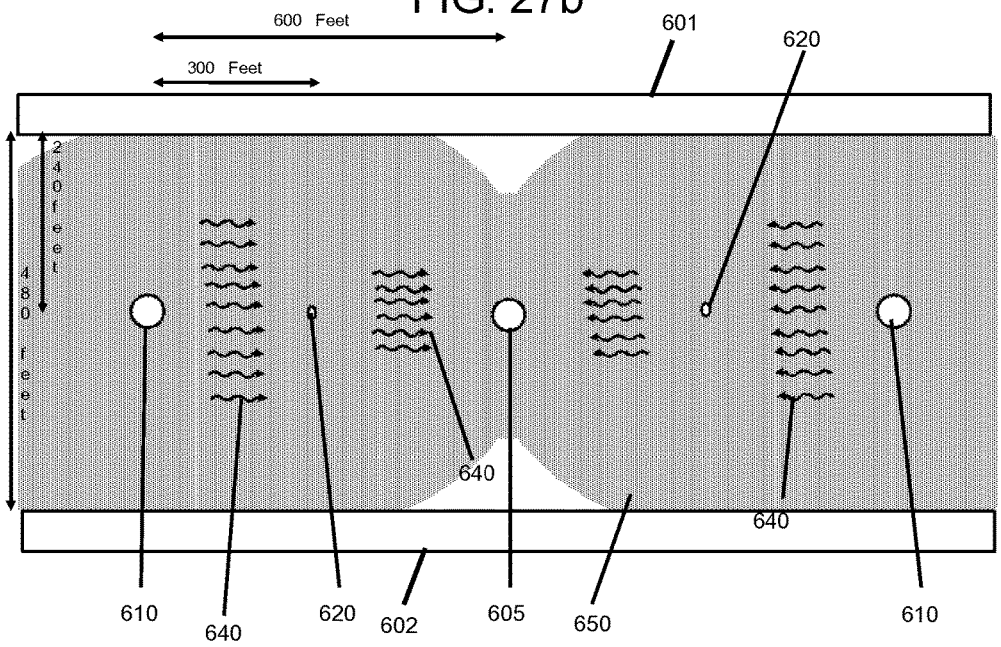

FIG. 27*a* shows the matrix arrangement after 500 hours. FIG. 27*b* shows the matrix arrangement after 750 hours.

Figure 27C:
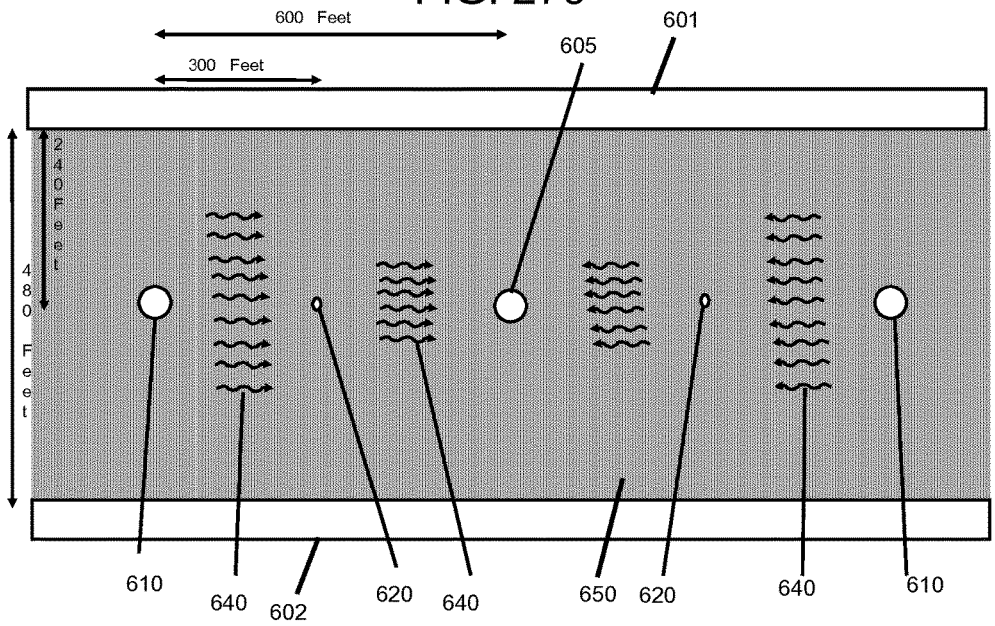

FIG. 27*c* shows the matrix arrangement after 1,250 hours, at which point the entire oil field can flow to the production well 605. Over time, the low viscosity area 650 increases in size and more recoverable oil and gas becomes available. The oil and gas is pushed toward the production well 605 and pulled by the oil production well 605 by pressure waves 640.

Figure 28:
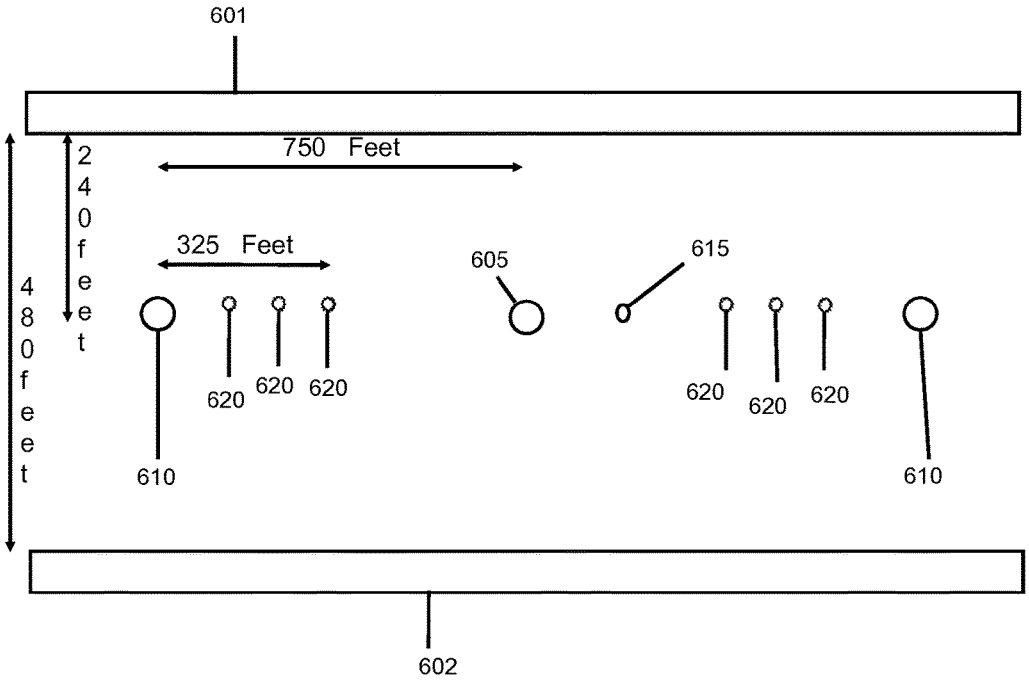
FIG. 28 shows a horizontal view of parallel heat delivery well implementations of the oil/heat delivery matrix with multiple heat delivery wells between the injection well and the production well.
Figure 29:
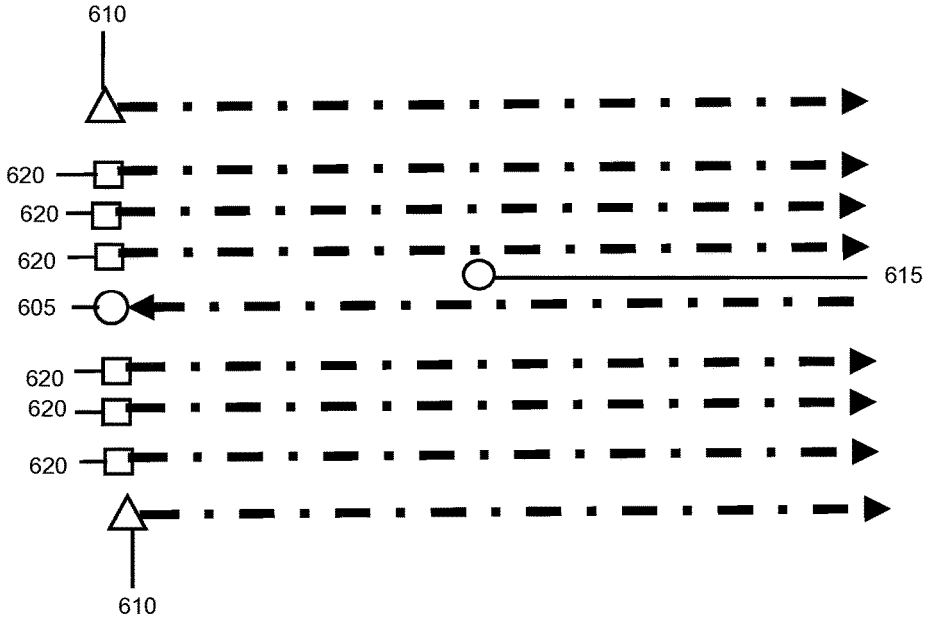
FIG. 29 shows an aerial view of parallel heat delivery well implementations of the oil/heat delivery matrix with multiple heat delivery wells between the injection well and the production well.
Figure 30A:
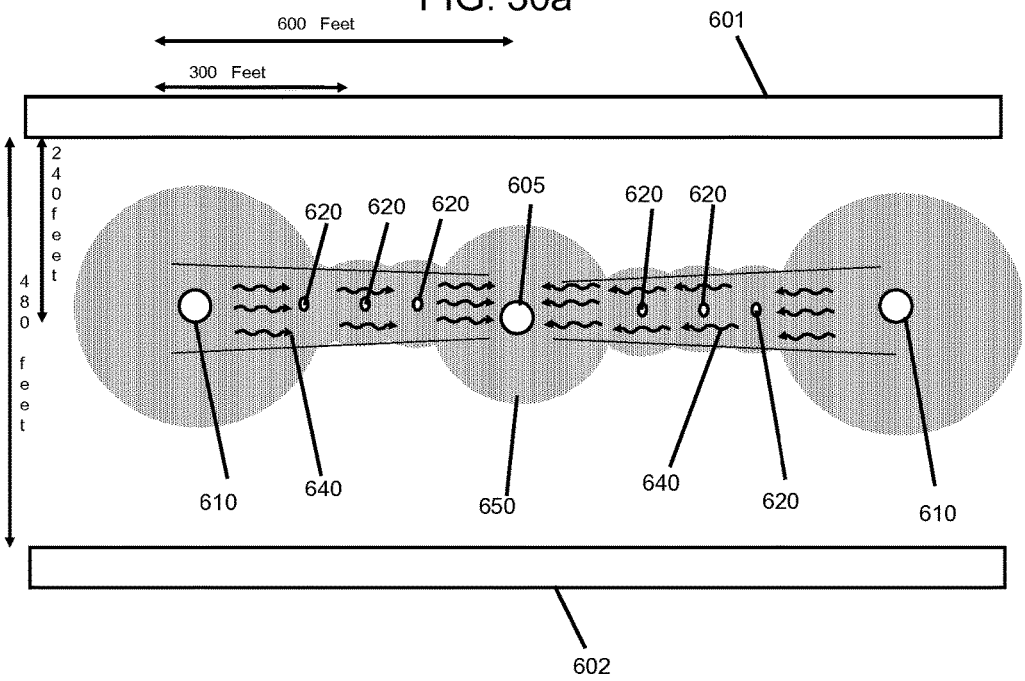
FIGS. 30*a*-30*c* show the evolution of the flow paths for the configuration depicted in FIGS. 28 and 29.
Figure 30B:
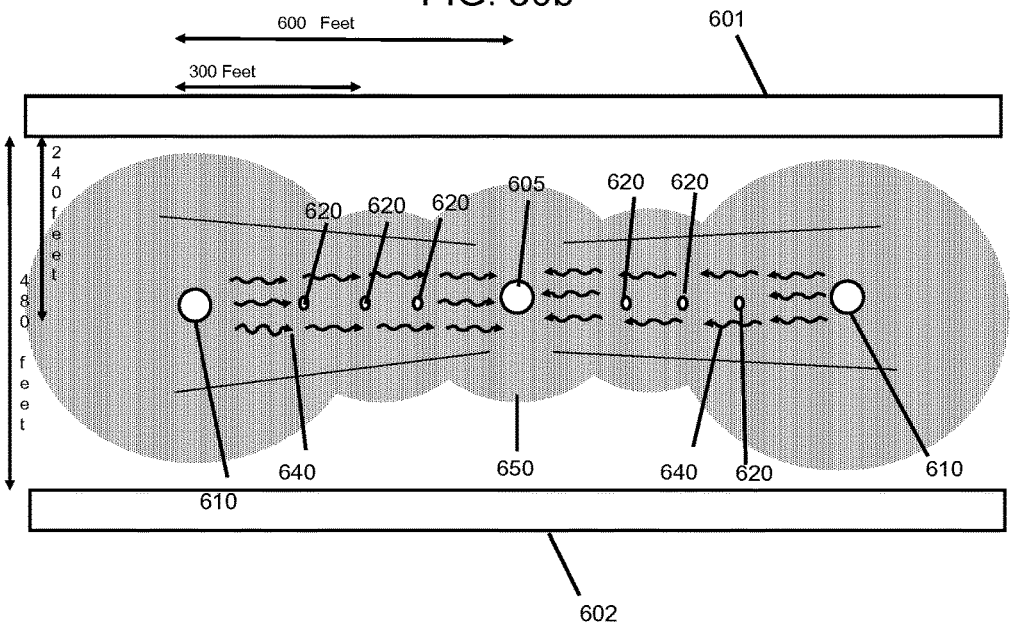
Figure 30C:
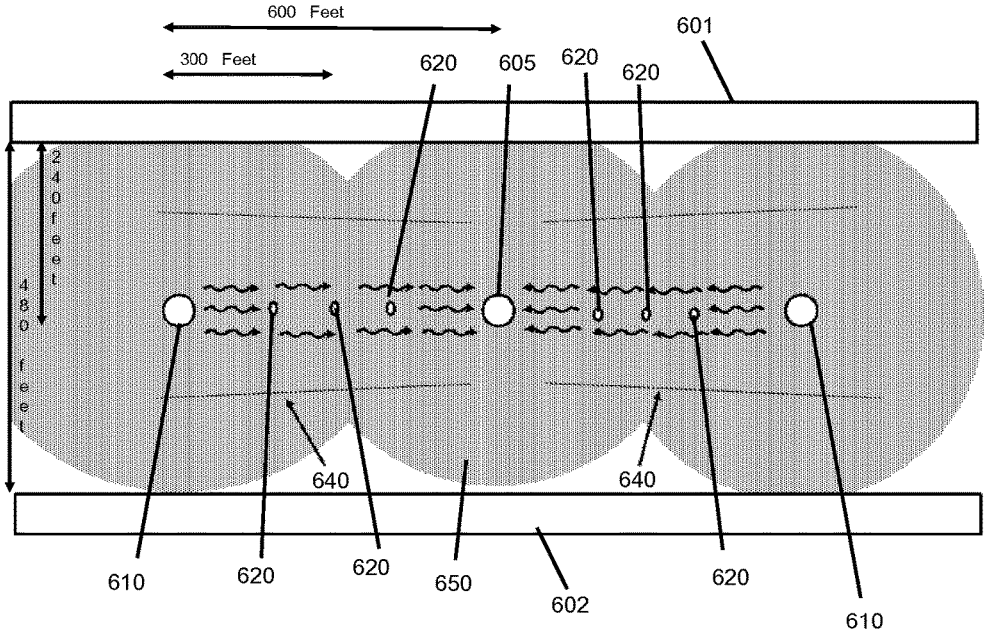

FIGS. 28*a*-30*c* show an example of an embodiment including multiple heat delivery wells 620 positioned between the injection wells 610 and production well 605. In the embodiment shown in FIGS. 28*a*-30*c*, there are three heat delivery wells 620 positioned between injection wells 610 and production wells 605. The distance between the parallel production wells 605 and injection wells 610 can be approximately 600 to 750 feet, and the heat delivery wells 620 can be positioned to be substantially evenly dispersed between the production wells 605 and injection wells 610, as shown in FIGS. 30*a*-30*c*, or can be placed in one half of the distance between the production wells 605 and injection wells 610, as shown in FIG. 28. Depending on the characteristics of the resource, this arrangement may allow a higher percentage of the recoverable oil to be addressed over time.

FIG. 28 shows a horizontal view of the matrix comprising parallel wells with multiple heat delivery wells 620 between the injection wells 610 and production well 605 and FIG. 29 shows an overhead view of such matrix. FIG. 30*a* shows the matrix arrangement after 500 hours. FIG. 30*b* shows the matrix arrangement after 750 hours. FIG. 30*c* shows the matrix arrangement after 1250 hours.

Option 3—Circular Layout

As a third alternative embodiment, a circular well layout can be provided. FIG. 31 shows one example of such an arrangement, which includes production wells 605, injection wells 610, and heat delivery wells 620 arranged circularly around an oil well pad 685. In the embodiment shown in FIG. 31, four well sets 690 are included, each having a production well 605, an injection well 610 and heat delivery well 620. As shown in FIG. 31, low pressure pulses 670 emanate from the production well 605, the heat delivery well 620 radiates heat 675, and high pressure pulses 680 emanate from the injection well 610.

This arrangement can be used in situations where the drilling pad must be located in a central location. For example, this embodiment may be preferred for a reservoir beneath a bog or wetland where it is preferable to locate the surface equipment for the system, such as the equipment shown above the surface in the embodiments of FIGS. 5-8 for example, in a central location on well pad 685. FIG. 31 shows this configuration in a four production well arrangement. In the design shown in FIG. 31, the lateral length of the wells impacts the coverage of the matrix system. A lateral length of 4,800 feet provides an acreage coverage of 1,644, a lateral length of 5,800 feet provides an acreage coverage of 2,401 and a lateral length of 6,800 provides an acreage coverage of 3,300. The matrix could also be implemented in a crosshatched pattern using either straight angles or gentle curving heat delivery wells. This design can also be used for off-shore drilling platforms.

Option 4—Vertical Well Layout

A fourth embodiment for an arrangement is shown in FIGS. 32 and 33. In this embodiment, the production wells 605 and injection wells 610 are vertically oriented and the heat delivery wells 620 are horizontally oriented. This is in contrast to the first arrangement shown in FIGS. 20*a*-23, for example, in which the production wells 605 and injection wells 610 are horizontally oriented and the heat delivery wells 620 are vertically oriented. In the embodiment shown in FIGS. 32 and 33, the arrangement includes a series of injection wells 610 surrounding each production well 605. In this arrangement, the injection wells 610 are arranged in a hexagon form around the production well 605, and the injection wells 610 are separated by approximately 750 feet. The heat delivery wells 620 can be arranged perpendicular to production wells 605 and the injection wells 610, as shown in FIG. 33, and are also separated by approximately 750 feet.

The systems shown in the Figures herein can all incorporate a control system, such as control system 540 shown in FIG. 12 to monitor the performance of the three well types utilized in the well systems according to the invention, including: production wells, injection wells, and heat delivery wells.

The production to injection well spacing can be set so that constructive interference of the pressure pulses created by the injection well (pushing) and the production well (pulling) can be easily synchronized. During operation, pressure amplitude and phasing data can be taken at a monitoring well, and at the injection and production wells, along with flow rates of injected and extracted fluids. Frequency and phasing of the pulsed pumping in the wells can be adjusted to create the constructive interference so that amplitude of the pulses can be maximized for the target extraction zone.

Another key to full reservoir harvesting is to adjust the location of the primary injection and extraction zones (the span of the series of evenly spaced access ports) along the well length as the resource matures, when a significant amount of oil has been extracted, and the region of higher temperature has expanded significantly into the resource. This is critical to directing the pulsed flow waves through newly heated regions in the resource so that the new oil reserves are accessed and swept toward the production well so that the oil to water ratio in the fluid entering the production well is maximized methods involving valves, concentric tubing, and acoustic manipulation can also be used. During operation, the control system can use information from the extracted flows such as flow rates and specifically oil to water ratio to determine when the pressure and flow access regions need to be adjusted. Unlike the pulse frequency and phasing control, which has a control loop cycle of seconds, the pulsed flow access region manipulation will only be adjusted in multiple month or year time periods.

A final key control aspect is the measurement of the heated zone radius around the heat delivery wells. The heated region around the heat delivery wells expands radially from the well bore over time. Knowing the position of the heated region where oil viscosity and surface tension are reduced is critical to determining the specific positioning of the well lengths where flow into and out of the resource needs to be restricted so that the flow path of lower flow resistance leads to harvested volumes of the reservoir. This radius can be measured at various locations on the monitoring well. The monitoring well and heat delivery wells do not run parallel so as to allow the temperature versus radial position from the heat delivery well.

The pressure amplitude of the pulsed pumping wave that is required to loosen oil held in tightly held formations can be determined in advance of operation. During operation, the control system can change the pulse amplitude in relatively small increments and then record the resulting extraction rate and composition of the oil. The energy used to extract the oil will be compared to the yield to maximize the efficiency of the process. This period for the modification of control parameters will be measured in days.

Perturbations of injected flow rate and temperature will also be imposed on the system and the oil extraction results assessed. A control algorithm can calculate the optimum injection rate and fluid temperature to optimize the net energy extracted.

The control system can also vary the amount of electric heat used in the heat delivery wells. Though the electrically imposed heat will produce higher heat saturation rates and temperatures, the resulting oil extraction rate must be balanced against the energy used to produce the electricity used for this purpose. Large amounts of hot fluid will be available for use in the heat delivery wells, so a control algorithm can specify the optimum process parameters to maximize the net energy yield form the formation. It should be noted that this process can be repeated periodically (likely in the monthly timeframe) to reassess the operation optimization, as these parameters will change significantly as the reservoir ages.

The control system can control the system using the following parameters as inputs, where available in the particular system: $CO_2$ flow rate and temperature in the injection well flowing into the formation, including a flow rate and temperature of the $CO_2$ exhaust from a boiler and a flow rate and temperature of the $CO_2$ exhaust optional gas/oil turbine generator; water flow rate in the injection well flowing into the formation composed of water (brine) return flow from the oil/gas/brine separator via the boiler and any additives or additional water used in the injection flow; temperature of the flow rate in the injection well; pressure wave amplitude, mean pressure, and frequency in the injection well; power to the injection well pump/oscillator; pressure wave amplitude, mean pressure, and temperature at the monitoring well at several locations; flow rate and temperature of the production well fluid composed of crude oil, water/brine/additives and gas to the boiler and/or turbine/generator; pressure wave amplitude, mean pressure, and frequency in the production well; power to the production well pump/oscillator; water flow rate to the boiler; temperature of the water flow rate to the boiler; temperature of the water flow rate from the boiler; flow rate of additional gas to the green boiler and/or turbine; separated gas flow rate to the green boiler; separated gas flow rate to the turbine/generator; electricity generated by the turbine/generator; temperature and flow rate to the heat exchanger mixer; temperature and flow rate to the heat delivery well; temperature leaving the heat delivery well; electric power to the heat delivery well; and electric power to the production well casing.

Outputs from the control system controlling the system equipment can include: injection well oscillating pump maximum pressure; injection and production well oscillating pump frequency; production well oscillating pump minimum pressure; water/additive injection flow rate; $CO_2$ injection flow rate; heated water injection flow rate; heated water flow rate to the heat exchanger/mixer; heated water flow rate to the heat delivery well; electric power to the delivery well heaters; electric power to the production well heaters; position of the pressure access port field in the injection well; position of the pressure access port field in the production well; additional gas fuel input to the boiler and/or turbine/generator; gas flow rate to the boiler; and gas flow rate to the turbine/generator.

The above listed inputs and outputs are not exhaustive. The specific parameters can be adjusted to the particular details of a given resource or system equipment configuration.

A modeling system that simulates a specific oil resource to determine the optimum design of the particular comprehensive EOR system is also provided and can specify a preferred system configuration and process operating parameters to maximize both the extraction rate and overall percentage of oil recovered from that field. As previously described herein, the array of wells that form the Heat/Oil Delivery Matrix can have several different configurations, including perpendicular, parallel, or circular arrangements. The modeling system according to the invention is capable of simulating any of these arrangements within the reservoir.

The modeling system can use information taken from acoustic testing and geologic data of the resource, and other factors to specify the well spacing and pulse frequency range that will be effective in low attenuation transmission, and also to determine the spacing and placement of pulsing pump access ports along the injection and production wells, and the location of the primary injection and extraction zones and well length.

The modeling system can be used help anticipate the timing of the injection and extraction zone adjustments during operation as they may require shutdown of extraction processes while the zone adjustments are being made.

The pressure amplitude of the pulsed pumping wave that is required to loosen oil held in tightly held formations will also be determined prior to specifying the entire EOR system. The modeling system will determine this by the oil and formation parameters (pore size distribution, viscosity, surface tension) and the frequency of the pulsed waves used so as to address the minimum practical pore size in the formation that is retaining oil. The modeling system can be used within the control system to predict the appropriate operating parameter adjustments implemented by the control system.

The modeling system can use information from reservoir testing to determine the optimum design of the comprehensive EOR components. The modeling system will also specify the starting operating parameters of the system and project the estimated change in these values over time as a baseline for the control system. Similar to the control system, the system model will specify the component sizing and placement (and operating parameters) to meet both short term and long term output goals.

The reservoir inputs to achieve the output optimization entered into the modeling system will include, but are not limited to: (1) Dimensions of the reservoir field; (2) Temperature distribution of the reservoir; (3) Porosity distribution of the reservoir; (4) Permeability distribution of the reservoir; (5) Size and distribution of the capillary pores in the reservoir; (6) Physical description of the crude oil, including viscosity, density, gas fraction, and water fraction, (7) Conductivity of the in situ oil/rock formation; and (8) Acoustic testing results, including frequency versus dissipation rates over travel lengths and wave speed distribution.

The outputs to the system equipment configuration will system will include, but are not limited to: (1) Location, orientation, and length of the production and extraction wells; (2) Spacing between the production and injection wells; (3) Position, orientation, and length of the heat delivery wells relative to the production and injection; (4) Placement of the monitoring well (location and orientation) to maximize the useful information to the control system during operation; (5) The frequency of the pulsed pumping;

(6) The desired amplitude of the pulsed pumping; (7) The anticipated capacity of the reservoir to accept heat from the heat delivery wells (used to size either electric heaters or fluid circulation capability in the heat delivery wells); (8) The anticipated rate of growth of the heated reservoir zone; (9) Injection pump pulsed volume and power requirement; (10) Extraction pump pulsed volume and power requirement; (11) Heat exchanger/mixer sizing; and (12) Green Boiler (or geothermal well geothermal heat input) sizing to meet the anticipated thermal input potential to the field.

The modeling system will also output a set of predicted system parameters based on the optimized performance of the Heat/Oil Matrix and system components specified. These parameters include, for example, the control system input parameters described previously. In addition, a set of initial operating parameters for the system equipment can be specified, which can include the control system output parameters described previously, when applicable to a given design.

In summary, the comprehensive enhanced oil recovery system according to the invention incorporates several techniques, including: (1) Synergistic integration of the individual enhanced oil recovery techniques into a comprehensive enhanced oil recovery system; (2) Use of a closed loop power and resource supplier that reduces the environment impact of extracting oil and gas; (3) Using constant heat to volumetrically change the viscosity of the treated reservoir so that the integrated techniques will work; (4) Using the extracted gas (and/or crude oil) in a controlled burning environment creating thermal energy to heat the extracted brine while capturing the exhaust ($CO_2$ and other gases) to mix with the brine for water/gas flooding and for $CO_2$ miscibility with the reservoir oil; (5) Using controllable pressure gradients for the extractor ports and the injector ports along the well bore of the production and injection wells; (6) Using an oil/heat delivery matrix to heat the volumetric reservoir, provide flow paths for the oil and gas and directionally mobilize the oil toward the producing wells; (7) Using the controllable pressure gradients with the oil/heat delivery matrix to herd the oil to the producer wells; (8) Oscillate the pressure gradients and position the injection ports and extraction ports one wave length apart (of the oscillating frequency), which creates constructive interference starting one wave length from the injection and production wells, which approximately doubles the amplitude of the pressure waves in the reservoir; (9) Phase controlling the timing of the oscillations in the injection wells and the extractor wells (production wells) so the when the waves meet in the reservoir they again constructively interfere and again double the amplitude of the pressure waves; (10) Using a control system to control all the components of the comprehensive system allowing the system to maximize the flow of oil and gas; (11) In purely fluid flows the pressure amplitude of the pulsed flow is limited by the displacement of the pump and the elasticity of the well/reservoir combination. To address this limitation, an innovative approach has been developed which uses the documented instability of steam collapse under certain conditions to create pressure waves. Normally heated and supersaturated water injected into the reservoir will expand into steam as the pressure drops entering the reservoir and then condense due to gradual thermal loss to the cooler reservoir. By controlling the pressure, temperature, and flow rate of two injected flows, the primary heated water flow and a subcooled water flow can be pulsed so that the steam collapse will become unstable with rapidly fluctuating condensation rates. This will create significant negative pressure spikes in the injected water flow. The flow pulses are all created on the cold water flow so very little energy is required.

The control system may comprise a non-transitory computer readable medium, such as a memory, and a processor configured to execute instructions for adjusting the components of the enhanced oil recovery system in response to feedback received from the monitoring well, pressure sensors and any other input receiving devices in the enhanced oil recovery system in communication with the control system.

TABLE 5

| Legacy Techniques | API Required | Expected Extraction |
|---|---|---|
| Thermal Flooding (Steam) | 5-40+ | 20.0% |
| Water Flooding (Brine) | 30+ | 16.0% |
| $CO_2$ Flooding | 30+ | 20.0% |
| $N_2$ Flooding | 30+ | 12.6% |
| Pulsing Waves | 30+ | 15.0% |

In Table 5, when using legacy enhanced oil recovery processes individually, expected extraction percentages are shown for different APIs Required (excluding heavy crude oil in all but the top row). As may be seen in Table 6, when a comprehensive approach is taken, even assuming a conservative expected extraction of 50% for each process and including heavy crude oil, the system extracts over two times the result of any one legacy system taken alone.

TABLE 6

| Comprehensive System | API Required | Expected Extraction | Cumulative Effect |
|---|---|---|---|
| Thermal Flooding (Steam) | 5-40+ | 10.0% | 10.0% |
| Water Flooding (Brine) | 5-40+ | 8.0% | 18.8% |
| $CO_2$ Flooding | 5-40+ | 10.0% | 30.7% |
| $N_2$ Flooding | 5-40+ | 6.3% | 38.9% |
| Pulsing Waves | 5-40+ | 7.5% | 49.3% |

While there have been shown and described and pointed out fundamental novel features of the invention as applied to preferred embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice.

What is claimed:

1. A method, comprising:

heating an underground reservoir within at least one volume surrounding at least one production well in the underground reservoir, the underground reservoir further comprising a heat transfer matrix configured to transfer heat to increase temperature within the volume surrounding the at least one production well, and recovering crude oil that flows to the at least one crude oil production well in the underground reservoir heated by the heat transfer matrix;

wherein the heat transfer matrix of the underground reservoir comprises at least one thermal injection well arranged in parallel to the at least one production well and at least one heat delivery well arranged along one or more planes intersecting the at least one thermal injection well and the at least one production well;

burning natural gas or a portion of the crude oil extracted from the underground reservoir, or burning both natural gas and crude oil extracted from the underground reservoir, for providing thermal energy, transferring the thermal energy to brine separated from the extracted oil, gas, or both, for providing heated brine, or converting the thermal energy to mechanical work, or both transferring the thermal energy to the separated brine and converting the thermal energy to mechanical work, and heating the underground reservoir with the heated brine injected into the at least one thermal injection well in the underground reservoir, or heating the underground reservoir with a resistive cable in a thermal well comprising a heat delivery well, the resistive cable energized by electricity generated by converting the mechanical work to electric energy, or heating the underground reservoir with both the heated brine and the energized resistive cable.

2. The method of claim 1, further comprising:

burning natural gas recovered with the recovered crude oil, or a portion of the recovered crude oil, or both the recovered natural gas and a portion of the recovered crude oil to heat circulating water and transfer heat from the heated circulating water to the brine extracted from the underground reservoir; and returning the heated brine to the underground reservoir for thermal flooding via at least one of the at least one thermal injection well or at least one heat delivery well.

3. The method of claim 2, further comprising stimulating the underground reservoir within the at least one volume surrounding the at least one production well with synchronized pressure waves provided in the at least one production well and in one or more of the wells for thermal flooding.

4. The method of claim 2, further comprising mixing exhaust gas generated from the burning with the brine for thermal flooding.

5. The method of claim 4, further comprising stimulating the underground reservoir within the at least one volume surrounding the production well with synchronized pressure waves provided in the production well and in one or more of the wells for thermal flooding.

6. The method of claim 1, wherein the transfer of heat gradually spreads within the at least one volume and increases the temperature in the at least one volume until the temperature stabilizes.

7. The method of claim 6, further comprising:

increasing by a selected amount the portion of the recovered crude oil or natural gas recovered with the recovered crude oil, or both, until the temperature stabilizes at a higher temperature level and repeating the increasing by selected amounts until the temperature stops stabilizing at increased temperature levels.

8. The method of claim 1, wherein the at least one thermal injection well is for injecting heated water into the at least one volume surrounding the least one production well and the at least one heat delivery well is for heating the at least one volume surrounding the least one production well with an electric cable or with heated water circulating within the at least one heat delivery well, the at least one volume having the at least one thermal injection well and the at least one heat delivery well arranged in relation to one another and to the at least one production well so as to increase temperature within the at least one volume between the at least one production well and the at least one heat delivery well, and between the at least one production well and the at least one thermal injection well.

9. The method of claim 1, wherein the at least one thermal injection well and at least one heat delivery well are arranged in relation to one another and to the at least one production well so as to define a volumetric shape for the at least one volume surrounding the at least one production well.

10. The method of claim 9, wherein the volumetric shape is a parallelepiped.

11. The method of claim 10, wherein the parallelepiped shape is a rectangular parallelepiped shape.

12. The method of claim 9, wherein the volumetric shape is a polyhedron shape.

13. The method of claim 1, wherein the heat transfer matrix comprises at least two thermal injection wells arranged in parallel to the at least one production well and situated on opposite sides of the at least one production well.

14. The method of claim 13, wherein the heat transfer matrix further comprises at least two heat delivery wells arranged perpendicular to the at least one production well and the at least two thermal injection wells.

15. The method of claim 13, wherein the heat transfer matrix further comprises at least two heat delivery wells arranged along a diagonal relative to the at least one production well and the at least two thermal injection wells.

16. The method of claim 1, further comprising using recycled $CO_2$ in an inlet flow to burning devices so that a flame temperature of combustion can be controlled without adding additional volume to an exhaust stream.

17. An apparatus, comprising:

a heat transfer matrix including:

at least one production well;

at least one thermal injection well; and at least one heat delivery well, wherein the at least one thermal injection well is arranged in parallel to the at least one production well and the at least one heat delivery well is arranged along one or more planes intersecting the at least one thermal injection well and the at least one production well; and wherein the heat transfer matrix is configured to transfer heat to an underground reservoir at least within at least one volume surrounding the at least one production well so as to increase temperature within the at least one volume;

at least one production pump for recovering crude oil that flows to the at least one production well in the underground reservoir heated by the heat transfer matrix;

a boiler for burning natural gas or a portion of the crude oil recovered from the underground reservoir, or for burning both natural gas and a portion of the crude oil recovered from the underground reservoir, for transferring thermal energy to a circulating fluid;

a heat exchanger for receiving both brine separated from the recovered oil and natural gas and the circulating fluid from the boiler for transferring the thermal energy from the circulating fluid to the brine separated from the extracted oil and natural gas, for providing heated brine; and at least one injection pump for injecting the heated brine into the at least one thermal injection well in the underground reservoir for transferring heat to the underground reservoir with the heated brine.

18. The apparatus of claim 17, further comprising pressure wave stimulators for stimulating the underground reservoir within the at least one volume surrounding the production well with synchronized oscillatory pressure waves provided in the at least one production well and the at least one thermal injection well.

19. The apparatus of claim 17, further comprising a mixer responsive to exhaust from the boiler for mixing the exhaust with the brine.

20. The apparatus of claim 17, wherein the at least one thermal injection well and the at least one heat delivery well are arranged in relation to one another and to the at least one production well so as to define a volumetric shape for the at least one volume surrounding the at least one production well.

21. The apparatus of claim 20, further comprising wherein the volumetric shape is a parallelepiped.

22. The apparatus of claim 21, wherein the parallelepiped shape is a rectangular parallelepiped shape.

23. The apparatus of claim 22, further comprising at least two thermal injection wells parallel to the at least one production well and are situated on opposite sides of the at least one production well.

24. The apparatus of claim 23, wherein a part of the production well that is parallel to the at least two thermal injection wells extends at an angle from a perpendicular to a surface of the earth.

25. The apparatus of claim 23, wherein the heat transfer matrix further comprises at least two heat delivery wells arranged perpendicular to the at least one production well and the at least two thermal injection wells.

26. The apparatus of claim 22, wherein the heat transfer matrix further comprises at least two heat delivery wells arranged along a diagonal relative to the at least one production well and the at least two thermal injection wells.

27. The apparatus of claim 20, further comprising wherein the volumetric shape is a polyhedron shape.

28. The apparatus of claim 17, wherein the transfer of heat from the heat transfer matrix gradually spreads within the at least one volume and increases the temperature in the at least one volume until the temperature stabilizes.

29. The apparatus of claim 17, wherein the at least one thermal injection well is configured for injecting heated water into the at least one volume surrounding the least one production well and the at least one heat delivery well is configured for heating the at least one volume surrounding the least one production well with an electric cable or with heated water circulating within the at least one heat delivery well, the at least one volume having the at least one thermal injection well and the at least one heat delivery well arranged in relation to one another and to the at least one production well so as to increase temperature within the volume between the at least one production well and the at least one heat delivery well, and between the at least one production well and the at least one thermal injection well.

30. A method, comprising:

heating an underground reservoir within at least one volume surrounding at least one production well in the underground reservoir, the underground reservoir further comprising a heat transfer matrix configured to transfer heat to increase temperature within the volume surrounding the at least one production well, and recovering crude oil that flows to the at least one crude oil production well in the underground reservoir heated by the heat transfer matrix;

wherein the heat transfer matrix of the underground reservoir comprises at least one thermal injection well arranged in parallel to the at least one production well and at least one heat delivery well arranged along one or more planes intersecting the at least one thermal injection well and the at least one production well; and wherein the method further comprises stimulating the underground reservoir within the at least one volume surrounding the production well with synchronized oscillatory pressure waves provided in the production well and in at least one of the at least one thermal injection well or at least one heat delivery well.

* * * * *